US012752165B2

(12) United States Patent
Ogg

(10) Patent No.: US 12,752,165 B2
(45) Date of Patent: Oct. 6, 2026

(54) LOW DRAG CLUBHEAD WITH ASYMMETRIC AFT PORTION

(71) Applicant: Acushnet Company, Fairhaven, MA (US)

(72) Inventor: Steven Scott Ogg, Carlsbad, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 1104 days.

(21) Appl. No.: 17/877,517

(22) Filed: Jul. 29, 2022

(65) Prior Publication Data

US 2023/0173357 A1 Jun. 8, 2023

Related U.S. Application Data

(63) Continuation-in-part of application No. 17/727,291, filed on Apr. 22, 2022, which is a continuation-in-part of application No. 17/544,033, filed on Dec. 7, 2021, now Pat. No. 12,179,076.

(51) Int. Cl.
*A63B 60/00* (2015.01)
*A63B 53/02* (2015.01)
*A63B 53/04* (2015.01)

(52) U.S. Cl.
CPC ..... *A63B 60/006* (2020.08); *A63B 53/0412* (2020.08); *A63B 53/0466* (2013.01); *A63B 53/023* (2020.08)

(58) Field of Classification Search
CPC ..... A63B 53/0412; A63B 53/0466; A63B 60/006
USPC ..... 473/324–350, 287–292
See application file for complete search history.

(56) References Cited

U.S. PATENT DOCUMENTS 1,503,291 A * 7/1924 Rimmer ..... A63B 53/0487 473/340
3,595,577 A 7/1971 Hodge
4,838,555 A * 6/1989 Kobayashi ..... A63B 60/00 473/327
5,092,599 A 3/1992 Okumoto et al.
D326,885 S 6/1992 Paul
5,120,061 A 6/1992 Tsuchida et al.
(Continued)

FOREIGN PATENT DOCUMENTS

JP H067484 A 1/1994
JP 2018166916 A 11/2018

OTHER PUBLICATIONS

Covey, Tony, Cobra LTDx Drivers, MyGolfSpy.com, Jan. 19, 2022, retrieved on May 11, 2022, https://mygolfspy.com/cobra-ltdx-drivers/.

*Primary Examiner* — Sebastiano Passaniti
(74) *Attorney, Agent, or Firm* — Womble Bond Dickinson (US) LLP

(57) ABSTRACT

Golf club heads with improved aerodynamic properties. In an example, the golf club head has striking face; a sole connected to a bottom side of the striking face; a crown connected to a top side of the striking face. An aft slice of the golf club head includes a rearmost point, a toe-side aft slice on a toe side of the rearmost point, and a heel-side aft slice on a heel side of the rearmost point. The heel-side aft slice has a volume greater than a volume of the toe-side aft slice. The aft slice is defined as a portion of the golf club head to a rear of a slice line and between an outer perimeter of the golf club head and an offset perimeter slice curve.

15 Claims, 36 Drawing Sheets

(56) References Cited

U.S. PATENT DOCUMENTS 5,165,688 A 11/1992 Schmidt et al.
5,397,127 A * 3/1995 Kawada ..... A63B 53/0466 473/331
5,575,725 A 11/1996 Olsavsky
5,645,495 A * 7/1997 Saso ..... A63B 60/02 473/345
5,647,807 A 7/1997 Nagamoto
5,735,754 A 4/1998 Antonious
5,935,020 A 8/1999 Stites
6,074,308 A 6/2000 Domas
6,162,133 A * 12/2000 Peterson ..... A63B 53/0466 473/345
6,168,537 B1 * 1/2001 Ezawa ..... A63B 60/00 473/349
6,319,148 B1 11/2001 Tom
6,942,581 B2 * 9/2005 Kim ..... A63B 53/0466 473/345
7,255,653 B2 * 8/2007 Saso ..... A63B 53/0466 473/345
7,318,780 B2 1/2008 Oywama
7,419,442 B1 * 9/2008 Alan ..... A63B 60/02 473/345
7,658,687 B2 * 2/2010 Hirano ..... A63B 53/0466 473/345
7,887,433 B2 2/2011 Hoffman et al.
7,887,435 B2 * 2/2011 Nishitani ..... A63B 60/00 473/345
7,951,013 B1 5/2011 Snyder et al.
8,043,166 B2 * 10/2011 Cackett ..... A63B 60/00 473/345
8,128,508 B2 3/2012 Sato
8,162,776 B2 * 4/2012 Boyd ..... A63B 53/04 473/345
8,177,659 B1 5/2012 Ehlers
8,182,365 B2 * 5/2012 Wada ..... A63B 53/0466 473/344
8,303,429 B2 11/2012 Cackett et al.
8,337,336 B2 12/2012 Brekke
8,371,957 B2 * 2/2013 Schweigert ..... A63B 53/04 473/409
8,535,174 B2 9/2013 Brekke
8,556,742 B2 * 10/2013 John ..... A63B 53/047 473/238
8,568,247 B1 10/2013 Ehlers
8,678,946 B2 3/2014 Boyd et al.
8,753,224 B1 * 6/2014 Kim ..... A63B 60/00 473/345
8,758,157 B1 6/2014 Ehlers
8,784,234 B2 7/2014 Lacey
8,827,828 B2 9/2014 Brekke
8,870,679 B2 10/2014 Oldknow
9,387,378 B2 7/2016 Shimono
9,433,833 B2 9/2016 Ehlers
9,566,486 B2 2/2017 Griffith
9,597,560 B2 3/2017 Narita et al.
10,080,940 B2 9/2018 Brekke
10,213,666 B1 2/2019 Adams et al.
10,286,265 B2 5/2019 Tsunashima et al.
10,576,338 B2 3/2020 Beach et al.
10,888,750 B2 * 1/2021 Stokke ..... A63B 53/08
11,247,105 B2 2/2022 Beach
11,358,038 B2 * 6/2022 Stites ..... A63B 53/0475
2002/0016215 A1 2/2002 Bamber
2002/0072434 A1 * 6/2002 Yabu ..... A63B 53/0466 473/345
2002/0082111 A1 6/2002 Hedrick
2005/0170907 A1 * 8/2005 Saso ..... A63B 53/0466 473/345
2006/0073911 A1 * 4/2006 Kusumoto ..... A63B 60/00 473/345
2007/0129167 A1 * 6/2007 Matsunaga ..... A63B 53/0466 473/345
2008/0113825 A1 * 5/2008 Funayama ..... A63B 53/0466 473/345
2008/0242445 A1 * 10/2008 Mergy ..... A63B 53/0466 473/282
2009/0209364 A1 * 8/2009 Lukasiewicz, Jr. .... A63B 60/02 473/334
2010/0016097 A1 1/2010 Albertsen
2010/0041492 A1 2/2010 Rice
2010/0056293 A1 3/2010 Cole et al.
2010/0105499 A1 * 4/2010 Roach ..... A63B 53/04 473/335
2010/0304888 A1 * 12/2010 Hirano ..... A63B 53/0466 473/348
2011/0028238 A1 2/2011 Boyd et al.
2011/0081982 A1 4/2011 Stites
2011/0136584 A1 6/2011 Boyd
2011/0250986 A1 * 10/2011 Schweigert ..... A63B 60/02 473/409
2012/0270676 A1 * 10/2012 Burnett ..... A63B 60/00 473/346
2012/0316007 A1 12/2012 Burnett
2013/0231201 A1 9/2013 Matsunga
2013/0324286 A1 12/2013 Sander et al.
2014/0066224 A1 3/2014 Albertsen
2015/0165284 A1 6/2015 Willett et al.
2016/0184663 A1 6/2016 Nivanh
2016/0339306 A1 * 11/2016 Simone ..... A63B 60/00
2017/0021236 A1 1/2017 Ghods
2017/0043222 A1 2/2017 Stokke
2018/0015337 A1 * 1/2018 Burnett ..... A63B 53/0466
2018/0111025 A1 4/2018 Vrska, Jr. et al.
2018/0200586 A1 7/2018 Stites
2019/0001198 A1 1/2019 Burnett
2019/0015713 A1 1/2019 Kato
2019/0275385 A1 9/2019 Saso
2020/0122001 A1 4/2020 Henrikson et al.
2020/0139208 A1 5/2020 Johnson et al.
2022/0111266 A1 4/2022 Henrikson et al.
2023/0173349 A1 6/2023 Ogg
2023/0173352 A1 6/2023 Barksdale et al.
2023/0173355 A1 6/2023 Ogg
2023/0173356 A1 6/2023 Ogg et al.
2024/0189676 A1 6/2024 Barksdale et al.
2024/0325832 A1 10/2024 Barksdale et al.
2024/0416197 A1 12/2024 Ogg et al.
2025/0083007 A1 3/2025 Ogg

* cited by examiner

| Club Head Number | $H_{RC}$ (mm) | $H_{RS}$ (mm) | $T_{Rear}$ (mm) | $L_{FB}$ (mm) | $\Phi_{1/2}$ | $\Phi_{1/3}$ | $\theta_{1/2}$ | $\theta_{1/3}$ |
|---|---|---|---|---|---|---|---|---|
| Example 1 | 36.4 | 19.6 | 17 | 112.9 | 24.3 | 29.4 | 17 | 18.5 |
| Example 2 | 36.4 | 22.8 | 13.7 | 112.9 | 24.3 | 29.4 | 19.9 | 22.6 |
| Example 3 | 36.4 | 26.2 | 10.3 | 112.9 | 24.3 | 29.4 | 22.6 | 26.5 |
| Example 4 | 30.1 | 13.2 | 17 | 112.8 | 28 | 32 | 11.3 | 12.2 |
| Example 5 | 30.1 | 16.4 | 13.8 | 112.8 | 28 | 32 | 13.7 | 13.9 |
| Example 6 | 30.1 | 19.7 | 10.5 | 112.8 | 28 | 32 | 16.7 | 18.1 |
| Example 7 | 42.7 | 26.1 | 16.8 | 112.8 | 19.4 | 24.3 | 22.8 | 25.9 |
| Example 8 | 42.7 | 29.4 | 13.5 | 112.8 | 19.4 | 24.3 | 25.4 | 29.7 |
| Example 9 | 42.7 | 32.6 | 10.3 | 112.8 | 19.4 | 24.3 | 27.9 | 33 |
| Example 10 | 37.4 | 19.6 | 17 | 113.4 | 24.4 | 29.5 | 17 | 18.5 |

FIG. 10

LOW DRAG CLUBHEAD WITH ASYMMETRIC AFT PORTION

RELATED APPLICATION

This application is a continuation-in-part of U.S. application Ser. No. 17/727,291, titled Golf Club Head with Vortex Generators, filed Apr. 22, 2022, which is a continuation-in-part of U.S. patent application Ser. No. 17/544,033, titled Low Drag Clubhead, filed Dec. 7, 2021, the entireties of which are incorporated herein by reference. To the extent appropriate, a claim of priority is made to the above applications.

BACKGROUND

During the game of golf, a golfer may often desire to hit a golf ball further. For instance, with a driver, the golfer may desire to hit the golf ball as far as possible. One factor in the distance the golf ball travels is the club head speed of the golf club as it is being swung. As a golf club is swung by a golfer, the golf club experiences significant drag effects that require greater power from the golfer to achieve higher swing speeds. Thus, a reduction in drag of the golf club head allows for higher club head speeds with the same amount of effort from the golfer.

It is with respect to these and other general considerations that the aspects disclosed herein have been made. Also, although relatively specific problems may be discussed, it should be understood that the examples should not be limited to solving the specific problems identified in the background or elsewhere in this disclosure.

SUMMARY

Examples of the present disclosure describe improved golf club heads with improved aerodynamic properties. In an aspect, the technology relates to a metal-wood type golf club head. The golf club head includes a striking face defining a frontmost point of the golf club head; a sole connected to a bottom side of the striking face; a crown connected to a top side of the striking face. An aft slice of the golf club head includes a rearmost point, a toe-side aft slice on a toe side of the rearmost point, and a heel-side aft slice on a heel side of the rearmost point, the heel-side aft slice having a volume greater than a volume of the toe-side aft slice, wherein the aft slice is defined as a portion of the golf club head to a rear of a slice line and between an outer perimeter of the golf club head and an offset perimeter slice curve. The slice line extends in a heel-to-toe direction and is located a slice depth rearward from the frontmost point, the slice depth being equal to 60% of a front-to-back length of the golf club head. The offset perimeter slice curve is offset from the outer perimeter of the golf club head by a perimeter offset distance of 1 inch.

In an example, the volume of the heel-side aft slice is at least 5% greater than the volume of the toe-side aft slice. In a further example, the volume of the heel-side aft slice is at least 10% greater than the volume of the toe-side slice. In another example, the heel-side aft slice includes a heel-side interior-most point; the toe-side aft slice includes a toe-side interior-most point; and the toe-side interior-most point is positioned higher above a ground plane than the heel-side interior-most point. In still another example, the toe-side interior-most point is at least 0.2 inches above the heel-side interior-most point. In yet another example, the toe-side interior-most point is positioned above the heel-side interior-most point by an asymmetry distance that is at least 5% of a height of the golf club head. In still yet another example, the golf club head further includes a skirt having a thickness that is asymmetric about the rearmost point.

In another aspect, the technology relates to a metal-wood type golf club head that includes a striking face defining a frontmost point of the golf club head; a sole connected to a bottom side of the striking face; a crown connected to a top side of the striking face. An aft slice of the golf club head includes a rearmost point, a heel-side interior-most point, and a toe-side interior-most point, the toe-side interior-most point is positioned higher above a ground plane than the heel-side interior-most point. The aft slice is defined as a portion of the golf club head to a rear of a slice line and between an outer perimeter of the golf club head and an offset perimeter slice curve. The slice line extends in a heel-to-toe direction and is located a slice depth rearward from the frontmost point, the slice depth being equal to 60% of a front-to-back length of the golf club head; and the offset perimeter slice curve is offset from the outer perimeter of the golf club head by a perimeter offset distance of 1 inch.

In an example, the toe-side interior-most point is at least 0.2 inches above the heel-side interior-most point. In another example, the toe-side interior-most point is positioned above the heel-side interior-most point by an asymmetry distance that is at least 5% of a height of the golf club head. In still another example, the aft slice includes a toe-side aft slice on a toe side of the rearmost point, and a heel-side aft slice on a heel side of the rearmost point, the heel-side aft slice having a volume greater than a volume of the toe-side aft slice. In yet another example, the volume of the heel-side aft slice is at least 5% greater than the volume of the toe-side slice. In a further example, the volume of the heel-side aft slice is at least 20% greater than the volume of the toe-side slice. In still yet another example, the golf club head further includes a skirt having a thickness that is asymmetric about the rearmost point.

In another aspect, the technology relates to a metal-wood type golf club head that includes a striking face defining a frontmost point of the golf club head; a sole connected to a bottom side of the striking face; a crown connected to a top side of the striking face. An aft slice of the golf club head includes: a rearmost point; a toe-side aft slice on a toe side of the rearmost point, the toe-side aft slice including a toe-side interior-most point; a heel-side aft slice on a heel side of the rearmost point, the heel-side interior-most point. The heel-side aft slice has a volume greater than a volume of the toe-side aft slice, and the toe-side interior-most point is positioned higher above a ground plane than the heel-side interior-most point. The aft slice is defined as a portion of the golf club head to a rear of a slice line and between an outer perimeter of the golf club head and an offset perimeter slice curve. The slice line extends in a heel-to-toe direction and is located a slice depth rearward from the frontmost point, the slice depth being equal to 60% of a front-to-back length of the golf club head; and the offset perimeter slice curve is offset from the outer perimeter of the golf club head by a perimeter offset distance of 1 inch.

In an example, the toe-side interior-most point is at least 0.2 inches above the heel-side interior-most point. In another example, the toe-side interior-most point is positioned above the heel-side interior-most point by an asymmetry distance that is at least 10% of a height of the golf club head. In yet another example, the volume of the heel-side aft slice is at least 5% greater than the volume of the toe-side slice. In still another example, the volume of the heel-side aft slice is at least 20% greater than the volume of the toe-side slice. In still yet another example, the sole of toe-side aft slice includes a convex segment and the sole of the heel-side aft slice is entirely convex.

In another aspect, the technology relates to a metal-wood type golf club head having improved aerodynamic properties. The golf club head includes a striking face; a sole; a crown; and a plurality of vortex generators positioned in at least one of: an aft half of the sole or an aft half of the crown.

In an example, the plurality of vortex generators are positioned along an arc defined by an offset distance from an outer perimeter of the crown, the offset distance being between 0.2 inches and 1.2 inches. In another example, the plurality of vortex generators include between 12-22 vortex generators. In still another example, a first subset of the vortex generators have a first extension angle, and a second subset of vortex generators have a second extension angle that is different than the first extension angle. In a further example, the first extension angle is a positive angle and the second extension angle is a negative extension angle. In yet another example, at least one of the vortex generators includes a top surface; a bottom surface; a heel side surface; and a leading edge, wherein the leading edge is curved as is extends from a frontmost point of the vortex generator to the top surface of the vortex generator. In still yet another example, the at least one of the vortex generators has a height between 0.05-0.09 inches.

In another example, the plurality of vortex generators are formed on an aft vortex generator inlay. In yet another example, the crown is made from a first material and the aft vortex generator inlay is made from a second material that is different than the first material.

In another aspect, the technology relates to a metal-wood type golf club head having improved aerodynamic properties. The golf club head includes a striking face; a sole; a crown, the crown defining an aft recess in an aft half of the crown; and an aft vortex generator inlay positioned in the aft recess, the aft vortex generator inlay including a base and vortex generators protruding therefrom.

In an example, the aft recess has a depth; the base of the aft vortex generator inlay has a thickness; and the depth is substantially the same as the thickness. In another example, the vortex generators are positioned along an arc defined by an offset distance from an outer perimeter of the crown, the offset distance being between 0.2 inches and 1.2 inches. In yet another example, the vortex generators protrude from an upper side of the base, and the aft vortex generator inlay further includes at least one attachment extension protruding from a lower surface of the base. In a further example, the aft recess includes at least one receiving hole through which the at least one attachment extension is inserted. In yet another example, the crown is made from a first material, and the aft vortex generator inlay is made from a second material that is different than the first material. In still another example, the crown further defines a forward recess, and the club head further comprises a forward inlay that includes an alignment indicator.

In another aspect, the technology relates to a method for manufacturing a golf club head with improved aerodynamic properties. The method includes forming from a first material, by a first manufacturing process, a crown of the golf club head, the crown including an aft recess; forming from a second material, by a second manufacturing process, an aft vortex generator inlay, the aft vortex generator inlay including a base and vortex generators protruding from an upper surface of the base; and inserting the aft vortex generator inlay into the aft recess.

In an example, the first material is a metallic material and the second material is a non-metallic material. In another example, the first manufacturing process is a casting process and the second manufacturing process is an injection molding process. In still another example, forming the aft vortex generator inlay includes forming at least one attachment extension; forming the crown includes forming at least one receiving hole in the aft recess; and inserting the aft vortex generator inlay into the aft recess includes pushing the at least one attachment extension through the at least one receiving hole.

In an aspect, the technology relates to a metal-wood type golf club head having improved aerodynamic properties, the golf club head having a club head frontmost point and a club head rearmost point. The golf club head includes a striking face, the striking face defining the frontmost point; a sole connected to a bottom side of the striking face, the sole having a rearmost point and a closing ascent angle of less than about 35 degrees, wherein the closing ascent angle is: an angle between (1) a line from the rearmost point of the sole to a sole point, of a projected silhouette of the golf club head from a toe-side viewpoint, located one third a front-to-back length from the club head rearmost point, as measured along a ground plane, and (2) a plane intersecting the sole point and parallel to the ground plane; and a crown connected to a topside of the striking face, the crown including a rearmost point and a closing descent angle of less than about 35 degrees. The closing descent angle is: an angle between (1) a line from the rearmost point of the crown to a crown point, of the projected silhouette of the golf club head from the toe-side viewpoint, located one third a front-to-back length from the club head rearmost point, as measured along a ground plane, and (2) a plane intersecting the crown point and parallel to the ground plane; and within 85%-115% of the closing ascent angle of the sole.

In an example, a club head height of the golf club head is at least 2 inches, and a club head length is greater than 4.0 inches. In another example, the golf club head further includes a skirt, wherein rearmost point on the sole is an intersection point of the sole and a lower boundary of the skirt, and the rearmost point on the crown is an intersection point of the crown and an upper boundary of the skirt. In still another example, the lower boundary is a skirt height above the ground plane, and the skirt height satisfies a head-length-to-skirt-height ratio between 3:1 and 8:1. In a further example, the skirt height is between 12-35 mm. In yet another example, the skirt has a skirt thickness that satisfies a head-length-to-skirt-thickness ratio of 6:1 and 11:1.

In another example, the skirt thickness is between 8-20 mm. In a further example, the closing ascent angle is less than 30 degrees and the closing descent angle is less than 30 degrees. In still another example, the closing ascent angle is within 95%-105% of the closing ascent angle of the sole.

In another aspect, the present technology relates to a metal-wood type golf club head having improved aerodynamic properties. The golf club head includes a striking face, the striking face defining a frontmost point of the golf club head; a sole connected to a bottom side of the striking face; a crown connected to a topside of the striking face; a hosel at a heelward side of the golf club head, the hosel including a hosel opening configured to receive a golf club shaft defining a shaft axis. The hosel includes a first tripping structure extending in a direction from the hosel opening towards the sole, the first tripping structure having a height or depth of between 0.005 inches and 0.03 inches; and a second tripping structure extending a direction from the hosel opening towards the sole, the second tripping structure having a height or depth of between 0.005 inches and 0.03 inches and the second tripping structure located apart from the first tripping structure by angular position of 70-170 degrees, as measured around the shaft axis. The golf club head further includes a skirt connected to, and located in between, the crown and the sole, wherein the skirt includes an aft skirt portion at a rear of the golf club head, wherein the aft skirt portion has: a rearmost point that is a head length from the frontmost point of the striking face; a lower boundary located at an intersection of the skirt and sole, wherein the lower boundary is a skirt height above ground plane, the skirt height satisfies a head-length-to-skirt-height ratio between 3:1 and 8:1; and a skirt thickness that satisfies a head-length-to-skirt-thickness ratio of 5:1 and 14:1. In an example, the skirt thickness is between 8-20 mm. In another example, the skirt height is between 12-35 mm.

In another aspect, the present technology relates to a metal-wood type golf club head having improved aerodynamic properties. The golf club head includes a striking face; a sole connected to a bottom side of the striking face; a crown connected to a topside of the striking face; and a hosel at a heelward side of the golf club head, the hosel including a hosel opening configured to receive a golf club shaft defining a shaft axis. The hosel includes a toeward tripping structure extending in a direction from the hosel opening towards the sole, the toeward tripping structure having a height or depth of between 0.005 inches and 0.03 inches, the toeward tripping structure being positioned at a shaft-axis angular position of 0-80 degrees measured around the shaft axis, wherein a zero-degree shaft-axis angular position corresponds to a direction forward of the golf club head and perpendicular to a plane defined by the striking face; and a heelward tripping structure extending a direction from the hosel opening towards the sole, the heelward tripping structure having a height or depth of between 0.005 inches and 0.03 inches, the heelward tripping structure being positioned at a shaft-axis angular position of 260-340 degrees measured around the shaft axis.

In an example, a position of the toeward tripping structure and a position of the heelward tripping structure are substantially symmetric about a line extending along a 350 degree shaft-axis angle, wherein a zero-degree shaft-axis angular position corresponds to a direction forward of the golf club head and perpendicular to a plane defined by the striking face. In another example, the toeward tripping structure is located at a shaft-axis angular position of 30-60 degrees and the heelward tripping structure is located at a shaft-axis angular position of 280-310 degrees. In yet another example, the heelward tripping structure is located apart from the toeward tripping structure by angular position of less than 100 degrees, as measured around the shaft axis. In still another example, the golf club head further includes a second toeward tripping structure and a third toeward tripping structure, the second toeward tripping structure and the third toeward tripping structure located within 30 degrees of the toeward tripping structure, as measured around the shaft axis.

In another example, the toeward tripping structure is one of a ridge or a groove; and the heelward tripping structure is one of a ridge or a groove. In yet another example, the toeward tripping structure has a length of at least 40 mm, and wherein the hosel is configured to cause tripping from laminar flow to turbulent flow around the hosel at a Reynolds number characteristic of flow conditions experienced by golfers. In still another example, the hosel is adjustable and includes an adjustable component having multiple setting positions, wherein the adjustable component includes a portion of a tripping structure for each setting position such that, at each setting position, one of the tripping structure portions aligns with remaining tripping structure portions on the hosel.

In another aspect, the technology relates to a golf club head that includes a striking face, the striking face defining a frontmost point of the golf club head; a sole connected to a bottom side of the striking face; a crown connected to a top side of the striking face, wherein an aft slice of the golf club head has a centroid height ($H_{Centroid}$) that is at least 95% of a height of a geometric center of the striking face above a ground plane and a height ($H_{Low}$) of a lowest point of the aft slice is at least 40% of the height of the geometric center of the striking face above the ground plane, the aft slice being a portion of the golf club head to a rear of a slice line and between an outer perimeter of the golf club head and an offset perimeter slice curve. The slice line extends in a heel-to-toe direction and is located a slice depth rearward from the frontmost point and the slice depth is equal to 70% of a front-to-back length of the golf club head. The offset perimeter slice curve is offset from the outer perimeter of the golf club head by a perimeter offset distance of 0.5 inches.

In an example, the centroid height is equal to at least 50% of a club head height of the golf club head. In another example, the centroid height is at least 28 mm. In still another example, a club head height of the golf club head is at least 2 inches, and a club head length greater than 4.0 inches. In a further example, the centroid height ($H_{Centroid}$) is less than 35 mm. In yet another example, the height ($H_{Low}$) of the lowest point of the aft slice is at least 10 mm and less than 15 mm above the ground plane.

In another example, a second aft slice of the golf club head has a centroid height ($H_{Centroid}$) of at least 28 mm and a height ($H_{Low}$) of a lowest point of the second aft slice is greater than 6 mm above the ground plane, the second aft slice being a portion of the golf club head to the rear of a second slice line and between the outer perimeter of the golf club head and a second perimeter slice curve. The second slice line extends in the heel-to-toe direction and is located a second slice depth rearward from the frontmost point, the second slice depth being equal to 60% of the front-to-back length of the golf club head; and the second perimeter slice curve is offset from the outer perimeter of the golf club head by a second perimeter offset distance of 1.0 inches.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Additional aspects, features, and/or advantages of examples will be set forth in part in the description which follows and, in part, will be apparent from the description, or may be learned by practice of the disclosure.

BRIEF DESCRIPTION OF THE DRAWINGS

Non-limiting and non-exhaustive examples are described with reference to the following figures.

FIG. 10 depicts dimensions of example golf club heads.

DETAILED DESCRIPTION

Due to the swing speeds and the shape of golf club heads, many golf clubs, or parts thereof, operate in a Reynolds number regime in which the state of the viscous boundary layer is typically laminar unless forced to a turbulent state by a tripping structure. On bluff bodies, such as the hosel of a golf club, the laminar boundary layer will separate creating a large wake with a relatively low-pressure region. This low pressure acting on the aft facing surface area results in a drag force that retards the speed of the clubhead at impact. In particular, hosels on golf clubs are often constructed having a circular (or nearly so) cross section. Circular cylinders at subcritical (prior to natural transition) Reynolds numbers have a relatively high drag coefficient as compared to those operating with a turbulent boundary layer. By forcing the transition to occur with a tripping structure the drag can be reduced with a resultant increase in clubhead speed. Due to the rotation of the golf club head, the location and dimensions of the tripping structures become important to create the transition from the laminar flow to the turbulent flow.

In addition to tripping structures on the hosel of the golf club head, the shape of the golf club head may also be altered to improve its aerodynamic properties. For instance, changing the shape of the golf club head, such as the striking face, crown, and sole, causes changes in drag experienced by the golf club head during a swing of the golf club head. As an example, what is commonly perceived as an improved aerodynamic shape to the golf club head is to have the crown and the sole meet a singular point at the aft of the golf club head, such as to form a teardrop shape of the golf club head that has a sharper trailing edge. The present technology, however, goes against that traditional perception of the teardrop shape while still lowering drag and improving the overall aerodynamic properties of the golf club head. For instance, the traditional teardrop shape causes a high closure angle of the crown and/or the sole. This high closure angle causes an earlier, or more forward, separation of the turbulent flow over the crown and the sole, which increases the pressure drag experienced by the golf club head during a swing. The present technology changes, and reduces, the closure angles of the crown and/or the sole to move the separation of the turbulent flow further towards the aft the golf club. These reduced closure angles result in a golf club head that may look less aerodynamic but actually results in a golf club that experiences less pressure drag forces and has overall improved aerodynamic properties. The changes to the closure angles of the crown and/or the sole may be accomplished, for example, by raising an aft portion of the skirt further above the ground plane and/or increasing the thickness of the aft portion of the skirt.

Figure 1:
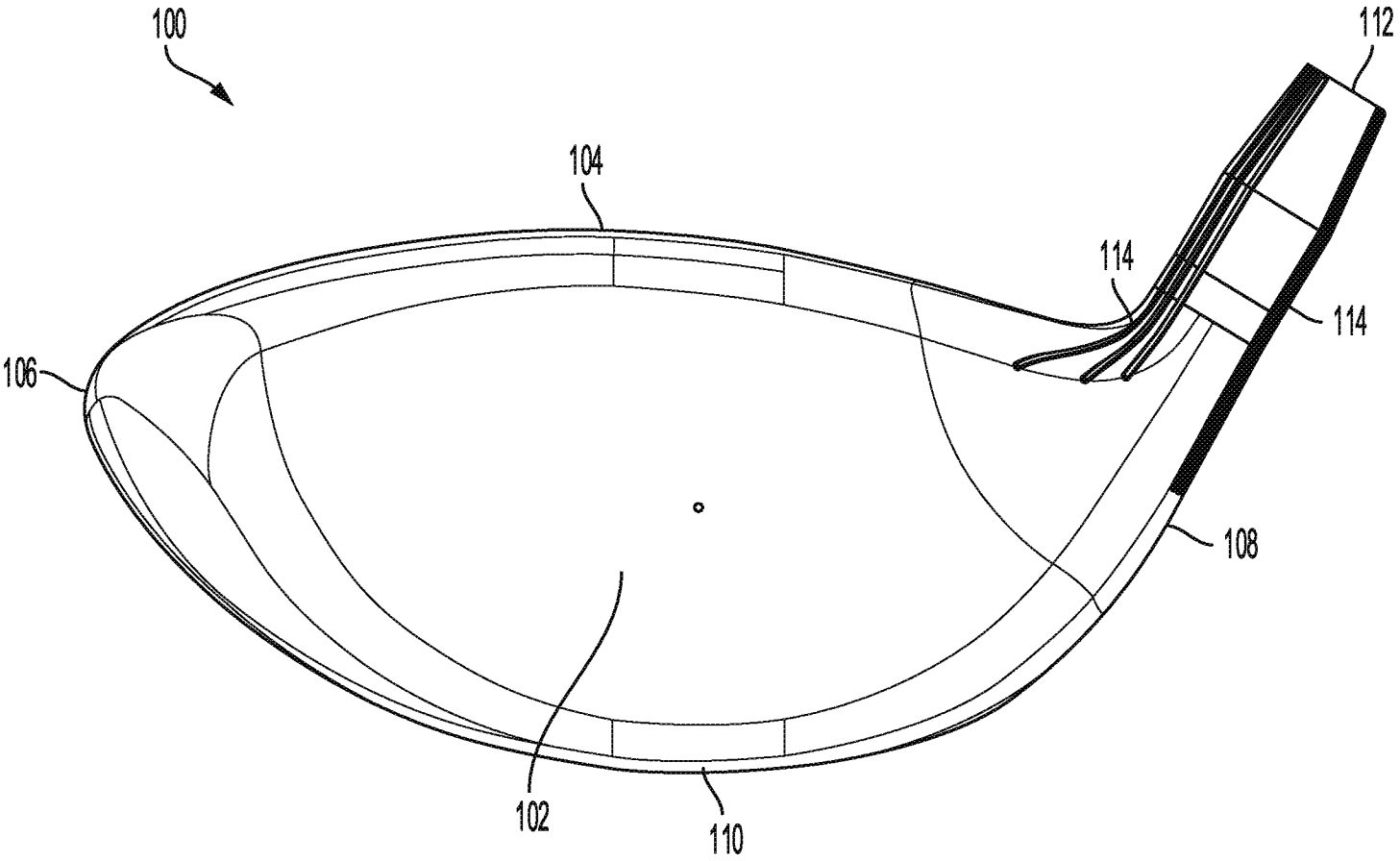
FIG. 1 depicts a front view of an example golf club head including a plurality of tripping structures.
Figure 2:
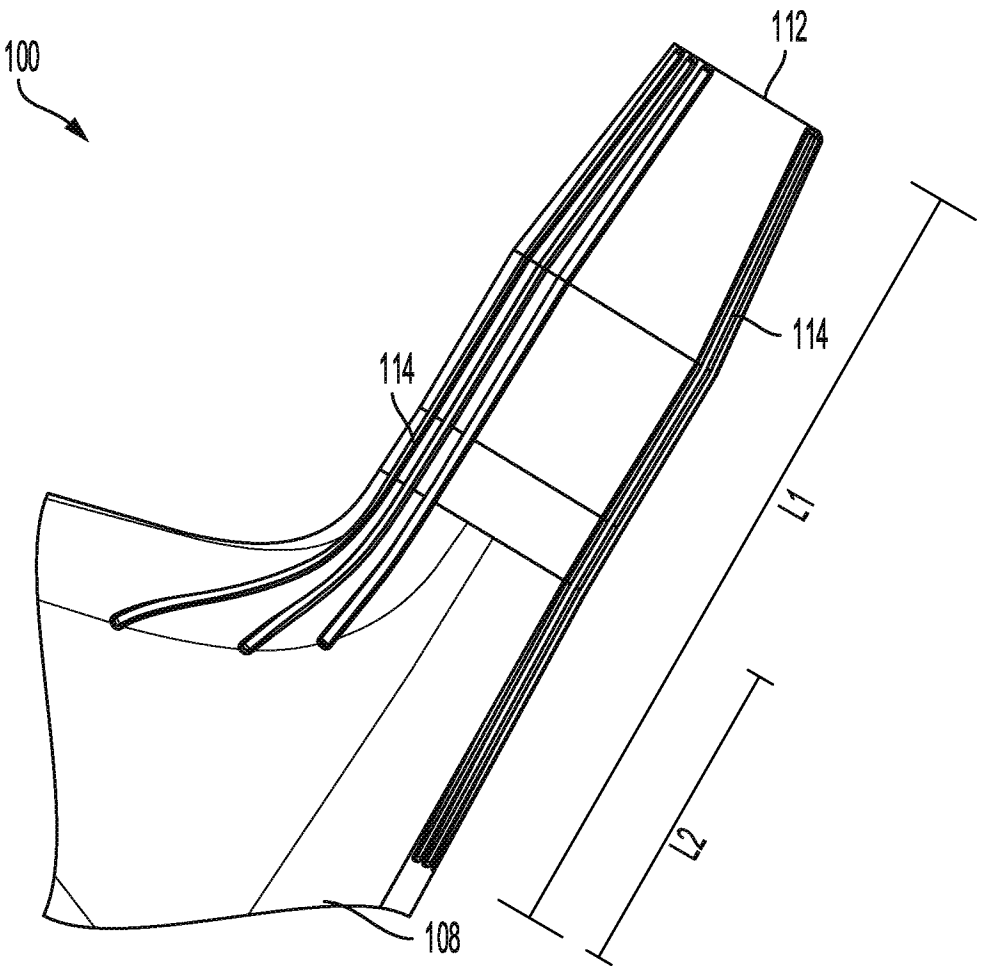
FIG. 2 depicts a front view of a hosel of the golf club head of FIG. 1.

FIG. 1 depicts a front view of an example golf club head 100 including a plurality of tripping structures 114. FIG. 2 depicts an enlarged front view of a hosel of the golf club head of FIG. 1. FIGS. 1-2 are discussed concurrently. The golf club head 100 is metal-wood type golf club head, such as a driver or a fairway metal. The golf club head 100 includes a striking face 102, a crown 104, a toe region 106, a heel region 108, and a sole 110. The crown 104 and the sole 110 may be attached to the striking face 102. For instance, the crown 104 is attached to a topside of the striking face 102 and the sole 110 is attached a bottom side of the striking face 102.

The golf club head 100 also includes a hosel 112. The hosel 112 is used to attach a shaft (not depicted) to the golf club head 100. The hosel 112 may be formed into at least a portion of the crown 104 and the heel portion 108. The hosel 112 may also include a ferrule or components of an interchangeable shaft system.

The hosel 112 also includes a plurality of tripping structures 114. In the example depicted, the tripping structures 114 are formed as elongate ridges extending from the top of the hosel towards the sole. This particular pattern has three substantially parallel ridges on both the heelward and toeward side of the hosel. The height of the ridges (e.g., the distance the ridges protrude from the surface of the hosel) may be between 0.005 inches and 0.03 inches. In some examples, the height of the ridges is between 0.009 inches and 0.015 inches.

The length (L1) of the tripping structures 114 may be between 30-70 mm. In some examples, the length (L2) of the tripping structures 114 may be greater than 40 mm. The length of the tripping structures 114 may also be considered as two components, a first length component that extends through a ferrule and any additional hosel components (e.g., adjustable shaft components, rings, sleeves, etc.) and a second length component extending across the body of the club head 100, such as the heel region 108 of the club head 100. The second length component is represented as L2 in FIG. 2, and represents the length of the tripping structures 114 across the body of the club head 100. The second length component (L2) may be between 15-35 mm, 20-30 mm, and/or may be at least 20 mm. In some examples, the heelward tripping structures and the toeward tripping structures 114 may have the same length. In other examples, the heelward tripping structures 114 may have a greater length than the toeward tripping structures 114. In yet other examples, the toeward tripping structures 114 may have a greater length than the heelward tripping structures 114.

Figure 3A:
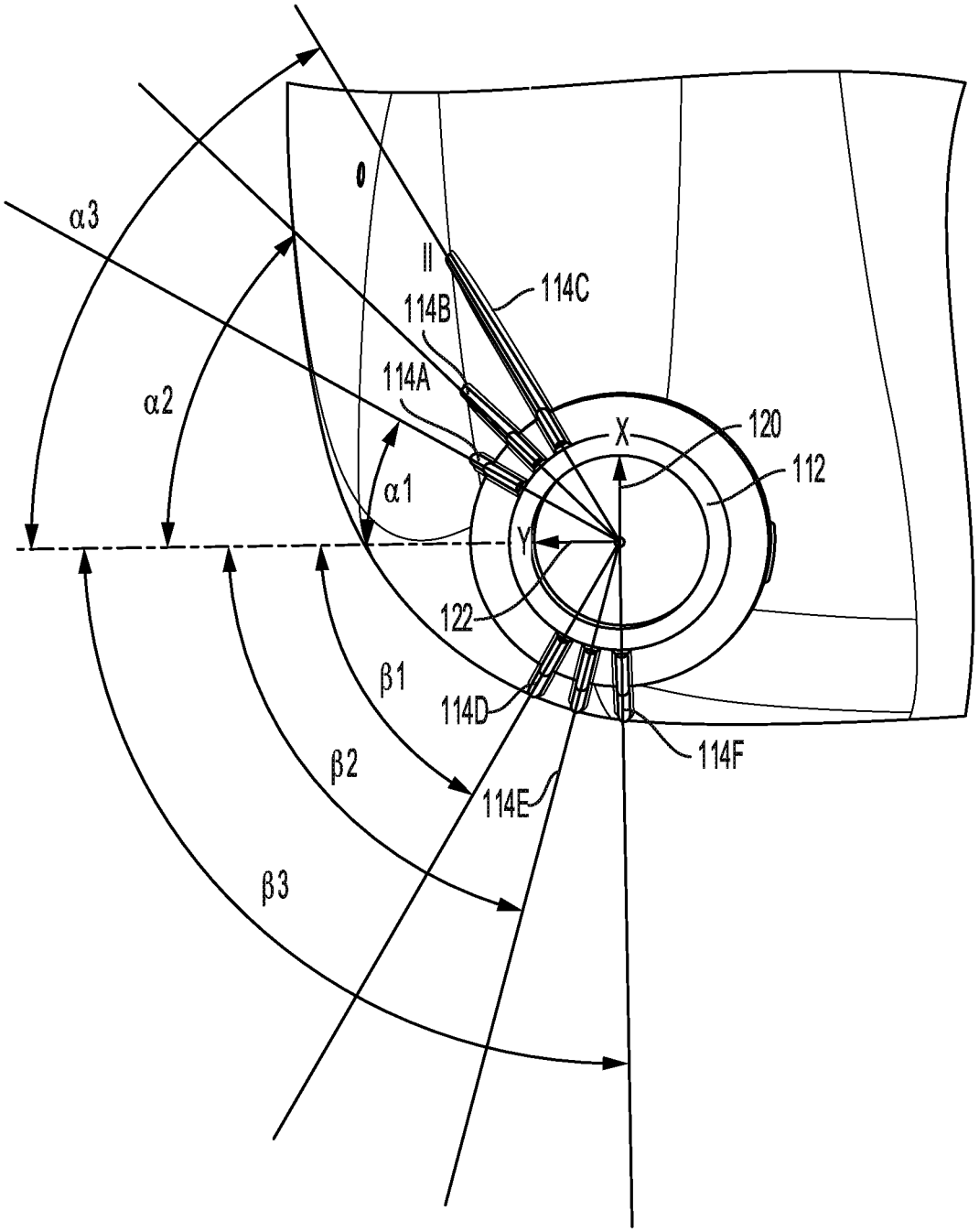
FIGS. 3A-3B depict top views of the hosel of the golf club head of FIG. 1.
Figure 3B:
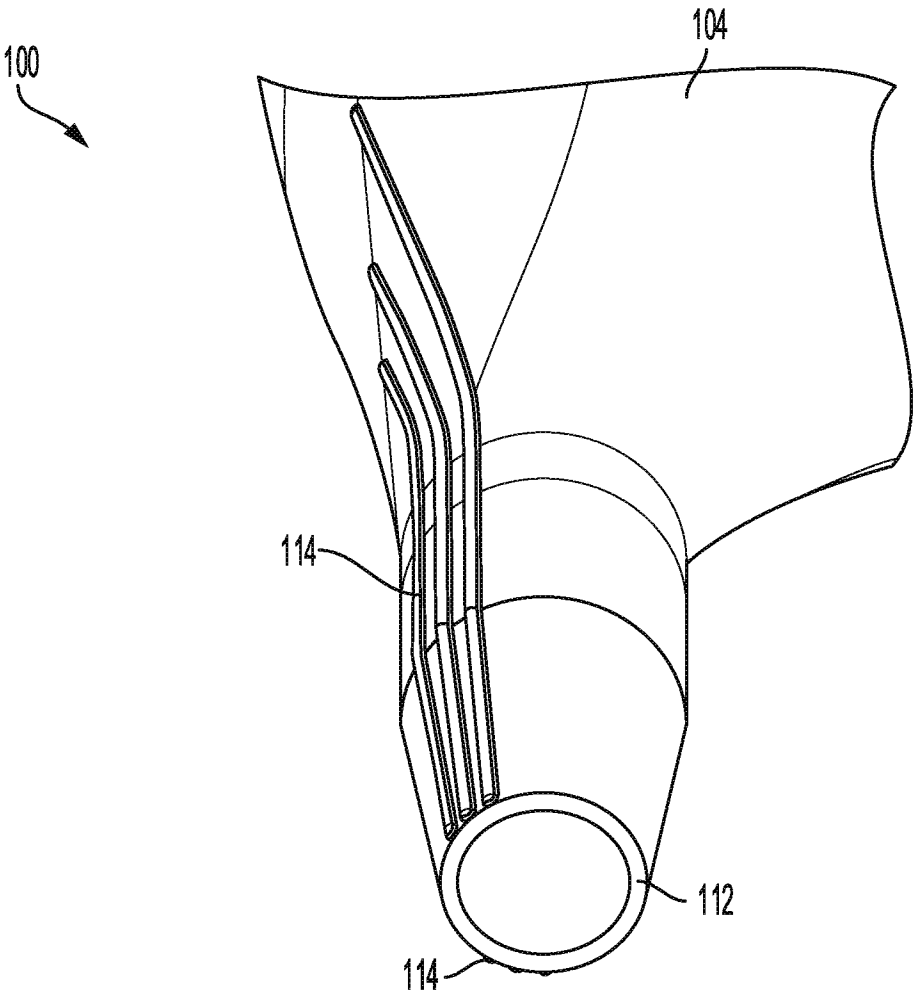
Figure 4:
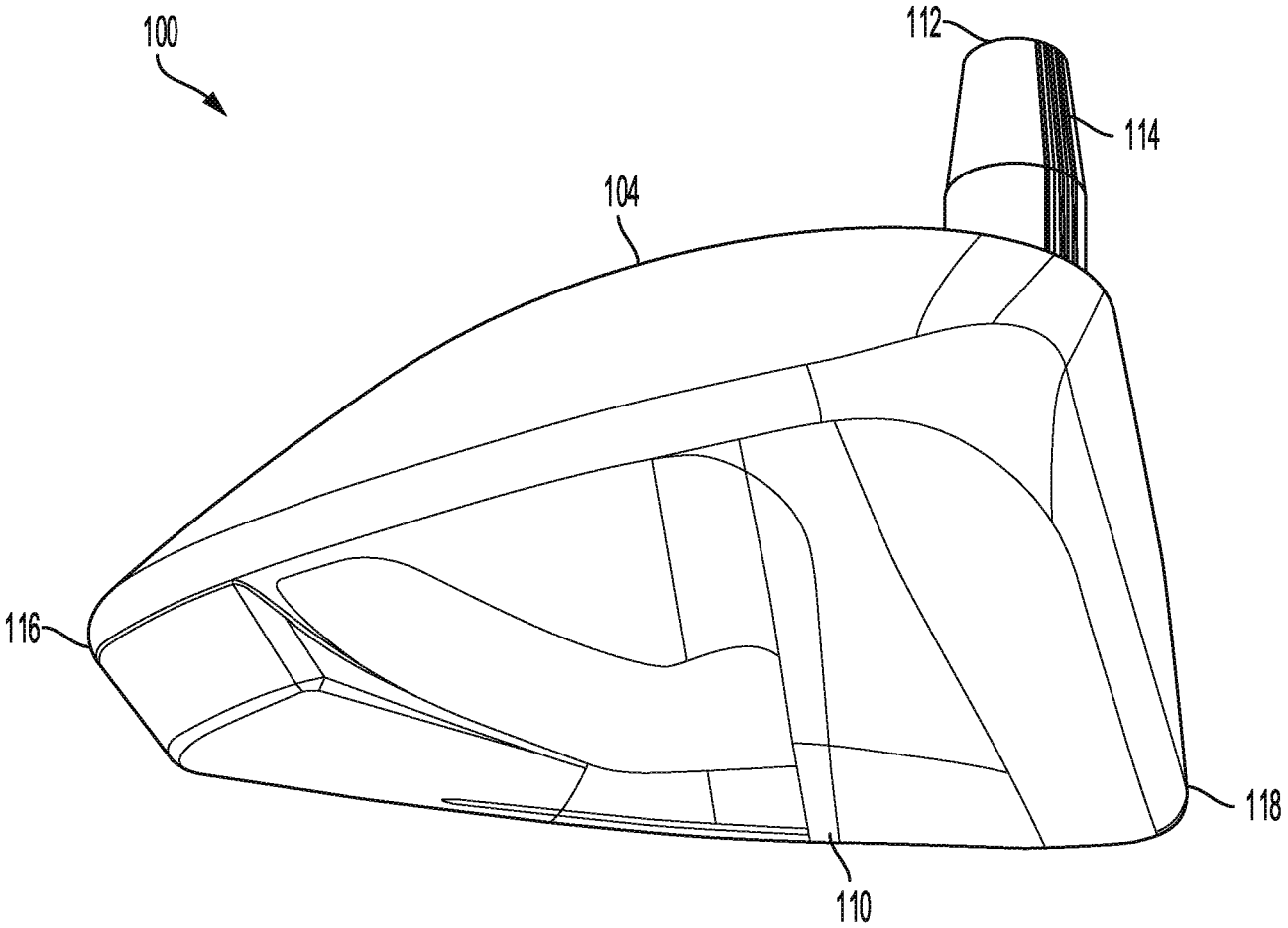
FIG. 4 depicts a toe-side view of the golf club head of FIG. 1.
Figure 5:
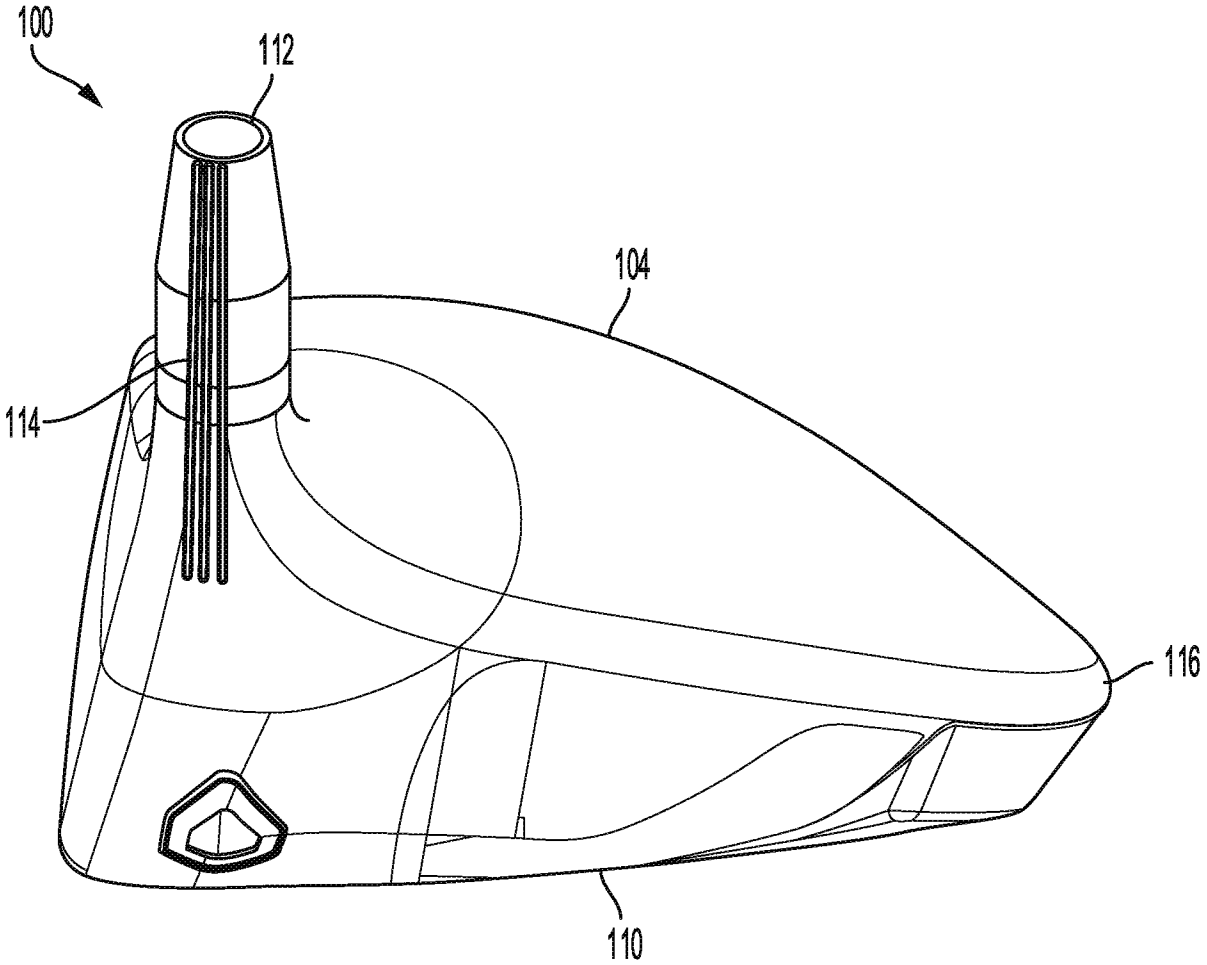
FIG. 5 depicts a heel-side view of the golf club head of FIG. 1.

FIGS. 3A-3B depict top views of the hosel of the golf club head of FIG. 1. FIG. 4 depicts a toe-side view of the golf club head of FIG. 1, and FIG. 5 depicts a heel-side view of the golf club head of FIG. 1. As can be seen from FIGS. 4-5, the golf club head 100 includes a rearmost point 116 (e.g., a trailing edge) and a frontmost point 118 (e.g., a leading edge). FIGS. 3A-3B, 4, and 5 are discussed concurrently.

FIG. 3A depicts a view down the shaft axis (e.g., an axis formed by a shaft that would be connected to the hosel) of the golf club head 100 and indicates the angular positions of the tripping structures with respect to the shaft axis. In FIG. 3A, the three toeward tripping structures 114 are individually labeled as a first toeward tripping structure 114A, a second toeward tripping structure 114B, and a third toeward tripping structure 114C. The three heelward tripping structures are also individually labeled as a first heelward tripping structure 114D, a second heelward tripping structure 114E, and a third heelward tripping structure 114F.

The locations or positions of the tripping structures 114 account for the rotational movement of the club head during a swing of a golf club head. For instance, during the downswing of golf club, the heelward tripping structures 114D-F are more exposed to the airflow, whereas at impact and during the follow through, the toeward tripping structures 114A-C are more exposed to the airflow. Due to the toeward tripping structures 114A-C being located more towards the striking face 102, the toeward tripping structures 114A-C also provide tripping effects during the downswing of the golf club head 100.

The location or position of each of the tripping structures 114 may be described as an angular position around the shaft axis. The angular positions may be described as relative to a toe-to-heel axis 120 or a front-to-back axis 122. The front-to-back axis 122 is an axis that runs from the front of the golf club head 100 to the back of the golf club head, and the toe-to-heel axis 120 is an axis that runs from the toe to heel of the golf club head 100 and is substantially perpendicular to the front-to-back axis 122. For instance, the front-to-back axis 122 may be perpendicular to a plane defined by the striking face 102. In the examples used herein, the front-to-back axis 122 has a zero-degree position pointing forward of the golf club head 100. For instance, the zero-degree shaft-axis angular position may correspond to a direction forward of the golf club head 100 and perpendicular to the plane defined by the striking face 102. The origin of the front-to-back axis 122 and the toe-to-heel axis 120 may be located at the center of the hosel (e.g., at the shaft axis).

The tripping structures 114 on the toeward side of the front-to-back axis 122 are referred to as the toeward tripping structures 114, and the tripping structures 114 that are on the heelward side of the front-to-back axis 122 are referred to as the heelward tripping structures 114. As measured from the front-to-back axis 122, the first toeward tripping structure 114A is located 30 degrees around the shaft axis, as represented by angle $\alpha$1, as measured in a clockwise direction. The second toeward tripping structure 114B is offset by 15 degrees around the shaft axis from the first toeward tripping structure 114A. The third toeward tripping structure 114C is offset by 15 degrees from the third toeward tripping structure 114C. In other words, the second toeward tripping structure 114B is located 45 degrees around the shaft axis, as represented by angle $\alpha$2, and the third toeward tripping structure 114C is located 60 degrees around the shaft axis, as represented by angle $\alpha$3.

Of note, the toeward tripping structures 114A-C are located towards the front of the golf club head 100 from the toe-to-heel axis 120. In other words, the toeward tripping structures are located between 0-90 degrees around the shaft axis as measured from the front-to-back axis 122. By positioning the toeward tripping structures 114A-C towards the front of the golf club head 100, the toeward tripping structures 114A-C are able to provide the tripping effect for more of the downswing of the golf club as the golf club rotates from an open position to a closed position.

As also measured from the front-to-back axis 122, the first heelward tripping structure 114D is located −60 degrees around the shaft axis, as represented by the angle $\beta$1. The second heelward tripping structure 114E is offset by 15 degrees around the shaft axis from the first heelward tripping structure 114D. The third heelward tripping structure 114F is offset by 15 degrees around the shaft axis from the second heelward tripping structure 114E. In other words, the second heelward tripping structure 114E is located −75 degrees around the shaft axis, as represented by angle $\beta$2, and the third heelward tripping structure 114F is located −90 degrees around the shaft axis, as represented by angle $\beta$3. In some examples, the heelward tripping structures may be more easily measured from the toe-to-heel axis 120. For instance, the third heelward tripping structure 114F is aligned with, or parallel to, the heel-to-toe axis 120.

The first toeward tripping structure 114A may be referred to as the frontmost toeward tripping structure 114A, and the first heelward tripping structure 114A may be referred to as the frontmost heelward tripping structure 114D. The frontmost toeward tripping structure 114A and the frontmost heelward tripping structure 114D in the example depicted are positioned 90 degrees apart from one another.

The angular positions of the tripping structures 114 described above are for a particular example, and some variations on the angular positions may also be implemented to achieve the tripping effects described herein. For example, the toeward tripping structures 114 may be located within 0-80 degrees, 10-80 degrees, 10-70 degrees, and/or 30-70 degrees around the shaft axis as measured from the front-to-back axis 122. The heelward tripping structures 114 may be located between −30 to −90, −50 to −90, −60 to −90, and/or −40 to −110 degrees around the shaft axis as measured from the front-to-back axis 122.

The toeward tripping structures 114 and/or the heelward tripping structures 114 may be spaced from one another by an angular amount of 5-25 degrees and/or 10-20 degrees. In some examples, such as the one depicted in FIG. 3A, the toeward tripping structures 114A-C and/or the heelward tripping structures 114D-F may be evenly spaced from one another.

One or more of the toeward tripping structures 114A-C may be symmetrically positioned about radial line of 350 degree (i.e., −10 degree) shaft-axis angle from one or more of the heelward tripping structures 114D-F. For instance, a position of the toeward tripping structure and a position of the heelward tripping structure may be substantially symmetric about a line extending along a 350 degree shaft-axis angle. Such symmetry may improve the overall aerodynamic properties of the hosel 112. As an example, a toeward tripping structure being positioned at a shaft-axis angular position of 0-80 degrees measured around the shaft axis, and a heelward tripping structure may be positioned, symmetrically about the 350 degree line, at a shaft-axis angular position of 260-340 degrees measured around the shaft axis. the toeward tripping structure is located at a shaft-axis angular position of 30-60 degrees and the heelward tripping structure is located at a shaft-axis angular position of 280-310 degrees.

The heights, lengths, and locations of the tripping structures 114 discussed herein are able to trigger a transition from a laminar flow to a turbulent flow around the hosel at the Reynolds numbers and swing speeds typically associated with the swinging of a golf club head. For instance, the tripping structures 114 may be configured to cause tripping from laminar flow to turbulent flow around the hosel at a Reynolds number characteristic of flow conditions experienced by golfers (such as less than 30,000), as the hosel 112 of the golf club head 100 usually is within a 20,000 to 50,000 Reynolds number regime. In addition, the dimensions and locations of the tripping structures 114 are important for causing the transition from the laminar flow to turbulent flow in the proper location. For example, if the tripping occurs too early, the flows will fully separate and not reattach, or if there is a very strong favorable gradient, the flows will relaminarize and then separate—both of which may actually increase drag. The present dimensions and locations of the tripping structures 114 prevent such adverse phenomenon even when the golf club head rotates during a golf swing.

While the tripping structures 114 shown in FIGS. 1-5 are ridges that protrude outwardly from the hosel, in other examples, the tripping structures 114 may take different forms. For instance, the tripping structures 114 may be formed as grooves rather than ridges. The depth of the grooves may be the same as the height of the ridges discussed herein. The grooves may also have similar lengths and positions as the ridges. In some examples, grooves and ridges may be utilized, and the height may be considered an amplitude measured from the peak of the ridge to the valley of the groove.

The tripping structures 114 may also be formed from tooling marks, that have adequate roughness to transition the boundary layer, positioned in similar locations and orientations as the ridges discussed above. Additional patterns, such as three-dimensional sine waves that are roughly axisymmetric with respect to the shat or hosel axis, may also be used. The sine waves may also be a function of both position along the shaft or hosel axis and the circumferential position around the hosel. A three-dimensional pattern of interconnect ridges, such as a hexagonal pattern, may also be used as tripping structures 114. Dimples or pimples (e.g., the opposite of dimples) may also be used as tripping structures 114 in some examples.

Figure 6:
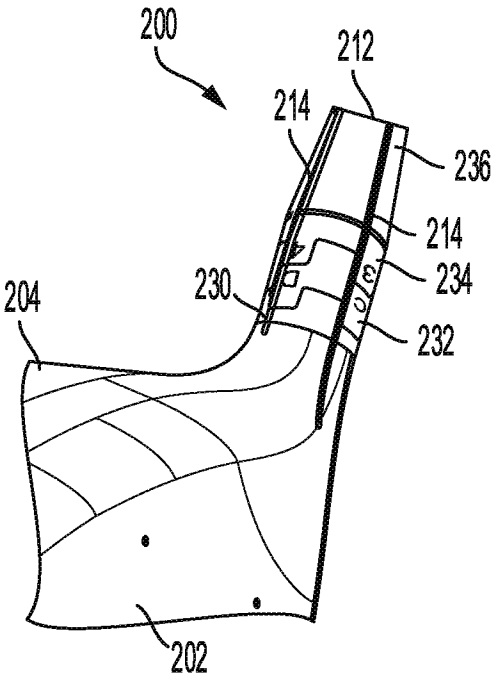
FIG. 6 depicts an adjustable hosel including tripping structures.

FIG. 6 depicts a partial perspective view of a golf club head 200 with an adjustable hosel 212 including tripping structures 214. As with the other examples described above, the golf club head 200 has a striking face 202 and a hosel 212 extends from the crown 204. The adjustable or configurable hosel 212 may be a part of a shaft connection system, and/or the configurable hosel 212 may be adjusted to change characteristics of the golf club head 200, such as the loft and/or lie characteristics of the golf club head 200.

The example configurable hosel 212 depicted in FIG. 6 is similar to the SUREFIT® hosel system from the Acushnet Company of Fairhaven, Massachusetts. The configurable hosel 212 includes a fixed portion 230 attached to the club head 200 near the crown 204 and two configurable or adjustable components: a rotatable ring 232 and a rotatable sleeve 234. The fixed portion 230, the rotatable ring 232, and the rotatable sleeve 234 each include a series of tangs and notches. When the configurable hosel 212 is tightened together, the tangs fit into the notches. By rotating the ring 232 and the sleeve 234, multiple different configuration states for the configurable hosel 212 may be achieved. In the example depicted, the ring 232 includes four different settings as indicated by letter markings A-D, with each setting including a different tang on the ring 232. The sleeve 234 similarly has four different settings as indicated by number markings 1-4, with each setting including a different tang on the sleeve 234. The configuration state of the configurable hosel 212 corresponds to the settings of the ring 232 and the sleeve 234 that are aligned with an alignment reference indicator on the fixed portion 230. A ferrule 236 may also be included. Additional details regarding a similar configurable hosel system may be found in U.S. Pat. No. 9,403,067, titled "Interchangeable Shaft System," which is incorporated herein by reference in its entirety.

The configurable hosel 212 also includes tripping structures 214. The tripping structures 214 may be divided into separate pieces or portions corresponding to the number of different components in the configurable hosel 212. In the example depicted, there are four components of the adjustable hosel 212—the fixed portion 230, the rotatable ring 232, the rotatable sleeve 234, and the ferrule 236. The tripping structures 214 extend across each of the four components. To allow for adjustment of the adjustable hosel 212, each of the tripping structures are separated into four pieces corresponding to the four different components of the adjustable hosel 212. For instance, each tripping structure 214 may have a first piece on the ferrule 236, a second piece on the sleeve 234, a third piece on the ring 232, and a fourth piece on the fixed portion 230. Each of the pieces of the tripping structure 214 may be separated from one another, such as by a cut, or the pieces of the tripping structures 214 may be separately formed as part of the respective components, such as the ring 232 and the sleeve 234. Accordingly, as the adjustable components of the hosel 212 (e.g., the ring 232 and the sleeve 234) are rotated, the corresponding piece of the tripping structure 214 move with the respective adjustable component. For example, the pieces of tripping structures 214 located on the ring 232 move with the ring 232 as the ring 232 is rotated.

The number and/or positions of the tripping structures 214 may be based on the number of different settings available from the adjustable components of the hosel 212. In the example depicted, the ring 232 and the sleeve 234 each have four possible settings (e.g., settings A-D and settings 1-4). Accordingly, four tripping structures 214 may be incorporated into the hosel 212. Each of the four setting positions on the ring 232 and the sleeve 234 are offset by 90 degrees (e.g., 360 degrees divided by four). Thus, the four tripping structures 214 are also offset from one another by 90 degrees. As a result, in any setting combination of the ring 232 and the sleeve 234, the respective pieces of the tripping structures 214 align with other pieces of the tripping structures 214 to form the full-length tripping structures 214. With the offsets of 90 degrees, the tripping structures 214 may be located in the angular positions discussed above with respect to FIGS. 1-5. The pieces of the tripping structures 214 on the adjustable components of the hosel 212 may also be made such that all the pieces have the same size and shape (e.g., same thickness, length, width, cross-section, etc.), which further allows for consistent forming of the full tripping structures 214 in any of the settings of the adjustable components.

As another example, if the adjustable components have only three settings, three tripping structures 214 may be included and may be offset by 120 degrees, whereas if the adjustable components have five settings, five tripping structures 214 may be incorporated and may be offset by 72 degrees. The number of tripping structures 214 may be equal to the number of settings, and the offset angle of the tripping structures 214 may be based on the offset angles of the different settings of the adjustable components. In some examples, multiple tripping structures 214 may be included on each of the different settings (such as the tangs of the ring 232). In such examples, the number of tripping structures 214 may be equal to a multiple of the number of settings. For instance, for an adjustable component with four settings, 4, 8, 12, or 16 tripping structures 214 may be included on the hosel 212.

Figure 7:
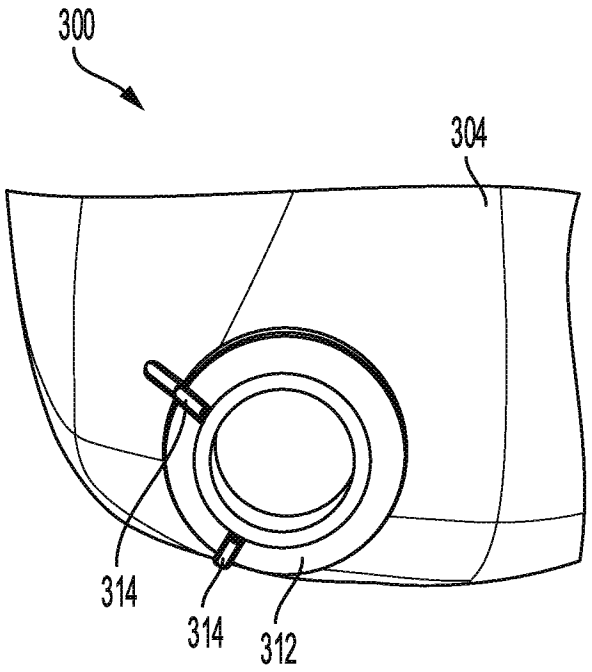
FIG. 7 depicts a top view a hosel with tripping structures.

FIG. 7 depicts a partial top view golf club head 300 with a hosel 312 with tripping structures 314. As with the other examples described above, the hosel 312 extends from the crown 304. In this example, however, only two tripping structures 314 are included on the hosel. The two tripping structures 314 are offset from one another by about 90 degrees. Both of the tripping structures 314 are incorporated on the front half of the hosel 312 as well. For instance, both tripping structures 314 are located on the striking-face side of the hosel 312 rather than rear side of the hosel 312. As discussed above, by incorporating the tripping structures 314 on the front side of the hosel, the tripping structures 314 cause the tripping effects at more points during a golf swing due to the rotation of the golf club head.

Figure 8:
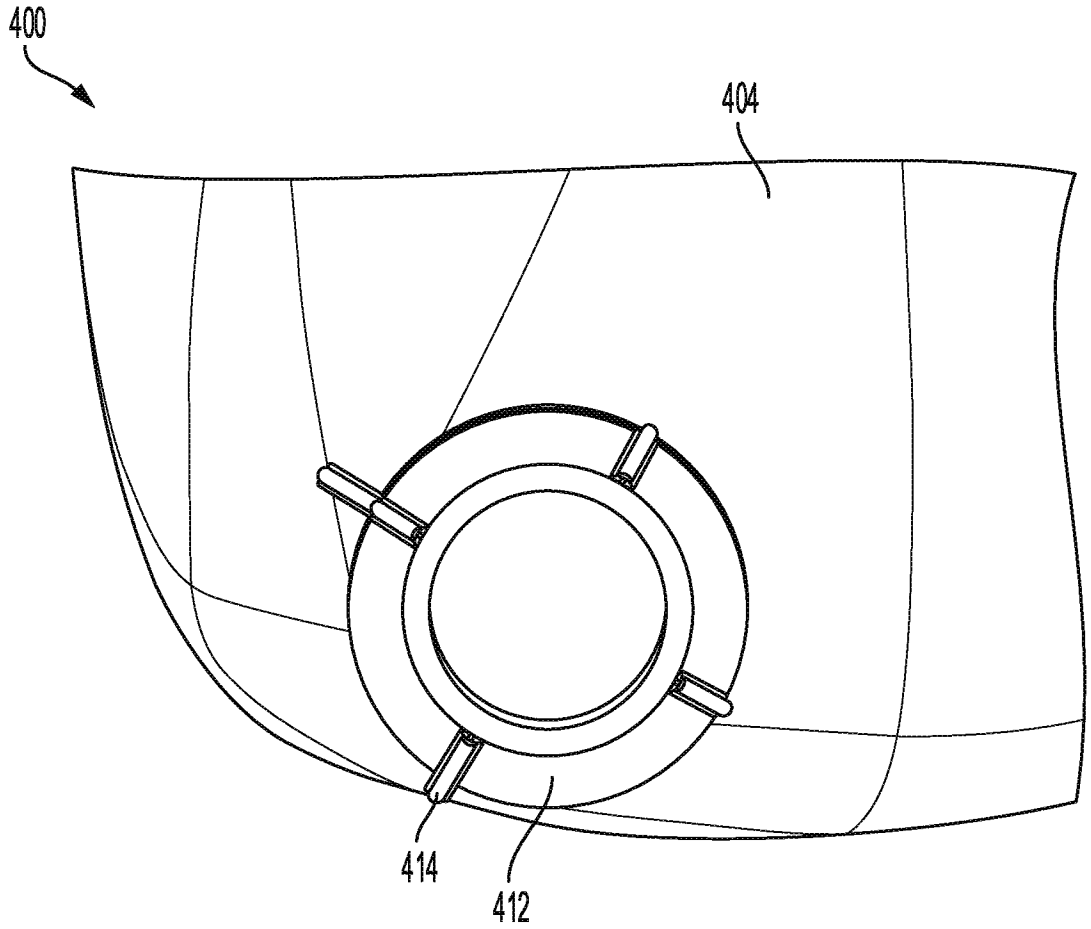
FIG. 8 depicts a top view of another hosel with tripping structures.

FIG. 8 depicts another partial top view golf club head 400 with a hosel 412 with tripping structures 414. As with the other examples described above, the hosel 412 extends from the crown 404. In this example, four tripping structures 414 are incorporated on the hosel 412. The four tripping structures 414 are offset from one another by 90 degrees. Two of the tripping structures 414 are included on the front half of the hosel 412, and two of the tripping structures 414 are included on the rear half of the hosel 412. The four tripping structures 414 and their locations may be suitable for a golf club head including an adjustable hosel components with four settings, such as the golf club head 200 discussed above with reference to FIG. 6.

Testing of prototype golf club heads have also demonstrated improvements due to the incorporation of the above tripping structures. For example, testing was performed using a control club (e.g., a club with no hosel tripping structures) and a test golf club head with tripping structures added to the hosel of the control club. Testing was performed by applying the same force to the golf clubs via a robotic swinging system in substantially the same aerodynamic conditions (e.g., location, air temperature, etc.) The results of the testing indicated that the control club had an average swing speed of 105.21-105.59 miles per hour (mph), and the testing club had an average swing speed of 106.07 mph. Thus, with the same force applied, a swing speed increase of 0.48-0.86 mph was observed based on the inclusion of the hosel tripping structures. For the testing, the tripping structures of the test club had a configuration similar to the configuration shown in FIGS. 1-5 and the tripping structures had heights of 0.012 inches. Additional testing using tripping structure configurations such as those in FIGS. 6-8 also indicated increases in swing speeds.

Figure 9:
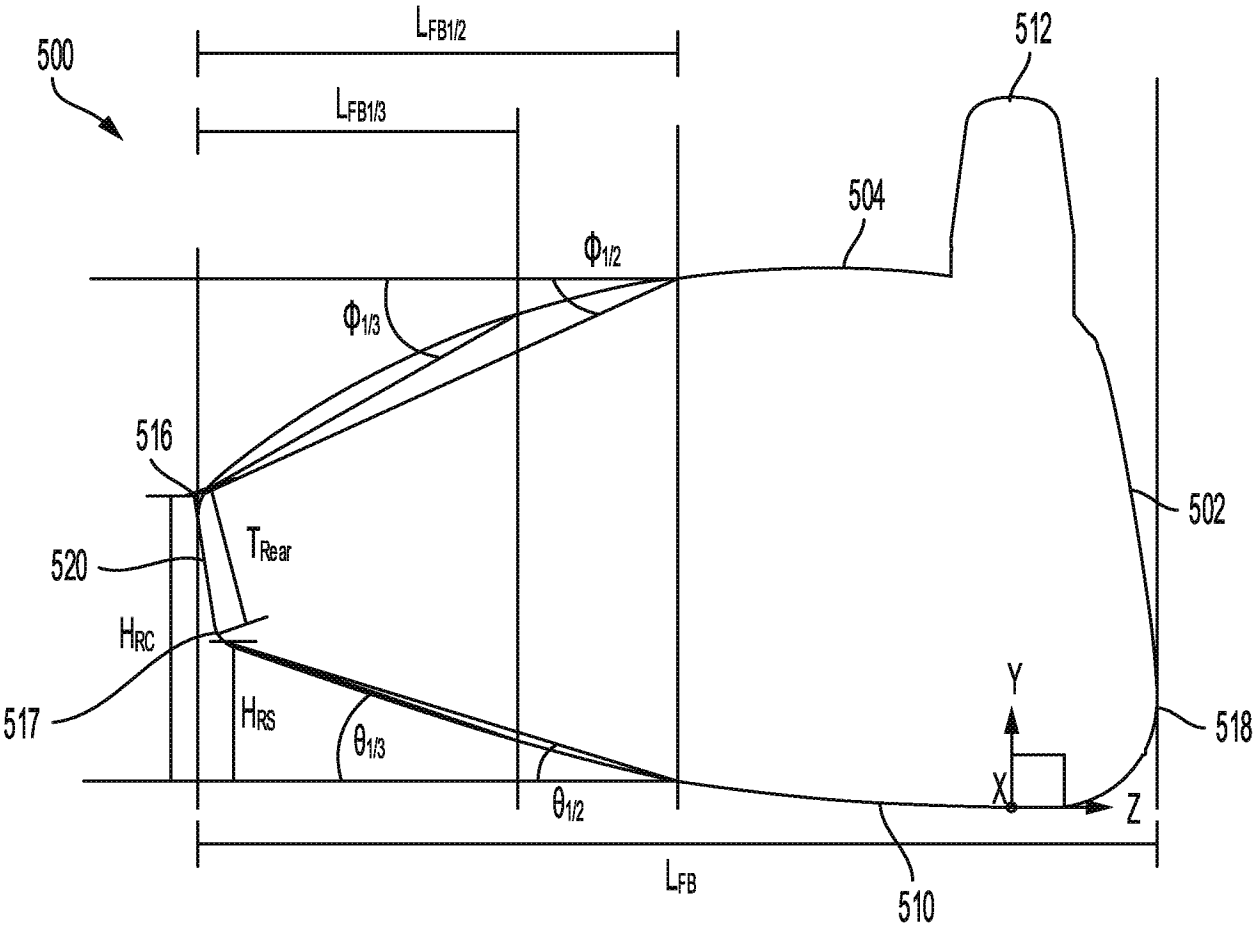
FIG. 9 depicts an example golf club head with improved drag properties.

FIG. 9 depicts an example golf club head 500 with improved drag properties. The representation of the golf club head 500 shown in FIG. 9 is a projected silhouette of the golf club from a toe-side viewpoint. The golf club head 500 shown here is setup at an address position that replicates how the golf club head 500 will interact with a golf ball. The address position, as defined by the current invention, sets up the golf club head 500 at an orientation that has a lie angle of 60 degrees similar to the requirements of the United States Golf Association (USGA). Once the lie angle is set at 60 degrees, the face angle of the golf club head 500 is set to be square, which is defined as having a face angle of 0 degrees.

Like the golf club heads described above, the golf club head 500 includes a striking face 502, a crown 504, a sole 510, and a hosel 512. The golf club head 500 also has a frontmost point 518 and a rearmost point 516. The frontmost point 518 may also be referred to as a leading edge, and the club head rearmost point 516 may also be referred to as the trailing edge.

The golf club head 500 also includes a skirt 520 or "boat tail" portion that connects the crown 504 and the sole 510. The skirt 520 may be defined as a portion of the club head 500 that is between the crown 504 and the sole 510, and defines a plane having an angle that is substantially different from the planes formed by either the crown 504 or the sole. For instance, the skirt 520 may define a plane that is within 80-120 percent of a loft angle of the golf club head 500. The angle of the plane formed by the skirt 520 may be referred to as the skirt angle. In other examples, the skirt 520 defines a plane that is within 20 degrees of being perpendicular to a ground plane defined by the ground.

The dimensions of the golf club head 500 result in the golf club head 500 experiencing lower drag during a swing of the golf club head 500. The dimensions of the golf club head 500 include a front-to-back length ($L_{FB}$), a ½ front-to-back length ($L_{FB1/2}$), and a ⅓ front-to-back length ($L_{FB1/3}$). The front-to-back length ($L_{FB}$) is the length between the club head frontmost point 518 and the club head rearmost point 516 as measured along the ground plane. The front-to-back length ($L_{FB}$) may also be referred to as the head length. The golf club head 500 also has a club head height that is measured from the lowest point on the sole to the highest point on the crown in a direction perpendicular to the ground plane.

Closing descent angles (Φ) and closing ascent angles (θ) are also defined by the golf club head 500. The closing descent angles (Φ) indicate how steeply the crown 504 is closing towards the rear of the golf club head 500. The closing ascent angles (θ) indicate how steeply the sole 510 is closing towards the rear of the golf club head 500.

The closing descent angle (Φ) is defined as an angle between (1) a line from a point on the crown 504, of the projected silhouette of the golf club from the toe-side viewpoint, to the rearmost point 516 of the crown 504 and (2) a plane intersecting the crown point and parallel to the ground plane. The rearmost point 516 of the crown 504 may be an intersection point of the crown 504 and an upper boundary of the skirt 520. The closing descent angles (Φ) may be measured from different points on the golf club head 500. For instance, a half-point closing descent angle ($\Phi_{1/2}$) may be measured from a point on the crown 504 that is halfway between the frontmost point 518 and the rearmost point 516 of the club head 500 (e.g., from a point located the ½ front-to-back length ($L_{FB1/2}$) from the rearmost point 516 as measured along the ground plane.) A third-point closing descent angle ($\Phi_{1/3}$) may be measured from a point on the crown 504 that is located the ⅓ front-to-back length ($L_{FB1/3}$) from the rearmost point 516 of the golf club as measured along the ground plane. In the example depicted, the rearmost point 516 of the golf club happens to also be the rearmost point 516 of the crown 504.

The closing ascent angle (θ) is defined as an angle between (1) a line from a point on the sole 510, of the projected silhouette of the golf club from the toe-side viewpoint, to the rearmost point 517 of the sole 510 and (2) a plane intersecting the sole point and parallel to the ground plane. The rearmost point 517 of the sole 510 may be an intersection point of the sole 510 and a lower boundary of the skirt 520. The closing ascent angles (θ) may be measured from different points on the golf club head 500. For instance, a half-point closing ascent angle ($\theta_{1/2}$) may be measured from a point on the sole 510 that is halfway between the frontmost point 518 and the rearmost point 516 of the club head 500 (e.g., from a point located the ½ front-to-back length ($L_{FB1/2}$) from the rearmost point 516 as measured along the ground plane.) A third-point closing ascent angle ($\theta_{1/3}$) may be measured from a point on the sole 510 that is located the ⅓ front-to-back length ($L_{FB1/3}$) from the rearmost point 516 of the golf club as measured along the ground plane.

The height and thickness of the skirt 520 also have an impact on the aerodynamics of the golf club head. The height of the skirt may be represented by the height ($H_{RS}$) of the rearmost point of the sole 510 above or off the ground plane. The rearmost point of the sole 510 represents the lowest point of the skirt 520. The height of the skirt 520 may also be represented by the height ($H_{RC}$) of the rearmost point 516 of the crown 504 off the ground plane. The thickness ($T_{Rear}$) of the rear portion the skirt 520 shown in the projection may then be defined by the distance between the rearmost point 516 of the crown 504 and the rearmost point 517 of the sole 510. For instance, the thickness ($T_{Rear}$) may be the shortest distance between the rearmost point 516 of the crown 504 and the rearmost point 517 of the sole 510 as measured in the projection.

As discussed above, configuring these dimensions of the golf club head 500 allows for improvements to the aerodynamic properties by reducing the pressure drag forces experienced by the golf club head 500 during a swing. For instance, by raising the aft portion of the skirt 520 or boat tail and/or increasing the thickness of the aft portion of the skirt 520, the closure angles of the crown 504 and the sole may be reduced and controlled. By reducing the closure angles, the separation of the turbulent flow of air over the crown 504 and/or sole 510 may be moved further rearward on the golf club head 500. Delaying the turbulent flow separation (e.g., moving the turbulent flow separation more rearward) results in a lower pressure drag forces acting on the golf club head 500 during the golf club swing. Additional reductions to pressure drag forces may be achieved by bringing the closing ascent angle (θ) closer to the closing descent angles (Φ).

As some examples, the height ($H_{RS}$) of the rearmost point of the sole 510 off the ground plane may be between 12 mm and 35 mm. The height ($H_{RC}$) of the rearmost point 516 of the crown 504 off the ground plane may be between 28 and 45 mm. The thickness of the skirt 520 ($T_{Rear}$) may be between 8 and 20 mm. Different combinations of $H_{RS}$ and $T_{Rear}$ may be utilized to achieve the aerodynamic benefits of the present technology. For example, as the skirt 520 is raised higher off the ground, the skirt 520 may not need to be as thick to achieve the shallower closure angles of the crown 504 and the sole 510. The thickness of the skirt 520 may also be adjusted based on the height of the skirt 520 to better match the closing ascent angles (θ) of the sole 510 with the closing descent angles (Φ) of the crown 504. These ranges of heights generally represent a heightened and/or thickened skirt 520 as compared to other drivers, which may have $H_{RS}$ values of about 9 mm, $H_{RC}$ values of about 22 mm, and $T_{Rear}$ values of about 16 mm.

As will also be understood, the closing ascent angles (θ) of the sole 510 and the closing descent angles (Φ) are also dependent on the height of the golf club head 500 as well as the club length or the front-to-back length ($L_{FB}$). The height of the golf club head 500 for a driver may be greater than 2 inches (50.8 mm), but may be lower for other types of metal woods, such as fairway metals. In some examples, the height of the golf club head 500 may be between 2 inches (50.8 mm) and 2.8 inches (71.12 mm). For a driver, the front-to-back length ($L_{FB}$) may be between 4.13 inches (105 mm) to 4.72 inches (120 mm) or between 4 inches (101.6 mm) to 5 inches (127 mm). In some examples, the front-to-back length ($L_{FB}$) may be less than 4.5 inches (114.3 mm).

Because some of the above dimensions may change as the type of metal wood changes (e.g., from drivers to fairway metals or other types of metal woods), the above dimensions may be better represented as ratios that help maintain the types closure angles of the crown 504 and the sole 510 that provide the improved aerodynamic properties discussed herein. For example, a ratio between (1) the front-to-back length ($L_{FB}$) (e.g., the head length) and (2) the height ($H_{RS}$) of the rearmost point of the sole 510 off the ground plane (e.g., the skirt height) may be utilized. This ratio may be referred to as the head-length-to-skirt-height ratio. The head-length-to-skirt-height ratio may be between 3:1 and 8.5:1, between 3.4:1 and 5.8:1, or less than 6:1. The value of the head-length-to-skirt-height ratio may be based on the skirt thickness ($T_{Rear}$) as well. For instance, for the head-length-to-skirt-height ratio may be greater where the skirt thickness ($T_{Rear}$) is smaller. For instance, for a skirt thickness ($T_{Rear}$) between 10-14 mm, the head-length-to-skirt-height ratio may be between 3.46:1 and 5.7:1. For a skirt thickness ($T_{Rear}$) between 16-18 mm, the head-length-to-skirt-height ratio may be between 4.3:1 and 8.5:1.

A ratio between the head length and skirt thickness ($T_{Rear}$) may also be utilized, and such a ratio may be referred to as a head-length-to-skirt-thickness ratio. The head-length-to-skirt-thickness ratio may be between 6:1 and 11:1, between 6.5:1 and 8.5:1, or less than 9:1. The head-length-to-skirt-thickness ratio may also depend on the skirt height similar to how the head-length-to-skirt-height ratio is dependent on the skirt thickness, as discussed above.

The closing descent angles (Φ) and the closing ascent angles (θ) of sole may be within ranges of degrees and the angles may be based on one another to more closely match the closing descent angles (Φ) to the closing ascent angles (θ). The half-point closing descent angle ($\Phi_{1/2}$) may be between 15 and 30 degrees, less than 30 degrees, or less than 20 degrees. The third-point closing descent angle ($\Phi_{1/3}$) 20 and 35 degrees, less than 35 degrees, less than 30 degrees, or less than 25 degrees. For instance, half-point closing ascent angle ($\theta_{1/2}$) may be between 15 and 30 degrees, less than 30 degrees, or less than 20 degrees. The third-point closing ascent angle ($\theta_{1/3}$) may be between 10-35 degrees, less than 35 degrees, or less than 20 degrees. As the closing descent angles (Φ) and the closing ascent angles (θ) become shallower, the golf club head 500 may incur less pressure drag effects.

In addition, as the closing descent angles (Φ) and the closing ascent angles (θ) become more closely matched, the golf club head 500 may also receive less pressure drag effects. For instance, in some examples the respective closing descent angles (Φ) and the closing ascent angles (θ) may be within 85% to 115% of one another. In another example, the respective closing descent angles (Φ) and the closing ascent angles (θ) may be within 95% to 105% of one another. For example, the half-point closing descent angle ($\Phi_{1/2}$) may be within 85% to 115% or 95% to 105% of the half-point closing ascent angle ($\theta_{1/2}$). Similarly, the third-point closing descent angle ($\Phi_{1/3}$) may be within 85% to 115% or 95% to 105% of the third-point closing ascent angle ($\theta_{1/3}$).

Additionally or alternatively, there may be no tangent line to the aft half of the crown 504 in the projected silhouette that is greater than 45 degrees, 40 degrees, or 30 degrees. Stated another way, all tangent lines that can be drawn on the aft half of the crown 504 in the projected silhouette may have an angle relative to the ground plane that is less than or equal to 45 degrees, 40 degrees, or 30 degrees. Similarly, there may be no tangent line to the aft half of the sole 510 in the projected silhouette that is greater than 45 degrees, 40 degrees, or 30 degrees. Stated another way, all tangent lines that can be drawn on the aft half of the sole 510 in the projected silhouette may have an angle relative to the ground plane that is less than or equal to 45 degrees, 40 degrees, or 30 degrees.

The table provided in FIG. 10 includes a listing of dimensions for ten example golf club heads that have dimensions based on the present technology to alter the closing angles of the sole and crown of the respective golf clubs. As can be seen from the data in the table, many of the example clubs satisfy the above relationships and characteristics.

Figure 11:
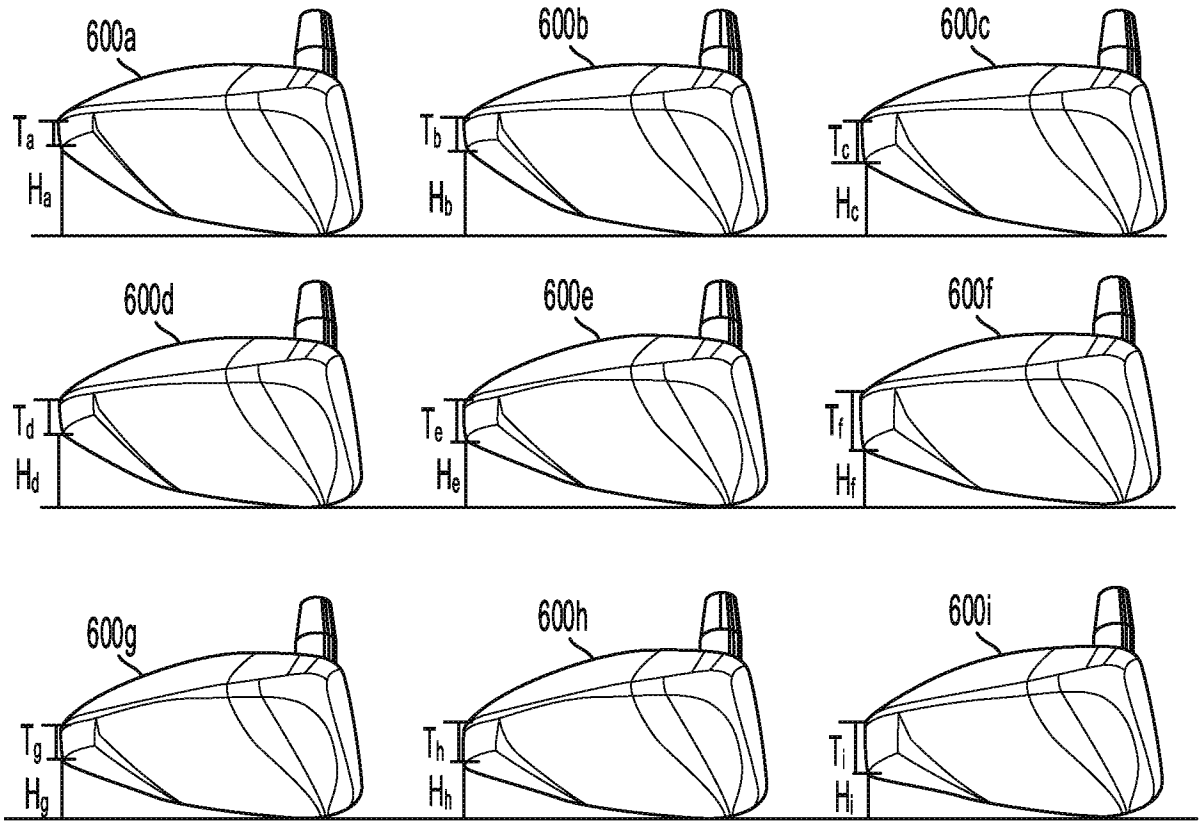
FIG. 11 depicts examples of golf club heads with improved drag properties.

FIG. 11 depicts examples of golf club heads with improved drag properties. The example golf clubs 600*a-i* in FIG. 11 each have different combinations of skirt thickness and skirt heights. In FIG. 11, the skirt thicknesses are labeled with a T and the skirt heights are indicated with an H. The skirt thicknesses (T) in FIG. 11 may be the same or substantially the same dimension as the thickness ($T_{Rear}$) of the rear portion the skirt, discussed above in FIG. 9. The skirt heights (H) may be the same dimension as the height ($H_{RS}$) of the rearmost point of the sole 510 off the ground plane, as discussed above in FIG. 9.

Golf club 600*a* has a skirt thickness of Ta and a skirt height of $H_a$. Golf club 600*b* has a skirt thickness of $T_b$ and a skirt height of $H_b$. Golf club 600*c* has a skirt thickness of $T_c$ and a skirt height of $H_c$. Golf club 600*d* has a skirt thickness of $T_d$ and a skirt height of $H_d$. Golf club 600*e* has a skirt thickness of $T_e$ and a skirt height of $H_e$. Golf club 600*f* has a skirt thickness of $T_f$ and a skirt height of $H_f$. Golf club 600*g* has a skirt thickness of $T_g$ and a skirt height of $H_g$. Golf club 600*h* has a skirt thickness of $T_h$ and a skirt height of $H_h$. Golf club 600*i* has a skirt thickness of $T_i$ and a skirt height of $H_i$.

As can be seen in the first row of golf club heads 600*a-c*, raising the skirt height allows for a shallower closing descent angle of the crown. However, with thinner skirt thicknesses, the closing ascent angle of the sole is quite steep. As the thickness of the skirt become increasingly greater from golf club head 600*a* to golf club head 600*c*, it can be seen that the closing ascent angle of the sole becomes shallower and becomes closer to the closing descent angle of the crown.

Similar results are seen in the second row, which includes example golf club heads 600*d-f*. The skirt heights (T) of the golf club heads 600*d-f* is less than the skirt heights (T) of the golf club heads 600*a-c* in the first row. The lower skirt height (T) in golf club heads 600*d-f* result in a steeper closing descent angle of the crown but also results in a shallower closing ascent angle of the crown—especially as the skirt thickness increases.

In the last row, which includes example golf club heads 600*g-i*, the skirt heights (H) are generally lower than that of the respective golf club heads 600*a-f* in the first and second row. By moving the skirt height even lower, the closing ascent angle of the sole is further reduced, but the closing descent angle begins to increase more dramatically. As the skirt thickness (T) increases, the closing ascent angle of the sole further decreases to point that it is shallower than the closing descent angle of the crown.

Testing of prototype golf club heads have also shown improvements due to the incorporation of the aerodynamic shaping to modify the skirt heights and thicknesses along with the closing angles. For example, testing was performed using a control club (e.g., a club with a more traditional low skirt height) and a test golf club heads with raised skirts. Testing was performed by applying the same force to the golf clubs via a robotic swinging system in substantially the same aerodynamic conditions (e.g., location, air temperature, etc.) In testing, raising the skirt by 0.25 inches resulted in an increase in club head speed of 0.44 mph, and raising the skirt by 0.5 inches resulted in increases in club head speed of between 0.57-0.91 mph. Golf club heads that included both the raised skirt and the tripping structures discussed above resulted in a combined even greater increase in swing speed.

Figure 12:
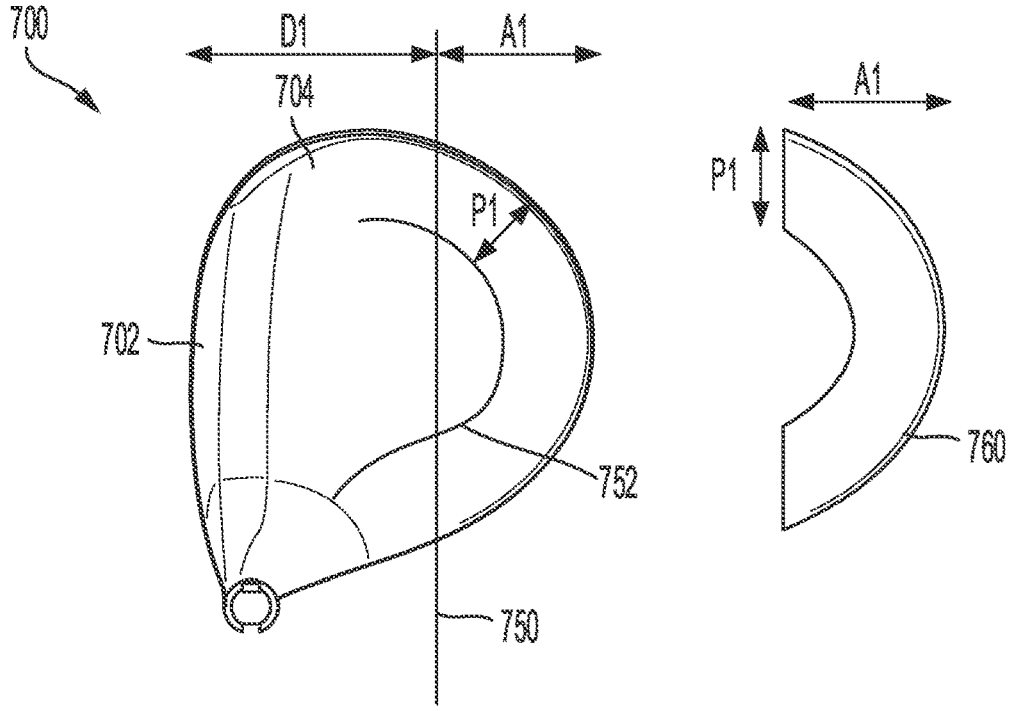
FIG. 12 depicts a top view of an example golf club head and an example aft slice.

FIG. 12 depicts a top view of an example golf club head 700 and an example aft slice 760. The example golf club head 700 may be similar or the same as the golf club heads discussed above. For instance, the golf club head 700 includes a crown 704 and a striking face 702.

Raising the skirt and/or thickening the skirt also generally raises the aft portion of the club head 700 to improve the aerodynamic properties of the golf club. To identify the characteristics of the aft portion of the club head 700, an aft slice 760 of the golf club head 700 may be considered. The aft slice 760 is a portion of the golf club head 700 to the rear of a slice line 750 and between an outer perimeter of the golf club head 700 and an offset perimeter slice curve 752. The slice line 750 runs in the heel-to-toe direction (e.g., parallel with a heel-to-toe axis) and is located a slice depth D from the frontmost point of the golf club head. The offset perimeter slice curve 752 is offset from the outer perimeter of the golf club head 700 by a perimeter offset distance P. The offset perimeter slice curve 752 follows the outline or contour of the outer perimeter at the offset position. For instance, an aft portion of the golf cub head 700 to the rear of the slice line 750 may be identified. A perimeter portion that is offset by the perimeter-offset distance P from the outer perimeter of that aft portion is then extracted or identified to form or define the aft slice 760. The aft slice 760 may be formed or extracted computationally by generating a three-dimensional scan of the golf club head or other computer modelling of the golf club head. In the example depicted in FIG. 12, the slice depth D1 is 60% of the front-to-back length of the club head 700 measured from the frontmost point of the golf club head, and the perimeter offset distance P1 is 1.0 inches.

The aft slice 760 also has an aft depth A that is measured from rearmost point of the aft slice 760 to the frontmost point of the aft slice 760 (e.g., slice line 750). The aft depth A of the aft slice 760 is equal to the difference of the front-to-back length of the club head 700 and the slice depth D. In the example depicted in FIG. 12, the aft depth A1 of the aft slice 760 is equal to 40% of the front-to-back length of the club head 700.

Figure 13:
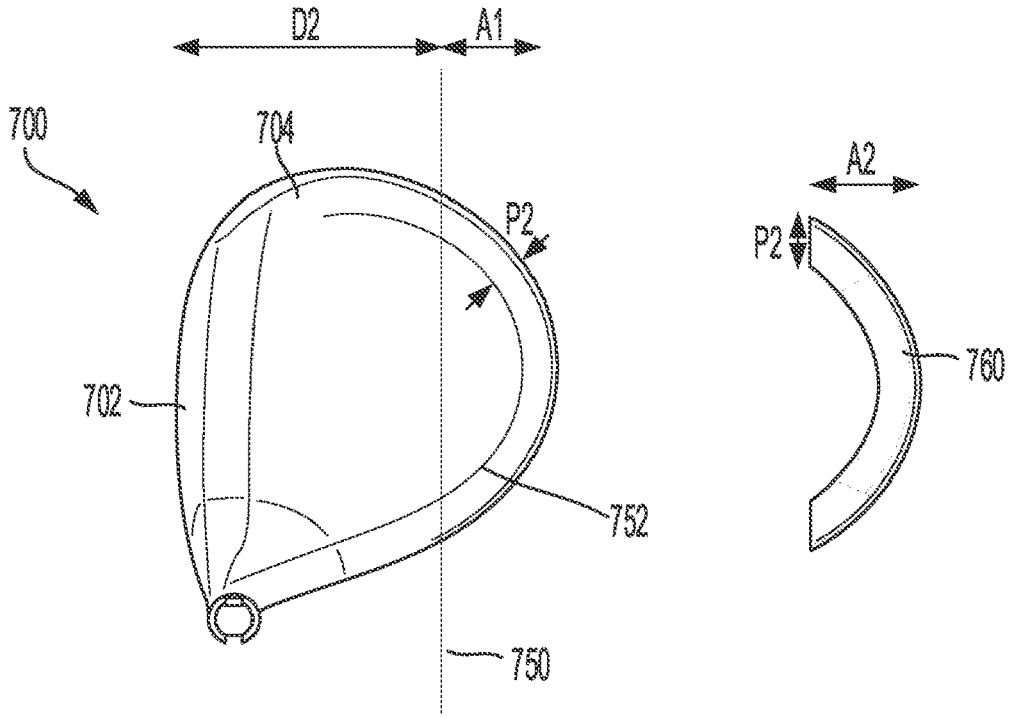
FIG. 13 depicts a top view of an example golf club head and another example aft slice.

FIG. 13 depicts a top view of an example golf club head 700 and another example aft slice 760. The aft slice in FIG. 13 differs from the aft slice 760 in FIG. 12 in that the slice depth D2 is greater than the slice depth D1, and the perimeter-offset distance P2 is less than the perimeter-offset distance P1. Because the slice depth D2 is greater than the slice depth D1, the aft depth A2 is less than the aft depth A1. In the example depicted in FIG. 13, the slice depth D2 is 70% of the front-to-back length of the golf club head 700, the aft depth A2 is 30% of the front-to-back length of the golf club head 700, and perimeter-offset distance P2 is 0.5 inches.

Figure 14:
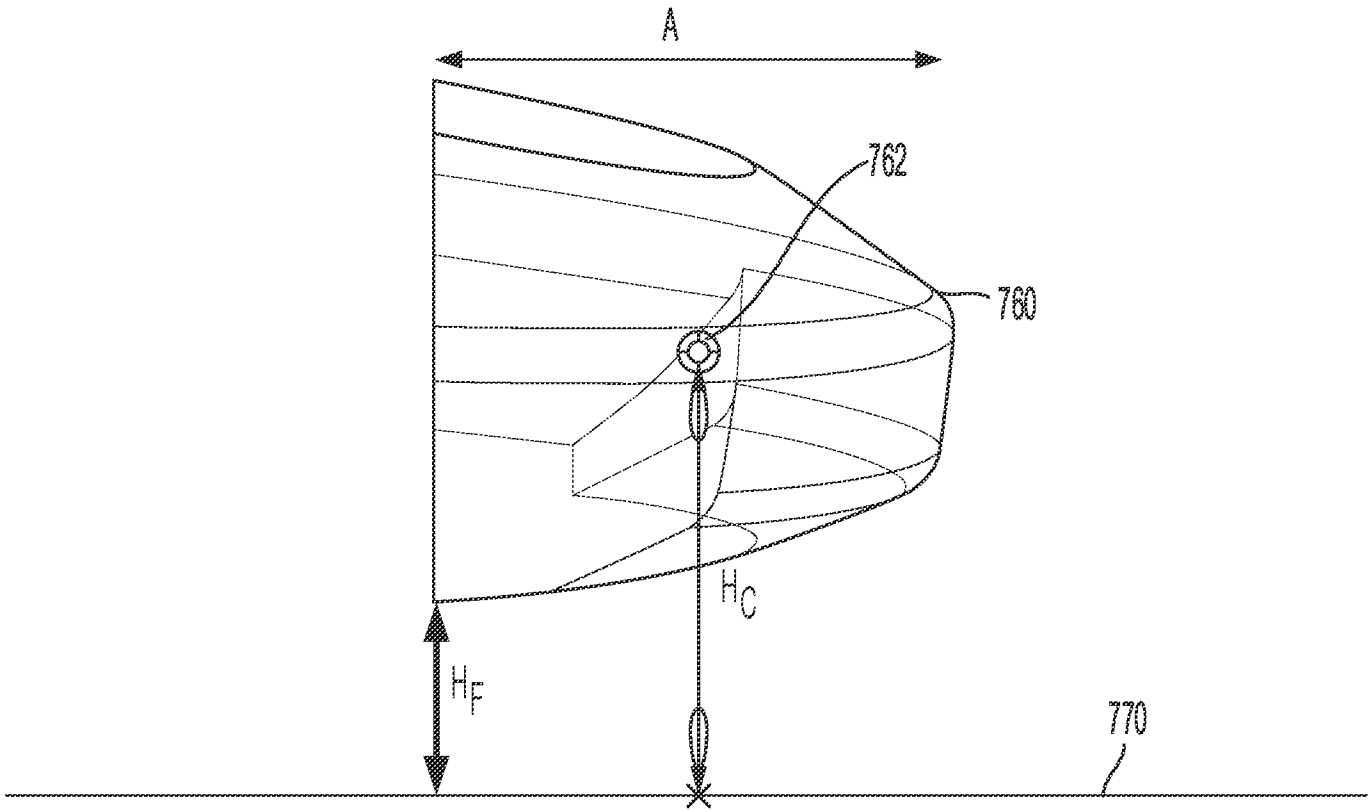
FIG. 14 depicts a side view of an example aft slice.

FIG. 14 depicts a side view of an example aft slice 760. More specifically, FIG. 14 depicts a projected silhouette of the aft slice 760 from a side view, which may be from a toe-side viewpoint or a heel-side viewpoint. The projected silhouette is generated with the golf club head 700 (from which the aft slice 760 is generated) setup at an address position that replicates how the golf club head 700 will interact with a golf ball. The address position, as defined by the current invention, sets up the golf club head 700 at an orientation that has a lie angle of 60 degrees similar to the requirements of the USGA. Once the lie angle is set at 60 degrees, the face angle of the golf club head 700 is set to be square, which is defined as having a face angle of 0 degrees.

Two dimensions of the aft slice 760 may be acquired or determined from the projected side-view silhouette of the aft slice 760. The first dimension is a height ($H_{Centroid}$) of a centroid 762 of the aft portion 760 above a ground plane 770. A centroid of an object may be considered the center of gravity of the solid object assuming uniform density. To calculate the centroid 762 of the aft slice 760, all internal geometry of the aft slice 760 may be filled in (mathematically, computationally, etc.) to be a solid object and assumed to have the same density throughout. The center of gravity of that solid object may then be determined or calculated as the centroid 762. The second dimension is a height ($H_{Low}$) of the lowest point of the aft slice 760, in the silhouette, above the ground plane 770.

In examples where the slice depth D is 60% of the front-to-back length of the golf club head 700, the aft depth A is 40% of the front-to-back length of the golf club head 700, and perimeter-offset distance P is 1.0 inches, the height ($H_{Low}$) of the lowest point of the aft slice 760 may be between 5-10 mm, and the centroid height ($H_{Centroid}$) may be between 28-35 mm. For example, the height ($H_{Low}$) of the lowest point of the aft slice 760 may be greater than 6 mm, and the centroid height ($H_{Centroid}$) may be greater than 29 mm.

In examples where the slice depth D is 70% of the front-to-back length of the golf club head 700, the aft depth A is 30% of the front-to-back length of the golf club head 700, and perimeter-offset distance P is 0.5 inches, the height ($H_{Low}$) of the lowest point of the aft slice 760 may be between 10-15 mm, and the centroid height ($H_{Centroid}$) may be between 28-35 mm. For example, the height ($H_{Low}$) of the lowest point of the aft slice 760 may be greater than 10, 11, or 12 mm, and the centroid height ($H_{Centroid}$) may be greater than 28 mm. In some examples, the centroid height ($H_{Centroid}$) may be at least 50% of the club head height of the golf club head 700. In some examples, the centroid height ($H_{Centroid}$) that is at least 95% of a height of a geometric center of the striking face 702 above a ground plane. For instance, the centroid height ($H_{Centroid}$) may also be greater than or equal to a height of a geometric center of the striking face 702. The height ($H_{Low}$) of a lowest point of the aft slice is at least 40%, 45%, or 50% of the height of the geometric center of the striking face above the ground plane.

Golf club heads having aft slices 760 with the dimensions discussed above have been shown through testing to have improved aerodynamic properties similar to those discussed above with respect to FIGS. 9-11.

Additional or alternative aerodynamic improvements to the golf club head may also be made by attaching vortex generators to the golf club head. As discussed above, golf clubs are bluff bodies that typically result in significant aerodynamic separation, which causes pressure drag that deters the clubhead speed. USGA limitations on fore-to-aft dimension and volume constrain the geometry and ability to eliminate this aerodynamic separation. This issue is particularly acute for driver-type golf club heads with significant face heights that are preferred for their forgiveness and a larger "sweet spot." The current limitations on clubhead shaping do not allow the simultaneous satisfaction of desired face height, minimal base area, conforming volume, and depth (fore to aft dimension no greater than heel to toe dimensions and less than 5 inches) to eliminate the aerodynamic separation. In golf clubs with steeper closure angles that cause the aerodynamic separation (without the use of vortex generators), the addition of vortex generators can reduce or minimize the turbulent aerodynamic separation with a resulting smaller base area over which the low pressure separated flow acts. This results in a reduction in drag force with a corresponding increase in clubhead speed.

More specifically, addition of vortex generators to the crown and/or the sole of the golf club head enables the viscous boundary layer to be energized. This high energy boundary layer enables larger closure angles and reduced boat tail or aft skirt thicknesses to be used for the golf club head. The reduction in base pressure drag on the boat tail or aft skirt portion results in an increase in clubhead speed with an associated increase in distance of the struck golf ball.

Figure 15:
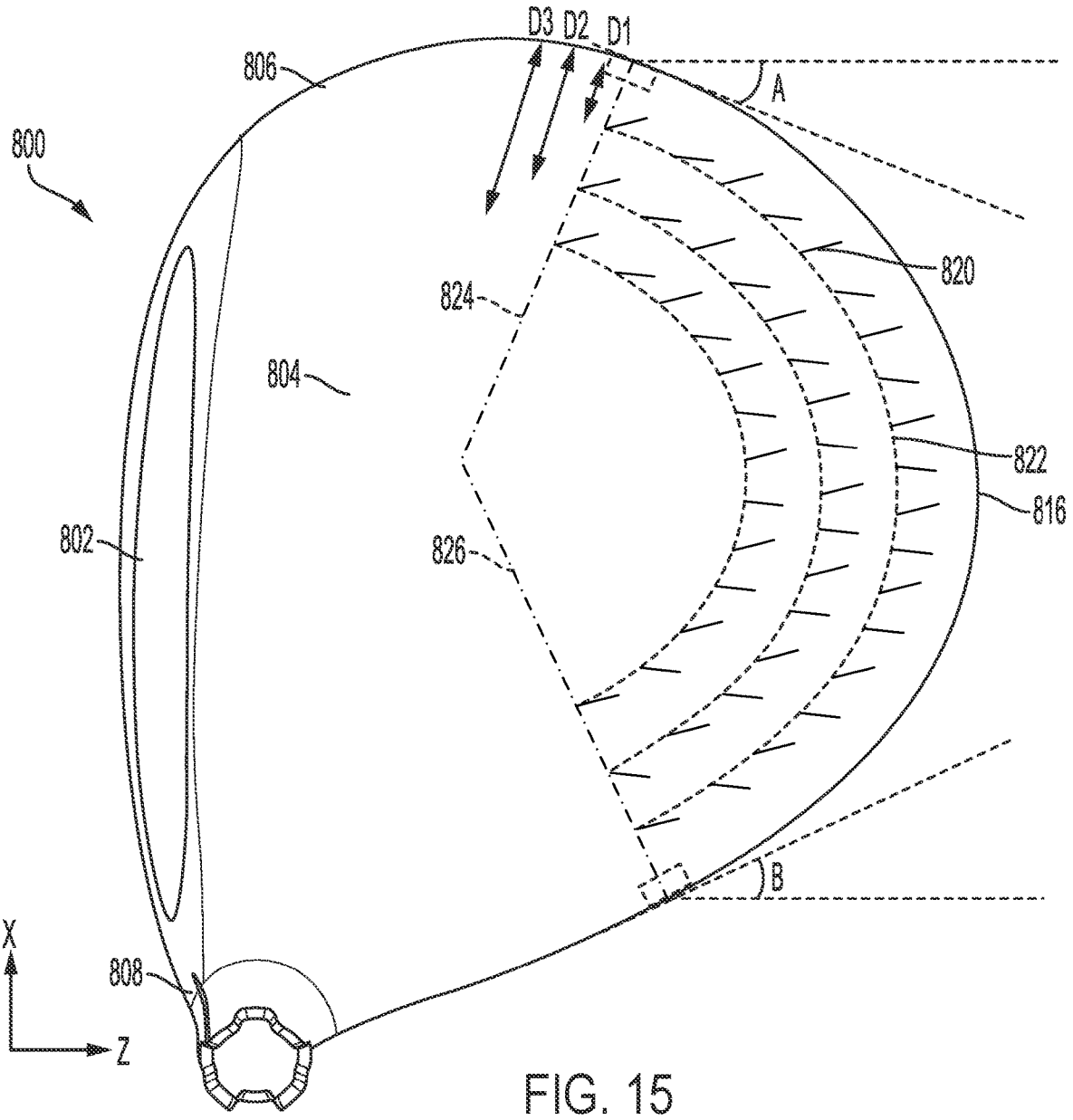
FIG. 15 depicts a top view of an example golf club with vortex generators.

FIG. 15 depicts a top view of an example golf club head 800 with vortex generators 820. Similar to the other golf clubs described herein, the golf club head 800 includes a crown 804 coupled to a striking face 802. The golf club head has a heel portion 808 and a toe portion 806. The aft portion of the club head 800 also has a rearward most point 816, which may also be referred to as the trailing edge.

The depiction of the golf club head 800 includes three possible arcs 822 on which the vortex generators 820 may be positioned. Of note, the vortex generators 820 may be placed on only one of the possible arcs 822 depicted in FIG. 15 rather than on all of the arcs 822. For instance, the possible arcs 822 are presented merely to show different offset positions from a perimeter of the golf club head 800. For instance, the longest arc 822 is positioned at an offset distance D1 from the outer perimeter of the golf club head 800. The second longest arc 822 is positioned at an offset distance D2 from the outer perimeter of the golf club head 800. The shortest arc 822 is positioned at an offset distance D3 from the outer perimeter of the golf club head 800. The offset distance D1 may be between 0.2-0.6 inches, the offset distance D2 may be between 0.6-1.0 inches, and the offset distance D3 may be between 1.0-1.4 inches. In the example depicted, the offset distance D1 is 0.4 inches, the offset distance D2 is 0.8 inches, and the offset distance D3 is 1.2 inches. These distances, however, are merely representative.

The shape of the arc 822 may substantially match the aft outer perimeter of the golf club head 800 such that an offset distance remains substantially constant along the arc 822. In some examples, this results in the arc have a constant radius of curvature, and in other examples, the arc 822 may have a variable radius of curvature. For instance, the arc 822 may traverse along a constant slope line of the crown 804 (e.g., a contour line of a topographic representation of the crown 804).

The position of the arc 822, and thus the position of the vortex generators 820, may be configured based on the closure angle of the crown 804. For instance, the position of the arc 822 and the vortex generators 820 may be based on where the turbulent separation of the airflow would occur if the club head 800 did not include the vortex generators 820. More specifically, the arc 822 may be placed slightly forward (e.g., less than 0.2 inches) of where the turbulent separation would have occurred. At such a position, the vortex generators 820 provide the most beneficial effect on the reduction of drag.

As discussed above, a steeper closure angle of the crown results in an earlier, or more forward, turbulent separation. In contrast, a shallower closure angle results in later, or more aft, turbulent separation. Accordingly, for crowns 804 with a steeper closure angle, the offset distance for the arc 822 may be greater, which results in the vortex generators 820 being more forward on the crown 804. For crowns 804 with a shallower closure angle, the offset distance for the arc 822 may be smaller, which results in the vortex generators 820 being more aft on the crown 804. Regardless of the offset position of the arc 822, the vortex generators 820 (or at least 80% of the vortex generators 820) are located in the aft half of the crown 804.

The arc 822 may begin at a first boundary line 824 and end at a second boundary line 826. The first boundary line 824 extends perpendicularly to a tangent line of the perimeter of the aft, toe-side portion of the crown 804. The toe-side tangent line may be where an angle A (defined as the angle between a line parallel to the Z axis and the toe-side tangent line) is between 20-30 degrees. The second boundary line 826 extents perpendicularly to a tangent line of the perimeter of the aft, heel-side portion of the crown 804. The heel-side tangent line may be where an angle B (defined as the angle between a line parallel to the Z axis and the heel-side tangent line) is between 25-35 degrees. The Z axis is an axis that extends in a front-to-back direction of the golf club head 800. In turn, the X axis is an axis that runs in the heel-to-toe direction and is perpendicular to the Z axis.

The number of vortex generators 820 positioned along the respect arc 822 depends on the length of the arc 822, which is in turn dependent on the offset distance of the arc 822 and the position of the first boundary line 824 and the second boundary line 826. As an example, where the offset distance is D3, 10-15 vortex generators 820 may be positioned along the arc 822. Where the offset distance is D2, 14-18 vortex generators 820 may be positioned along the arc 822. Where the offset distance is D1, 17-21 vortex generators 820 may be positioned along the arc 822. In some examples, the offset distance is between 0.2-1.2 inches and there are at least 12 vortex generators placed along the corresponding an arc 822. In such an example, the number of vortex generators 820 may be between 12-22 vortex generators 820.

The vortex generators 820 may be positioned along the arc 822 such that the leading edge, or frontmost point, of each of the vortex generators 820 is positioned on the arc 822. The vortex generators 820 may also be spaced equidistant across the length of the arc or equidistant across the X axis direction.

While the vortex generators 820 are depicted as being located only on the crown 804. Additional or alternative vortex generators 820 may be included on the sole of the golf club head 800. The vortex generators 820 may be positioned on the sole in a similar manner and configuration as the vortex generations on the crown.

Figure 16A:
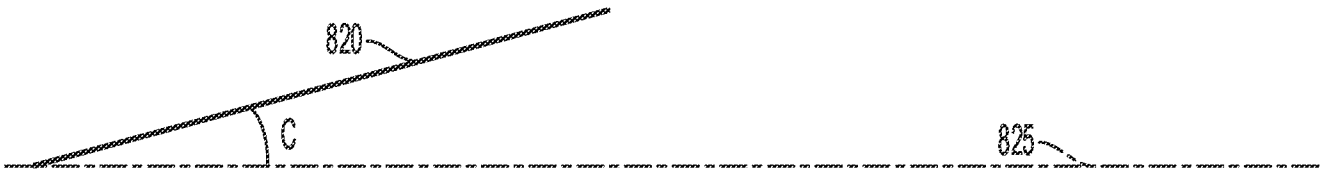
FIG. 16A depicts an example extension angle for a vortex generator.
Figure 16B:
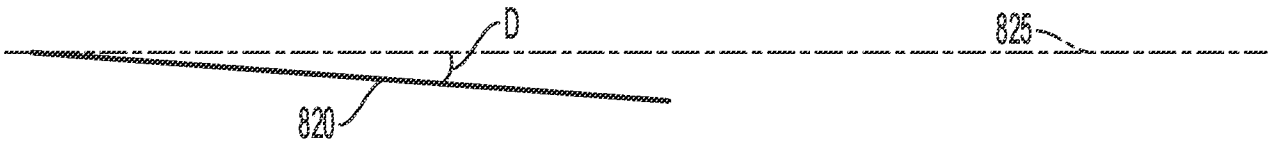
FIG. 16B depicts another example extension angle for a vortex generator.

The vortex generators 820 may also extend in the aft direction at an angle relative to a line parallel to the Z axis. Such an angle may be referred to herein as an extension angle. Different subsets of vortex generators 820 may extend at different extension angles, as can be seen in FIG. 15. FIGS. 16A-16B depict different example extension angles for vortex generators 820. FIG. 16A depicts a first example extension angle C for a vortex generator 820, and FIG. 16B depicts a second example extension angle D for a vortex generator 820. FIGS. 16A-16B depict a line 825 that runs parallel to the Z axis and a representative vortex generator 820 the extends rearwardly towards the aft of the golf club head 800.

In FIG. 16A, the vortex generator 820 extends rearwardly and partially towards the toe side of the crown. When the vortex generator 820 extends partially towards the toe side, the extension angle is a positive number and the vortex generator 820 may be considered to have a toe bias. In the example depicted in FIG. 16A, the example extension angle C is between 10-20 degrees and may be between 14-16 degrees.

In FIG. 16B, the vortex generator 820 extends rearwardly and partially towards the heel-side of the crown. When the vortex generator 820 extends partially towards the heel side, the extension angle is a negative number and the vortex generator 820 may be considered to have a heel bias. In the example depicted in FIG. 16B, the example extension angle is between 0 to −10 degrees and may be between −4 to −6 degrees.

In an example, one subset of the vortex generators 820 may extend at the first extension angle C, and a second subset of the vortex generators 820 may extend at the second angle D. The vortex generators 820 may alternate between vortex generators 820 that extend at the first extension angle C and vortex generators 820 that extend at the second extension angle D.

Incorporating different angled vortex generators 820 allows for the vortex generators 820 to provide an affect at different points of the golf swing. For instance, during a golf swing, the golf club head 800 rotates which changes the relative direction of airflow over the golf club head 800. When the airflow is directly aligned with a vortex generator 820, the vortex generator 820 does not generate any air vortex and therefore does not provide the desired effect. Accordingly, by having multiple subsets of vortex generators 820 that extend in different extension angles, at least one subset of vortex generators 820 will generate air vortices at each point during the downswing of the golf club head 800. While only two subsets of the vortex generators 820 are shown, multiple additional subsets of vortex generators 820 with different extension angles may be included.

Figure 18:
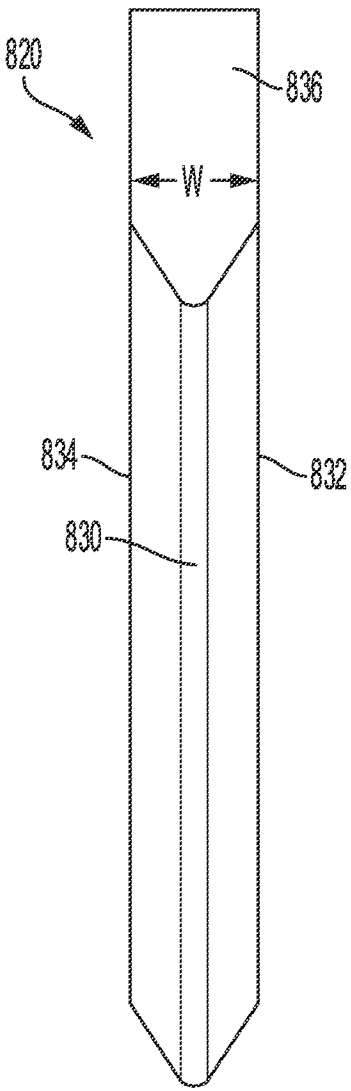
FIG. 18 depicts a front perspective view of an example vortex generator.
Figure 17:
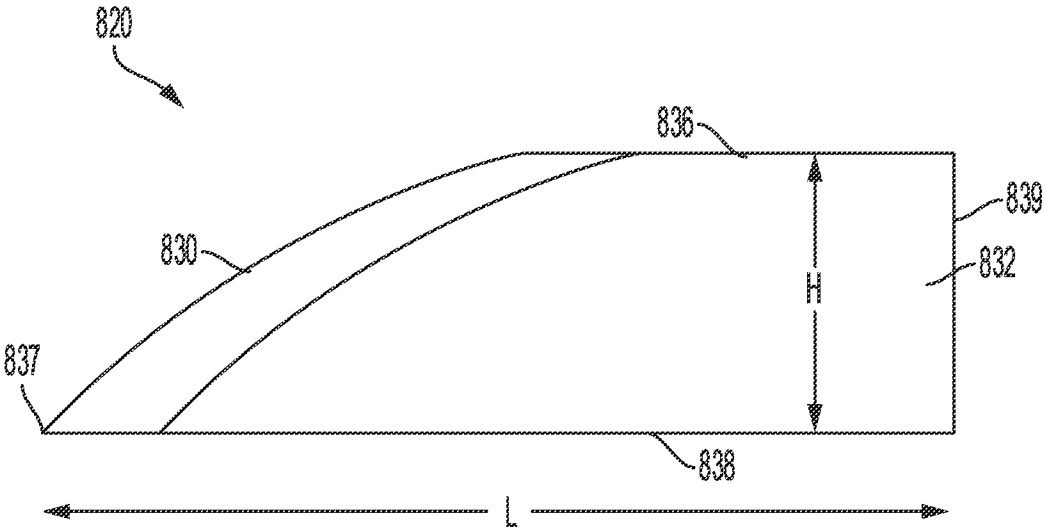
FIG. 17 depicts a side view of an example vortex generator.

FIG. 17 depicts a side view of an example vortex generator 820. FIG. 18 depicts a front perspective view of the example vortex generator 820. FIGS. 17-18 are discussed concurrently. The vortex generator 820 includes a leading edge 830, a top surface 836, a bottom surface 838, a heel side surface 832, and a toe side surface 834. The vortex generator 820 also has a frontmost point 837 and rear or trailing edge 839. The vortex generator 820 may be defined as having a height H between the top surface 836 and the bottom surface 838, a length L between the frontmost point 837 and the trailing edge 839 of the vortex generator, and a width W between the heel side surface 832 and the toe side surface 834. The length L may be between 0.150-0.350 inches and may be about 0.250 inches. The height H may be between 0.05-0.09 inches and may be about 0.075 inches. The width W may be between 0.01-0.03 inches and may be about 0.02 inches.

The leading edge 830 may be angled and/or curved as is extends from the frontmost point 837 to the top surface 836. The leading edge 830 may also come to a narrow point or edge that is radiused at a radius between 0.001-0.004 inches and may be about 0.002 inches. For instance, the heel side surface 832 and the toe side surface 834 converge together to form the edge 830.

The overall size of the example vortex generator 820 may be based on the effect of the example vortex generator 820 on the aerodynamic separation. For instance, a vortex generator 820 that has a height to energize the flow and reduce drag will likely not provide any additional benefit by having its height increased. Instead, an increase in height of the vortex generator 820 beyond what is needed to interact with the airflow may actually increase drag by introducing more energy into the airflow.

Figure 19:
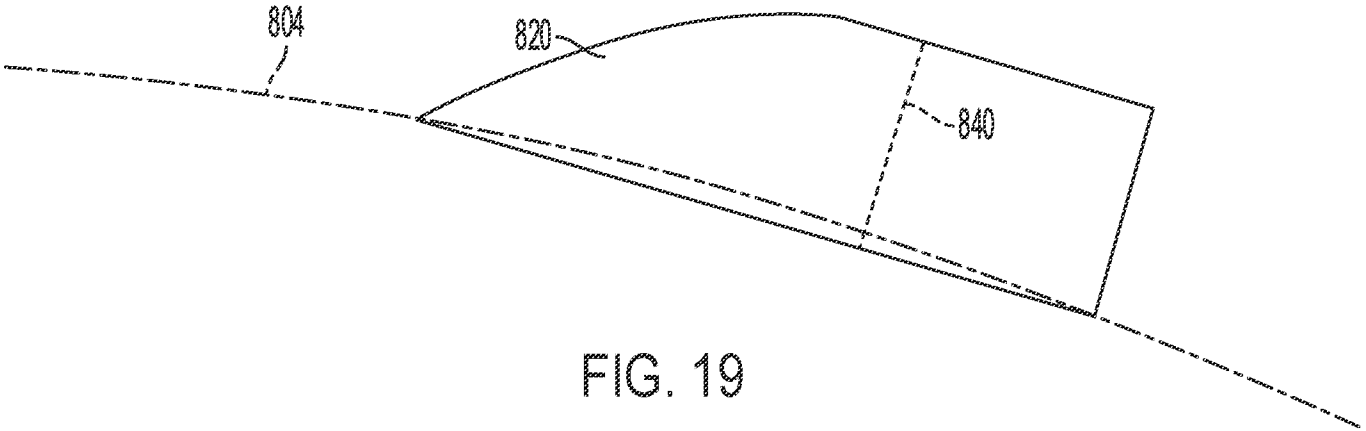
FIG. 19 depicts an example side view of a vortex generator attached to a body of an example golf club head.

FIG. 19 depicts an example side view of a vortex generator 820 attached to a crown 804. The vortex generator 820 includes a vertical axis 840. The vertical axis 840 is an axis that represents a vertical direction of the vortex generator 820 if the vortex generator 820 was not attached to the crown 804. For instance, the vertical axis 840 may align with a direction of gravity if the vortex generator 820 was placed on a flat, horizontal surface. When the vortex generator 820 is attached to the crown 804, the vertical axis of the vortex generator 820 may be perpendicular to a tangent plane of the crown surface at the attachment location.

Figure 20:
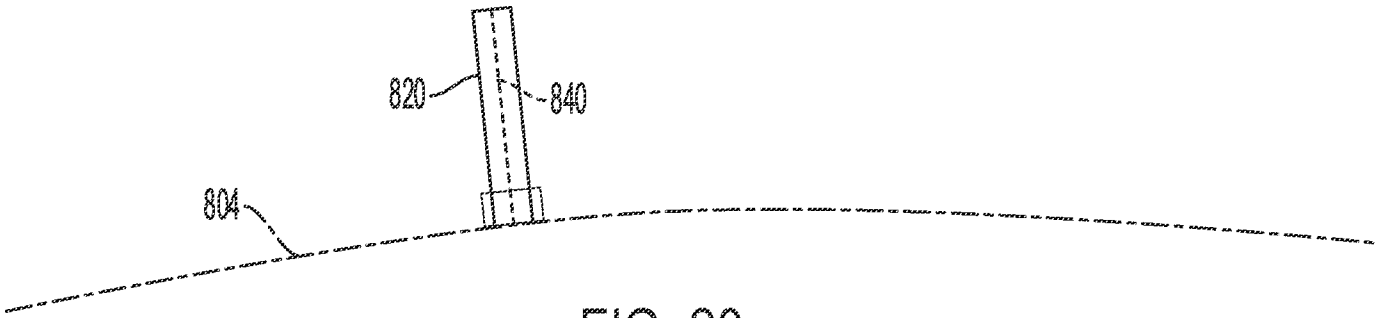
FIG. 20 depicts a front view of a vortex generator attached to a body of an example golf club head.

FIG. 20 depicts a front view of the vortex generator 820 attached to the crown. As can be seen from the front view as well, the vertical axis 840 of the vortex generator 820 is perpendicular to a tangent plane of the crown surface at the attachment location.

Because the vortex generators discussed herein are quite small, manufacturing processes that have high precision and tight tolerances may be needed to properly form the vortex generators. For instance, the small size of the vortex generators may effectively prevent the vortex generators from being incorporated as a standard cast metal component. Accordingly, the present technology may form a recess in the crown or sole of the golf club that is configured to receive an inlay that includes the vortex generators. The inlay may be manufactured from techniques that allow for greater precision, such as injection molding, 3D printing or the like. The inlay may then be affixed in the recess via an adhesive or other attachment mechanism. Accordingly, the club head may be manufactured using a casting process, and the inlay may be manufactured from a separate or different manufacturing process that allows for more precision. Additionally, the manufacturing process used to generate the inlays may allow for customization of the inlays while the casting process for the remainder of the club head may remain standardized.

Figure 21:
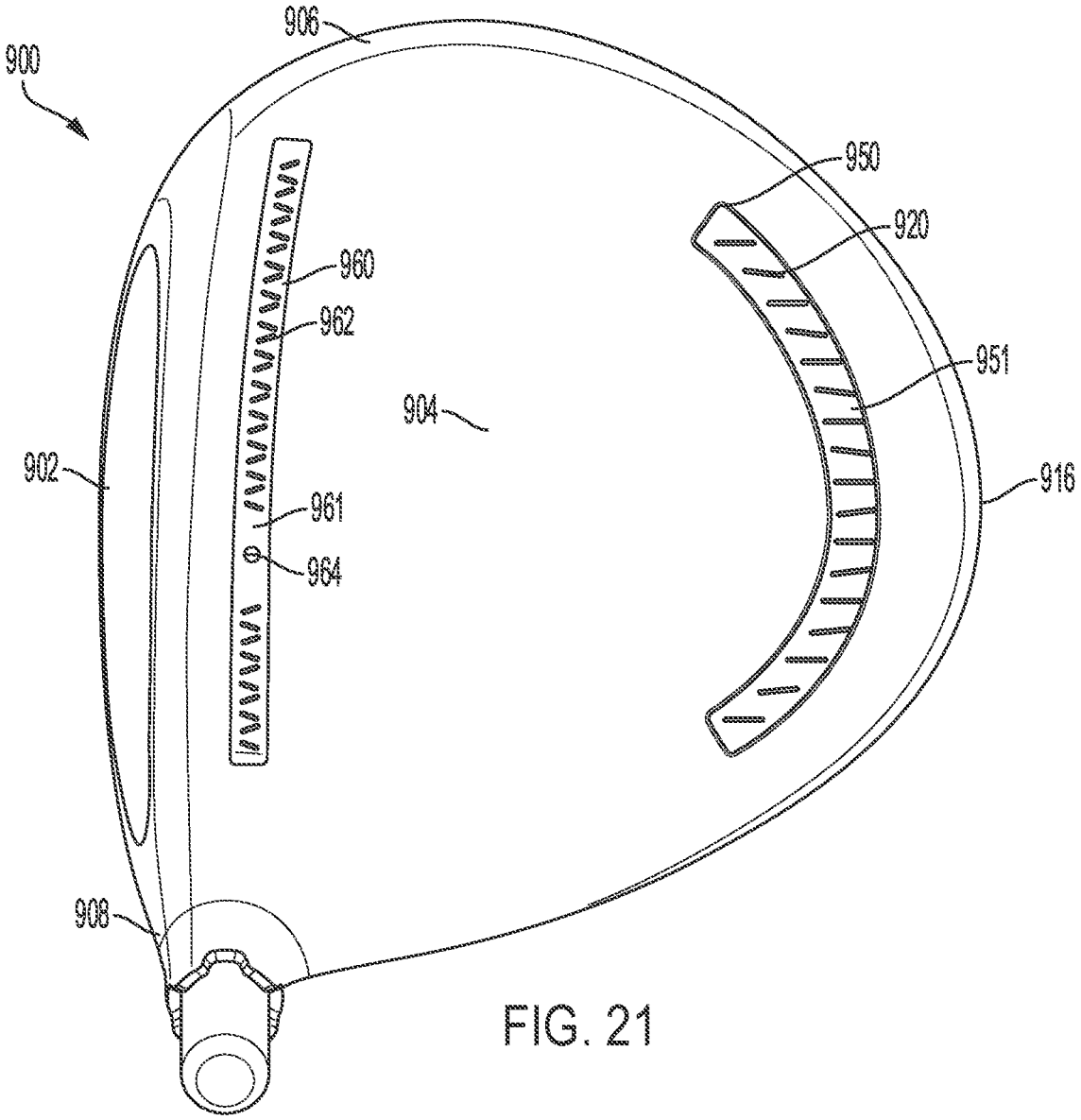
FIG. 21 depicts a top view of an example golf club head with vortex generator inlays.

FIG. 21 depicts a top view of an example golf club head 900 with vortex generator inserts 950, 960. More specifically, the golf club head 900 includes an aft vortex generator inlay 950 and a forward vortex generator inlay 960. The aft vortex generator inlay 950 includes a base 951 with a plurality of aft vortex generators 920 formed thereon. The forward vortex generator inlay 960 includes a base 961 that may include forward vortex generators 962 and/or an alignment indicator 964 formed thereon. While the forward vortex generator inlay 960 is described as having vortex generators 962 in this example, in other examples, the forward inlay 960 may include other or different small aerodynamic features, such as tripping structures, that have heights of less than about 0.1 inches. In general, the inlays discussed herein may be used to support such small aerodynamic features at any position of the golf club head 900 with a corresponding recess to receive the inlay. The golf club head 900 also includes a striking face 902, a crown 904, a rearmost point 916, a toe side 906, and a heel side 908.

Figure 22:
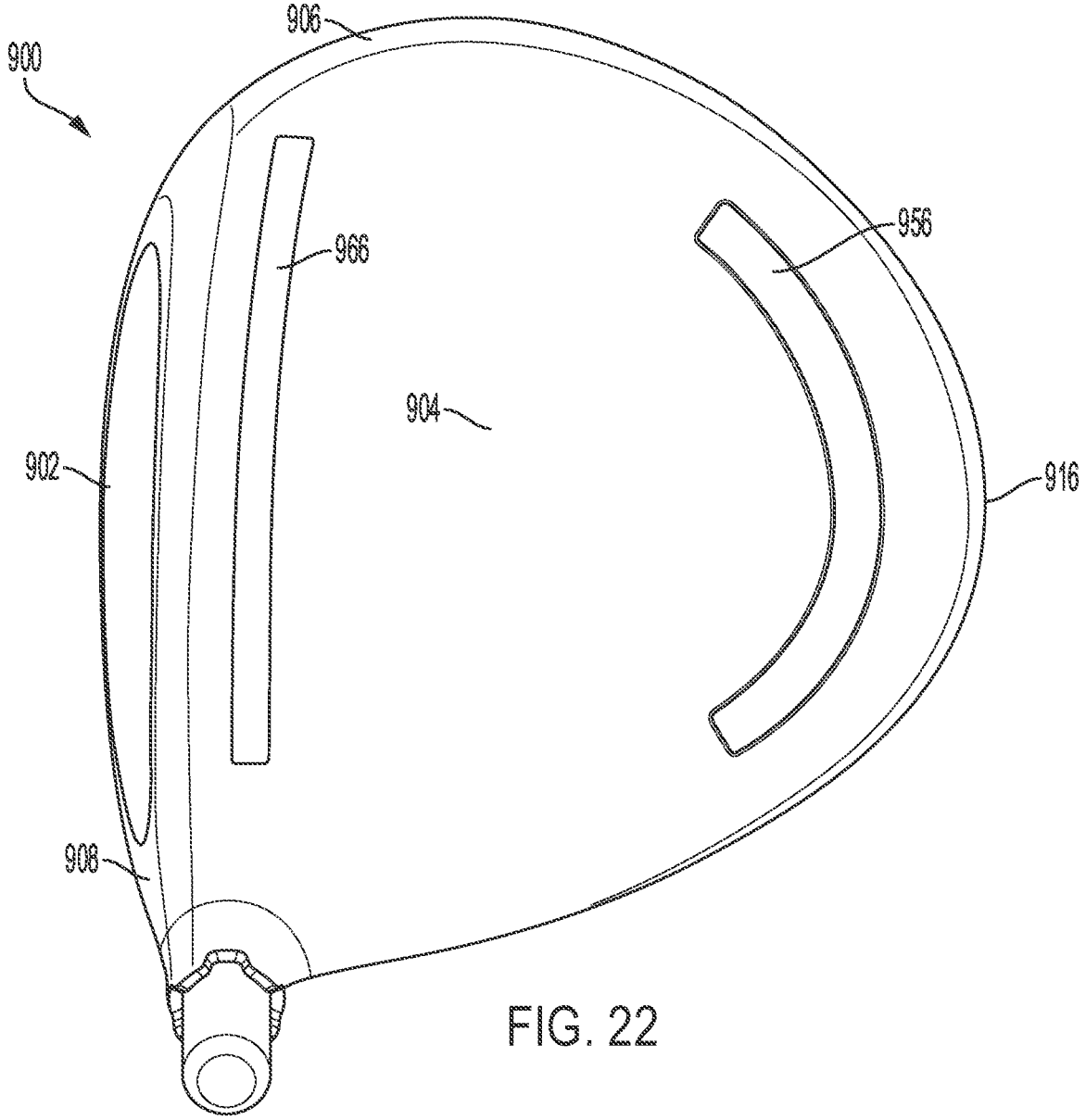
FIG. 22 depicts the example golf club head of FIG. 21 with the vortex generator inlays removed.

FIG. 22 depicts the example golf club head 900 of FIG. 21 with the aft vortex generator inlay 950 and the forward vortex generator inlay 960 removed. Without the aft vortex generator inlay 950 and the forward vortex generator inlay 960, the aft recess 956 and the forward recess 966 can be more easily seen. The aft recess 956 may have a shape that is consistent with one or more of the arcs 822 discussed above. For instance, a front edge of the aft recess 956 may be offset from the perimeter by one of the offset distances discussed above relating to the arcs 822.

The forward recess 966 extends across a front portion of the crown 904 in a heel-to-toe direction. The forward recess 966 may have a slight curvature to match the curvature of the front edge of the crown 904. For instance, the forward recess 966 may have a curvature that is similar to the horizontal face bulge radius of the golf club head 900. The front edge of the forward recess 966 may be positioned within 0.25 inches from the front edge of the crown 904.

The width of the aft recess 956 and the forward recess 966 may be substantially equal to the width of the respective aft vortex generator inlay 950 and the forward vortex generator inlay 960, respectively. The width of the respective inlays may be based on the lengths of the vortex generators formed thereon. For instance, the width of the aft vortex generator inlay 950 may be at least the length of the aft vortex generators 920 formed thereon. As an example, the width of the aft vortex generator inlay 950 may be between 100%-120% of the length of the aft vortex generators 920.

The depth of the aft recess 956 and the forward recess 966 may be equal to a thickness of a base of the forward vortex generator inlay 960 and the aft vortex generator inlay 950. For instance, the depth of the aft recess 956 and the forward recess 966 may be about 1 mm or between 0.5 mm to 1.5 mm. The base 951 of the aft vortex generator inlay 950 and the base 961 of the forward vortex generator inlay 960 provides a surface on which the aft vortex generators 920 and the forward vortex generators 962 may be formed, respectively. By having the depth of recesses 956, 966 be substantially the same as the thickness of the bases 951, 961, the upper surfaces of the base 951, 961 sit flush with the remainder the exterior surface of the crown 904, which provides for improved aerodynamics.

Figure 23:
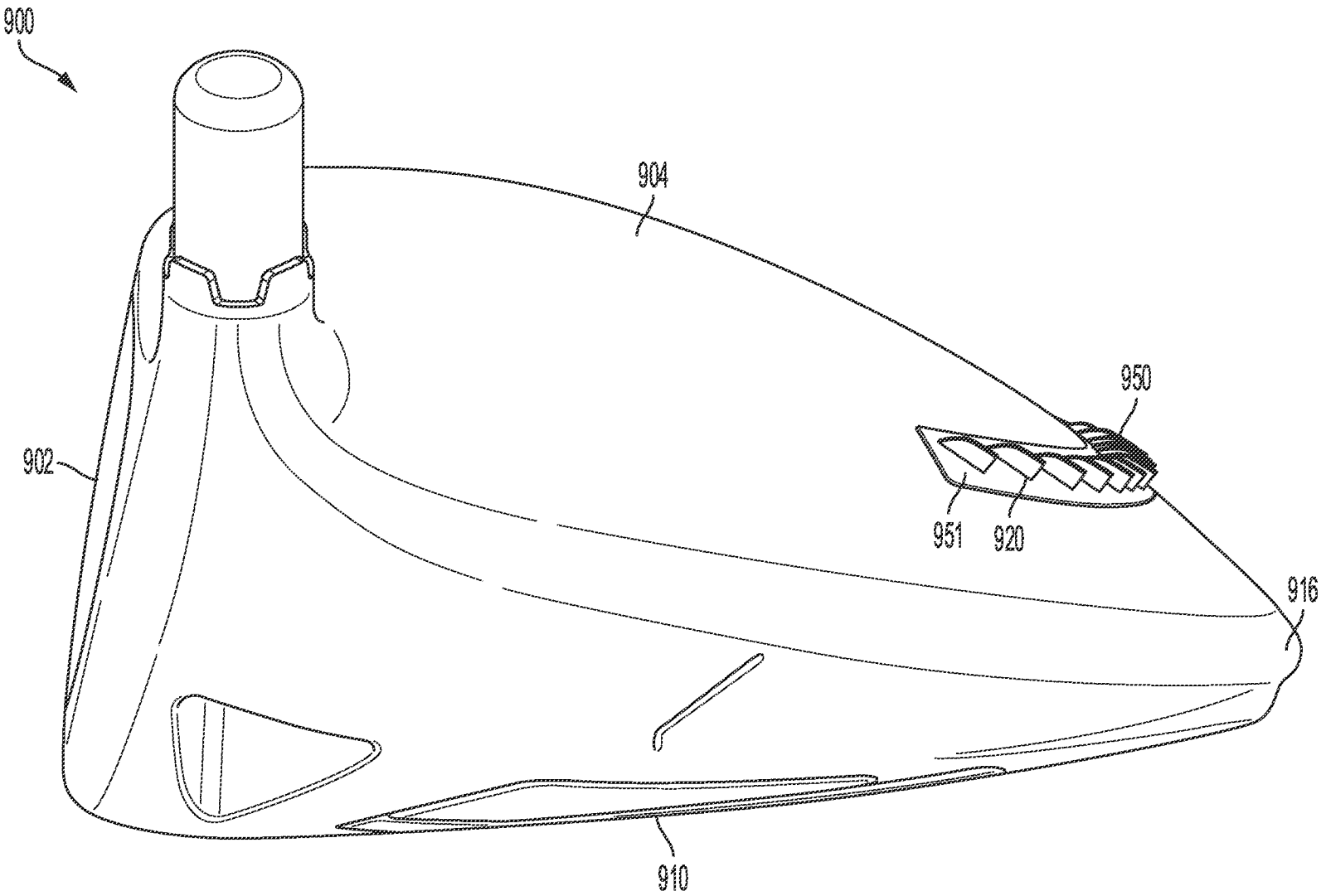
FIG. 23 depicts a side view of the golf club head of FIG. 21 with an aft vortex generator inlay.
Figure 24:
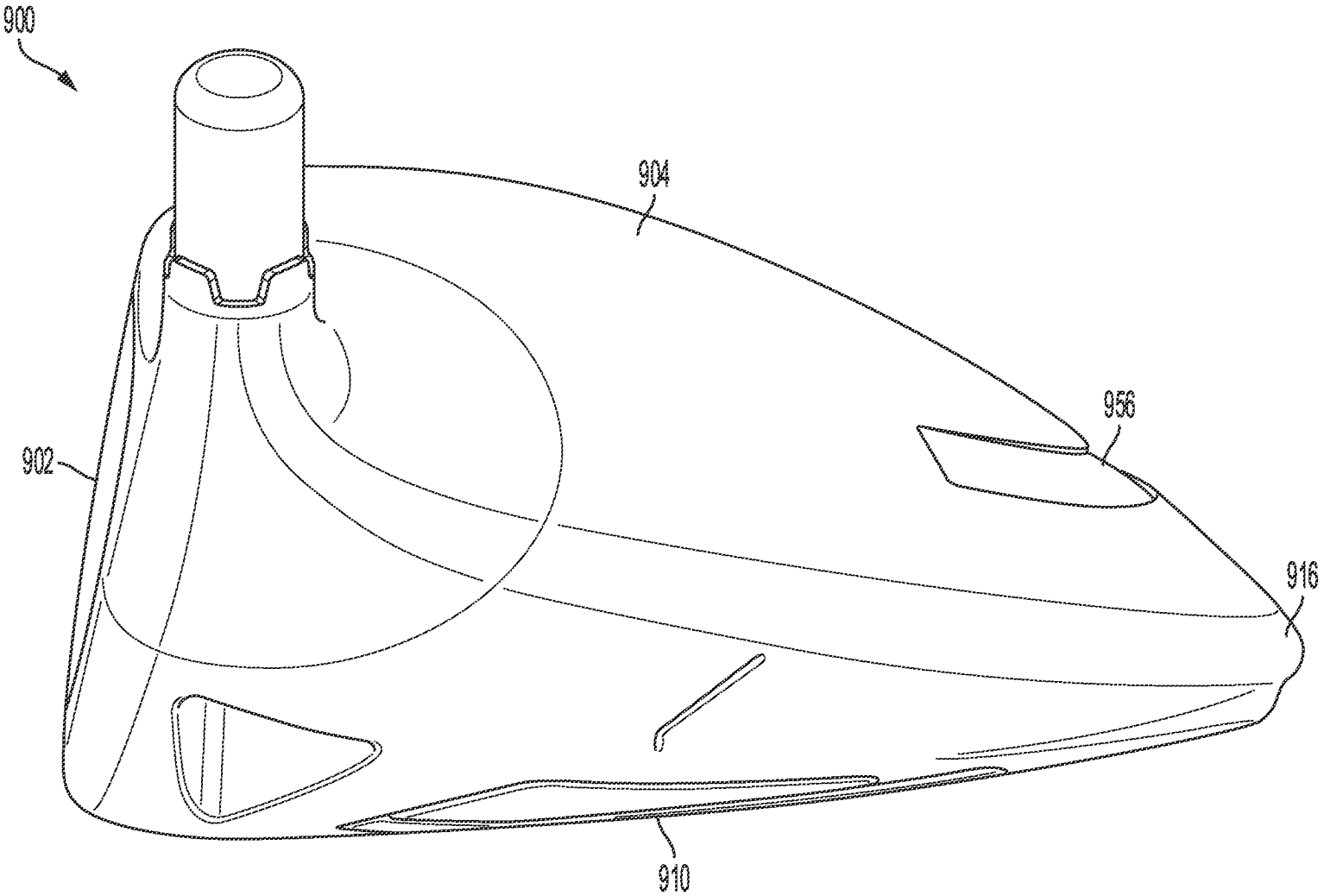
FIG. 24 depicts a side view of the golf club head of FIG. 23 with the aft vortex generator inlay removed.

FIG. 23 depicts a side view of the golf club head 900 with the aft vortex generator inlay 950. FIG. 24 depicts a side view of the golf club head 900 with the aft vortex generator inlay 950 removed. FIGS. 23-24 are discussed concurrently. The base 951 of the aft vortex generator inlay 950 and the aft vortex generators 920 the protrude from the base 951 can be more easily seen. In addition, the contour of the aft vortex generator inlay 950 can also be more easily seen. For instance, the aft vortex generator inlay 950 may be manufactured such that it is curved to match the shape of the aft recess 956. The aft vortex generator inlay 950 may also be at least partially flexible to help with installation of the aft vortex generator inlay 950 into the aft recess 956.

Figure 25:
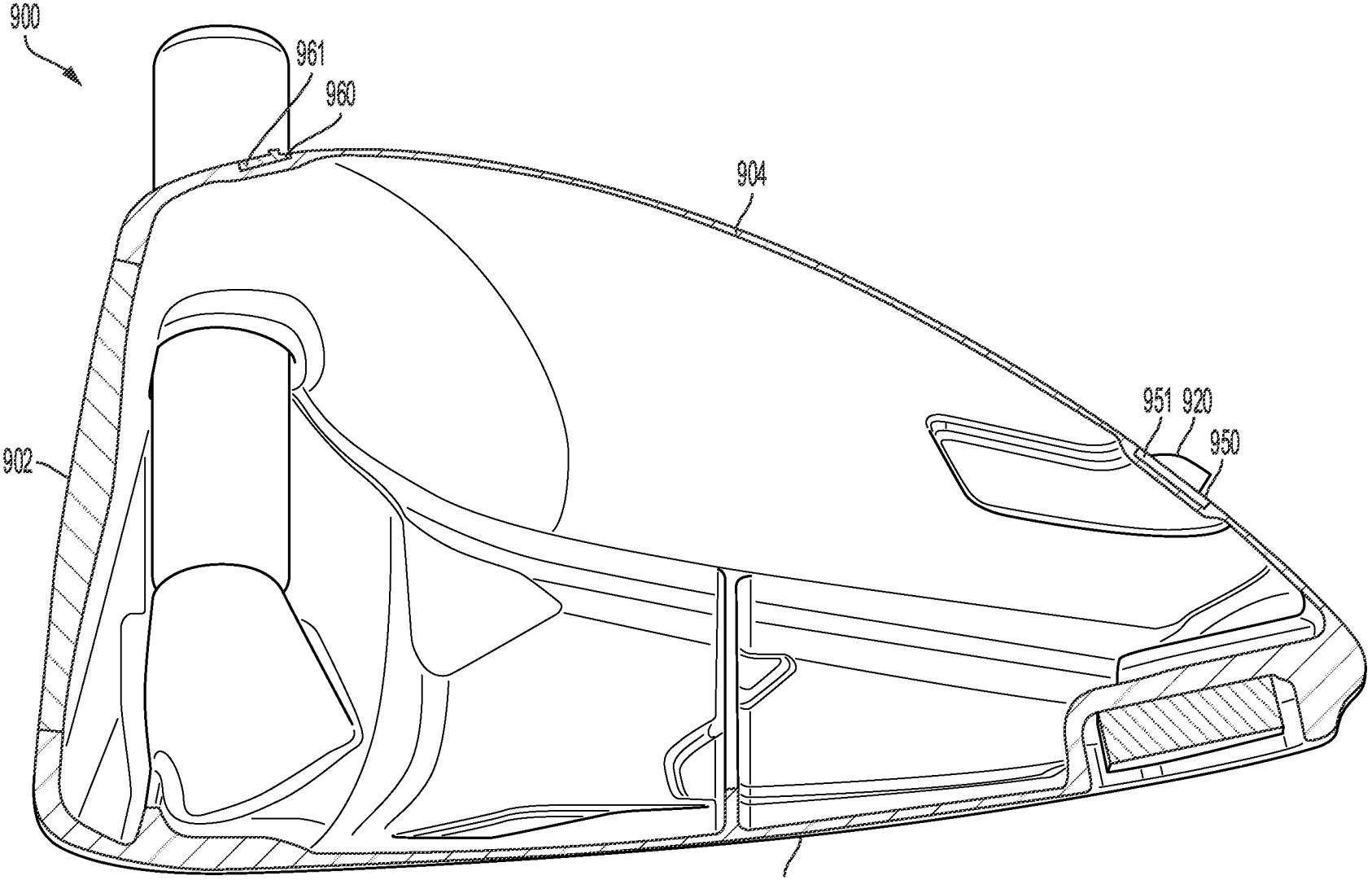
FIG. 25 depicts a side view of the interior of the golf club head of FIG. 21.

FIG. 25 depicts a side view of the interior of the golf club head 900. The thickness of the base 961 of the forward vortex generator inlay 960 and the thickness of the base 951 of the aft vortex generator inlay 950 can be more easily seen in FIG. 25. Similarly, the depth of the aft recess 956 and the depth of the forward recess 966 can also be more easily seen. Again, by having the depths of the recesses match the thickness of the bases, the upper surfaces of the bases may sit flush with the exterior surface of the crown 904. The thicknesses of the walls and floor of the recesses 956, 966 may be substantially the same as the thickness of the portion of the crown 904 surrounding the recesses 956, 966.

Figure 26:
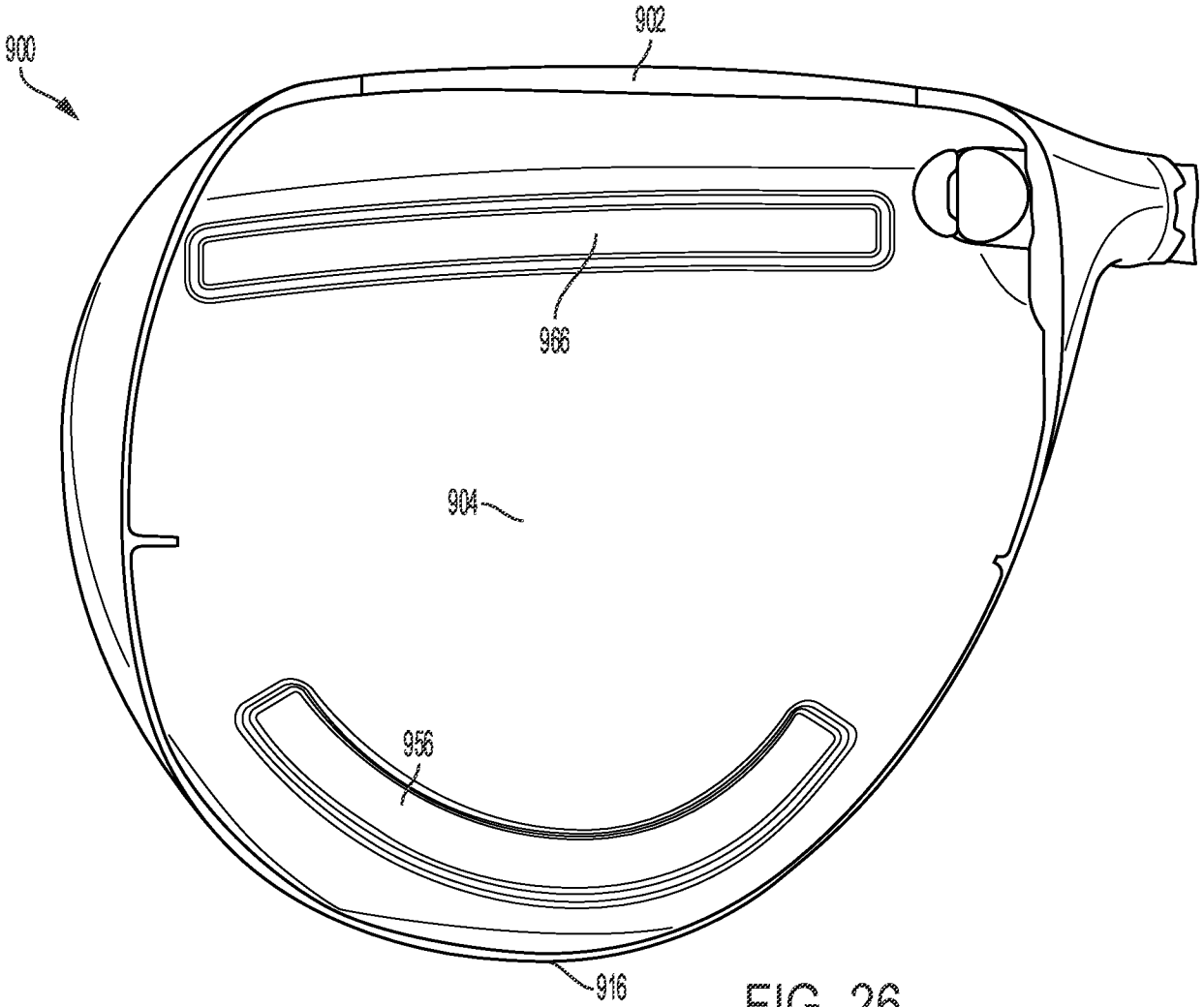
FIG. 26 depicts a bottom view of an interior of the golf club head of FIG. 21.

FIG. 26 depicts a bottom view of an interior of the golf club head 900. As can be seen from the figure, the aft recess 956 and the forward recess 966 protrude into the cavity of the example golf club head 900 and towards the sole of the example golf club head 900.

Figure 27A:
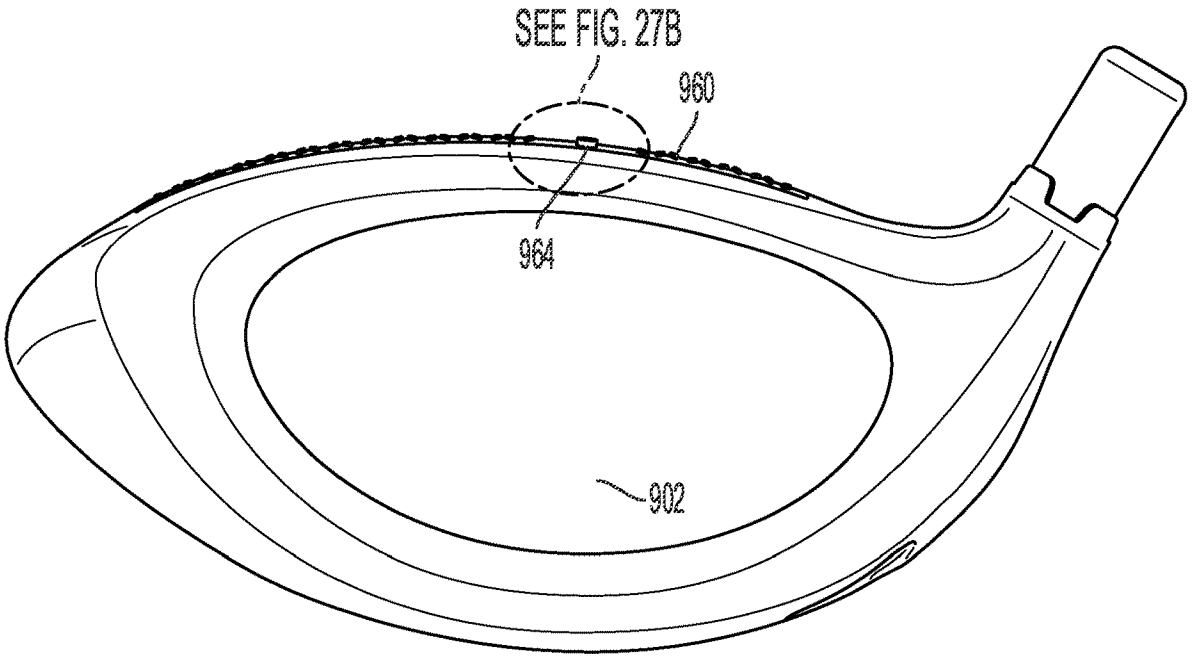
FIG. 27A depicts another example golf club head with a vortex generator inlay and an alignment protrusion.
Figure 27B:
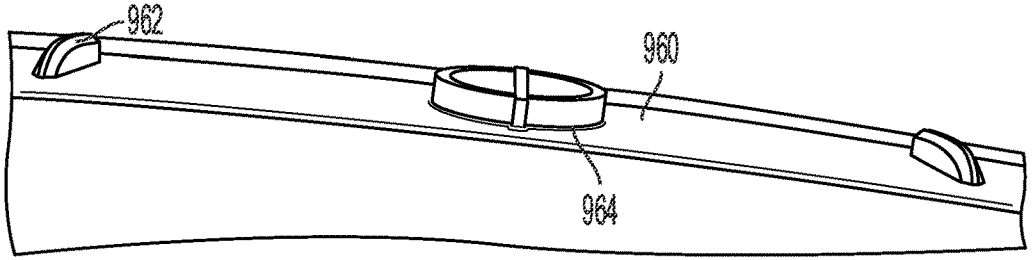
FIG. 27B depicts an enlarged portion of the golf club of FIG. 27A.

FIG. 27A depicts another example golf club head 900 with a forward vortex generator inlay 960 that includes an alignment protrusion 964. FIG. 27B depicts an enlarged portion of a segment of the golf club head 900 that includes the alignment protrusion 964. FIGS. 27A-B are discussed concurrently. The forward vortex generator inlay 960 is similar to the forward vortex generator inlay 960 discussed above, but the alignment indicator 964 includes a protruding or raised alignment indicator, which is referred to as the alignment protrusion 964. The height of the alignment protrusion 964 may be substantially similar to the heights of the forward vortex generators 962.

Because the aft vortex generator inlay 950 may be manufactured separately from the remainder of the golf club head 900, the alignment protrusion 964 may be customized for a particular golfer. For instance, the design, shape, size, location along the forward vortex generator inlay 960, and/or color of the alignment protrusion 964 may be configured by the golfer for custom manufacturing. In some examples, the alignment protrusion 964 may be recessed into the base 961 of the forward vortex generator inlay 960. The ability to have the alignment protrusion 964 be raised or recessed allows for additional contrast and aids in identification of the alignment protrusion 964 by the golfer.

Figure 28:
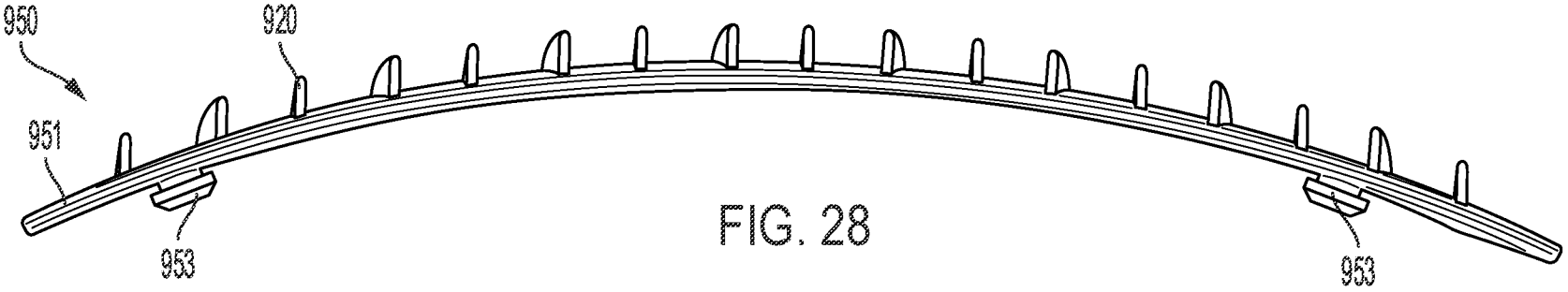
FIG. 28 depicts an example vortex generator inlay with attachment extensions.
Figure 29:
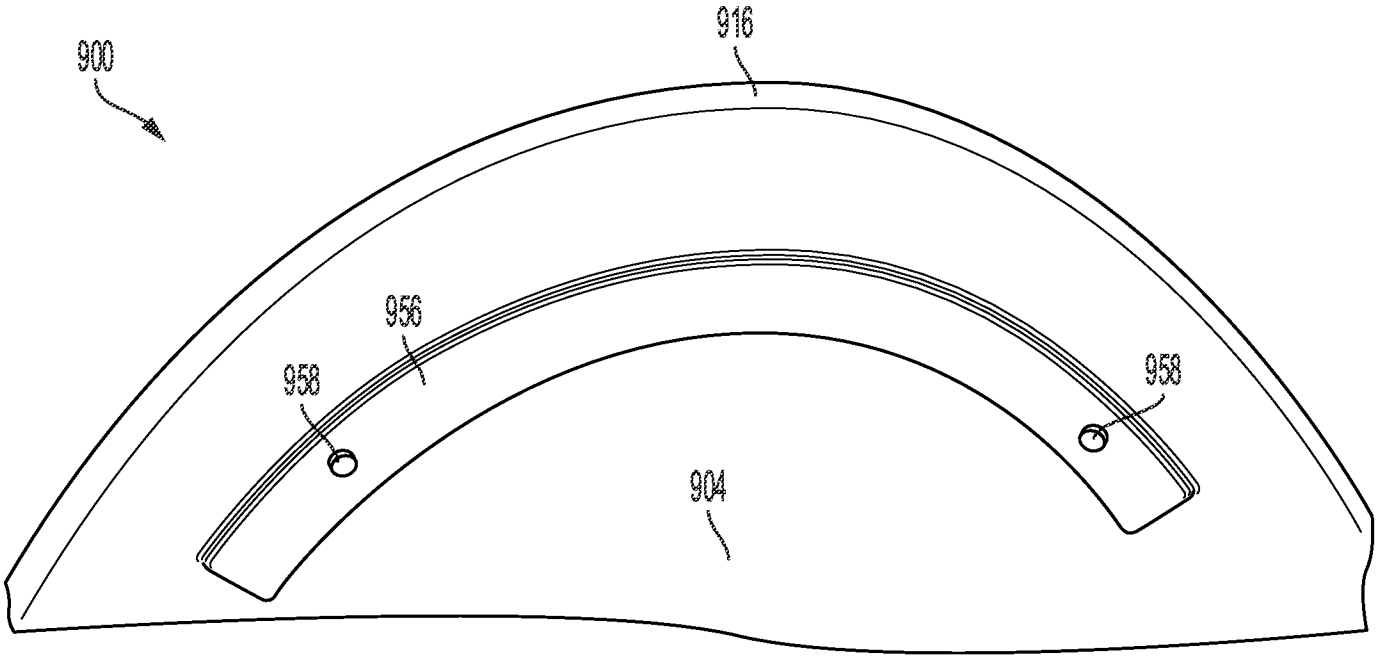
FIG. 29 depicts a top view of an example golf club head configured to receive the example vortex generator inlay of FIG. 28.
Figure 30:
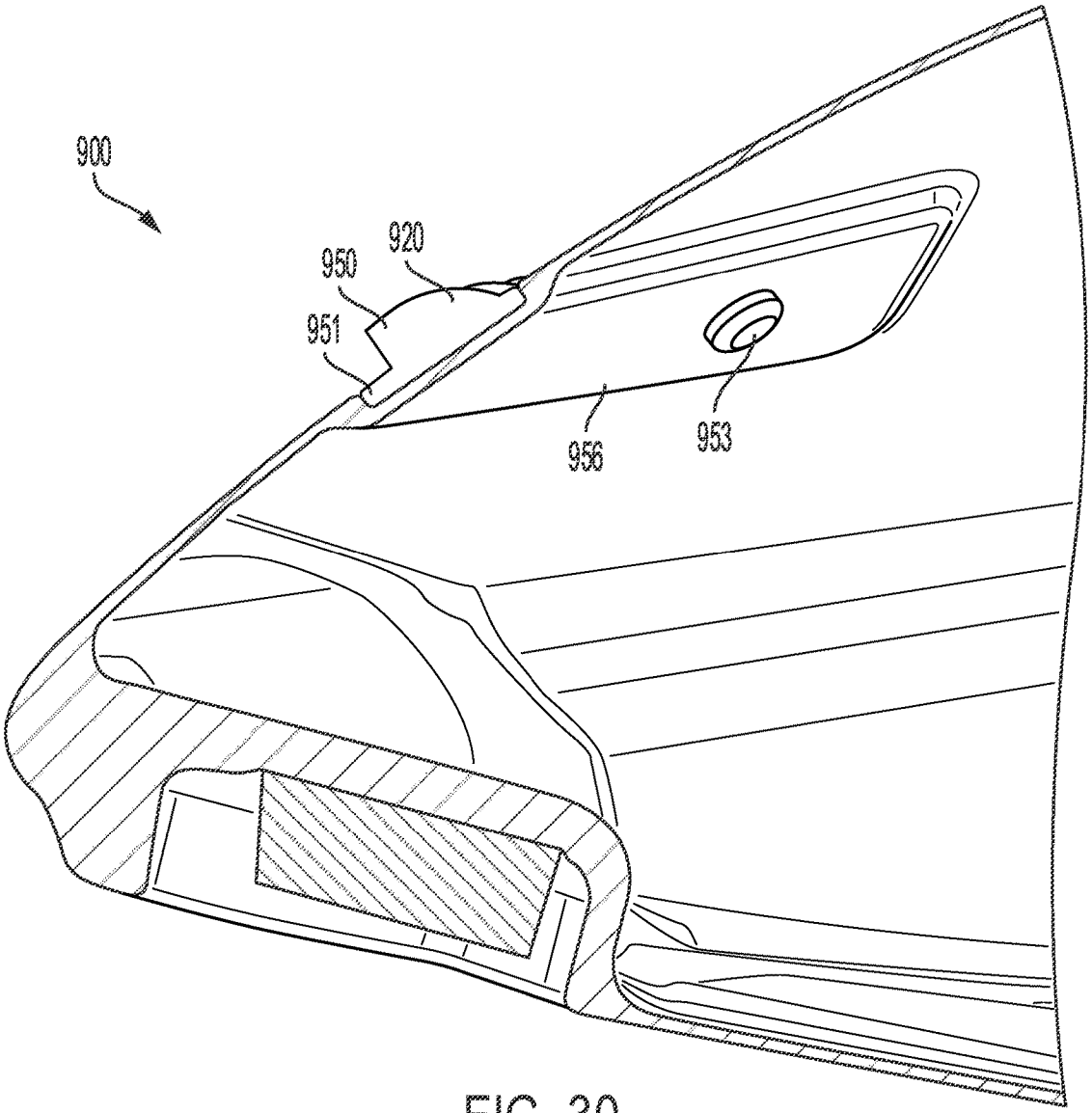
FIG. 30 depicts a side view of the interior of the example golf club head of FIG. 29 with the vortex generator inlay of FIG. 28 inserted into the golf club head.

FIG. 28 depicts an example aft vortex generator inlay 950 with attachment extensions 953. FIG. 29 depicts a top view of club head 900 configured to receive the example vortex aft vortex generator inlay 950 with the attachment extensions 953. FIG. 30 depicts a side view of the interior of the example golf club head 900 with the aft vortex generator inlay 950 inserted into aft recess 956. FIGS. 28-30 are discussed concurrently.

The attachment extensions 953 protrude downward from a lower surface of the base 951 of the aft vortex generator inlay 950. In some examples, the attachment extensions 953 are configured as a pin or plug with a shaft and a flange or head portion. The aft recess 956 includes receiving holes 958 to receive the attachment extensions 953. The receiving holes 958 may be through holes in the floor of the aft recess 956 that extend into the cavity of the example golf club head 900. The position of the receiving holes 958 are aligned with the position of the attachment extensions 953 such that the attachment extensions 953 are pushed through the receiving holes 958 when the aft vortex generator inlay 950 is installed into the aft recess 956. When a plug-type attachment extension is inserted through the receiving hole 958, the head portion causes an interference with the receiving hole to provide a securing mechanism in addition to, or alternatively, an adhesive. The interference also helps with surface alignment between the upper surface of the base 951 and the exterior surface of the crown 904.

Figure 31:
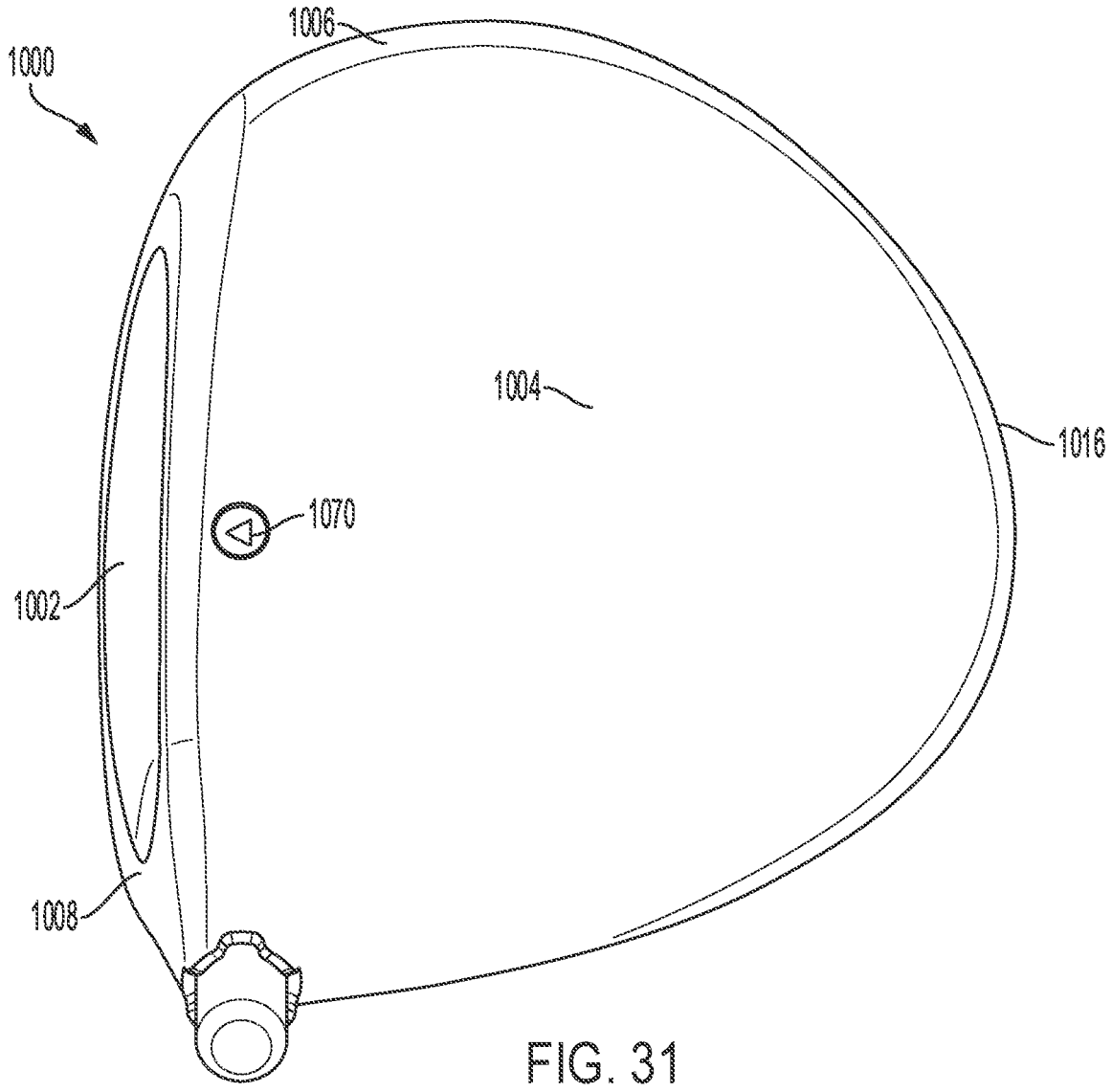
FIG. 31 depicts another example golf club head with an alignment inlay.

FIG. 31 depicts another example golf club head 1000 with an alignment inlay 1070. The golf club head 1000 is similar to the golf club heads discussed above. For instance, the example golf club head 1000 includes a striking face 1002, a crown 1004, a toe side 1006, a heel side 1008, and a rearmost point 1016. The alignment inlay 1070 is an example of a forward inlay that is smaller in size than the forward vortex generator inlays discussed above. The alignment inlay 1070 includes an alignment indicator. For instance, the alignment inlay 1070 may be the alignment indicator. The crown 1004 defines a forward recess for receiving the alignment inlay 1070.

Figure 32:
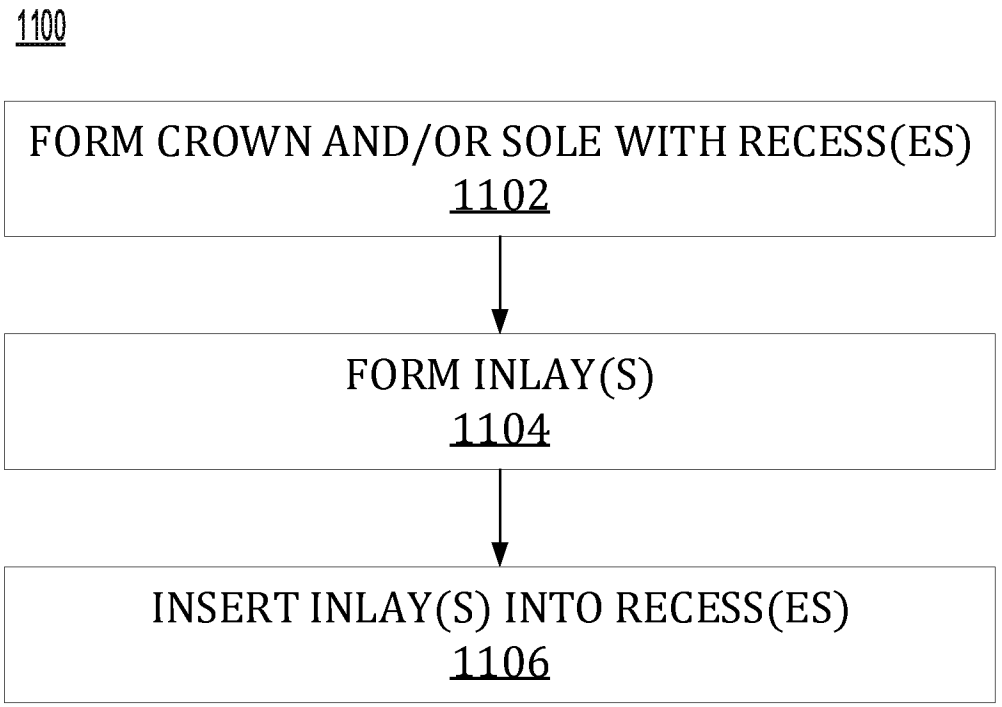
FIG. 32 depicts an example method for manufacturing a golf club head with one or more inlays.

FIG. 32 depicts an example method 1100 for manufacturing a golf club head with one or more inlays. At operation 1102, the club head body is formed with one or more recesses. For instance, the crown and/or sole is formed with one or recesses. The recesses may include one or more of the aft recess, forward recess, and/or alignment indicator recess, which may have the shapes and configurations as discussed above. The club head body (e.g., crown and/or sole) are formed from a first material, such as a metallic material (e.g., titanium, steel, etc.). The club head body is also formed from a first manufacturing process, such as a casting process. The recesses may also be formed with one or more receiving holes.

At operation 1104, one or more inlays are formed using a second manufacturing process that is different from the manufacturing process used to form the club head body in operation 1102. For example, the second manufacturing process may include an injection molding process or a 3D printing process, among others. The inlays may also be formed from a second material that is different from the material used to form the club head body. As an example, the club head body may be formed from metallic material and the inlay(s) may be formed from a non-metallic material. For instance, the material of the inlay(s) may include a plastic, composite, or polymeric material, among other types of materials. In other examples, the material of one or more of the inlays may also be metallic.

The inlay(s) formed in operation 1104 may include any of the inlays discussed herein, such as the aft vortex generator inlay, the forward vortex generator inlay, and/or the alignment inlay, among others. Forming the inlay(s) may include forming a base for the inlay and forming the vortex generators that protrude from an upper surface of the base. Forming the inlay(s) may also include forming one or more attachment extensions that protrude from a lower surface of the base.

Because the inlays may be formed from a second manufacturing process, the inlays may be formed in a customizable manner according to the needs or desires of the golfer. In addition, the inlays may be formed for particular golfer swing characteristics, such as swing speeds. For example, for higher swing speeds, the aft vortex generator inlay may have smaller (e.g., shorter) vortex generators. In contrast, for slower swing speeds, the aft vortex generator inlay may have larger (e.g., taller) vortex generators.

At operation 1106, the inlays formed in operation 1104 are inserted into the respective recesses formed in operation 1102. Inserting the inlays into the recesses may include adding an adhesive to the either the recess or the lower surface of the inlay to permanently adhere the inlay into the recess. In examples where receiving holes and attachment extensions are formed, inserting the inlays into the recesses may also include inserting the attachment extensions through the respecting receiving holes.

As discussed above, the configuration of the aft portion of a golf club head affects the aerodynamics of the golf club head. Improvements to the aerodynamics of the golf club head, in turn, lead to increased swing speeds of the golf club head when in use. In some golf club heads, there may be a desire to remove concavities from the aft portion of the golf club head to potentially improve the aerodynamics of the golf club head. Changing the shape of segments of the aft shell of the golf club head body from concave to convex, however, generally increases the volume of the segment and the overall volume of the golf club head. In the game of golf, strict limits on volume of the golf club head are placed by the governing bodies of the game. For instance, the volume of a driver may be limited to 460 cubic centimeters (cc). As such, while some increases in volume may be favorable for aerodynamics, volume must be conserved to ensure compliance with the volume limits.

Examples of the present technology utilize an asymmetric aft portion, such as the skirt or boat tail, of the golf club to improve aerodynamics of the golf club head while conserving volume of the golf club head. The volume of an aft slice of the golf club head varies from heel to toe and is asymmetric about the rearmost point of the golf club head. For example, the toe side of the aft slice may have a volume that is less than the heel side of the aft slice. Through testing, the increase in volume (e.g., to create convex segments) on the heel side provides an improvement to aerodynamics and club head speed, whereas a similar increase in volume on the toe side does not provide similar improvements to aerodynamics or club head speed. Accordingly, by providing an asymmetric aft slice, the aerodynamics of the golf club head can be improved without unnecessarily increasing volume on the toe side (where aerodynamic benefits are not substantially seen).

As one specific example, in the Titleist TSi3 Driver, available from the Acushnet Company of Fairhaven, MA, two steps exist on the boat tail. One step has a significant component of its normal vector substantially towards the toe side of the club head in the toe-to-heel direction. The other step has a normal vector that points substantially in the other direction (e.g., towards the heel side in heel-to-toe direction). Increasing the sole of such a driver to achieve some of the boat tail configurations discussed herein, however, may result in an increase in area of those steps. Such steps may have a negative impact on aerodynamics due to increased flow separation. To potentially alleviate such negative aerodynamic effects, the steps may be faired over to smooth the steps. Fairing over the steps however increases volume. In testing, fairing over the heelward step provided substantially greater aerodynamic effects than fairing over the toeward step. Thus, the testing confirmed that an asymmetric aft portion helps maximize aerodynamic improvements while still conserving volume.

Figure 34:
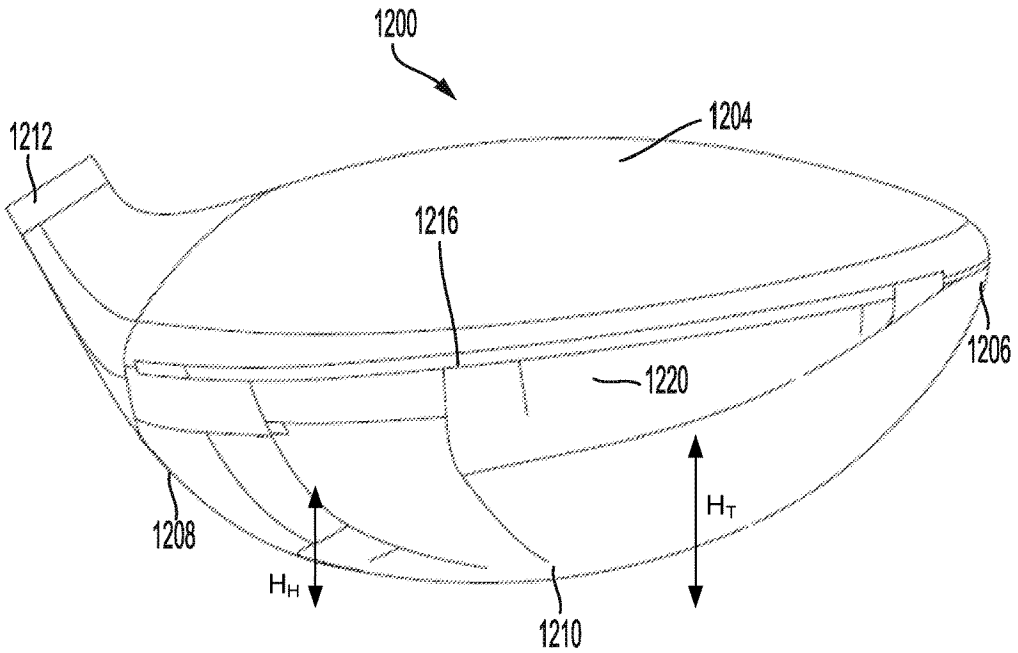
FIG. 34 depicts a rear view of the golf club head of FIG. 33.
Figure 33:
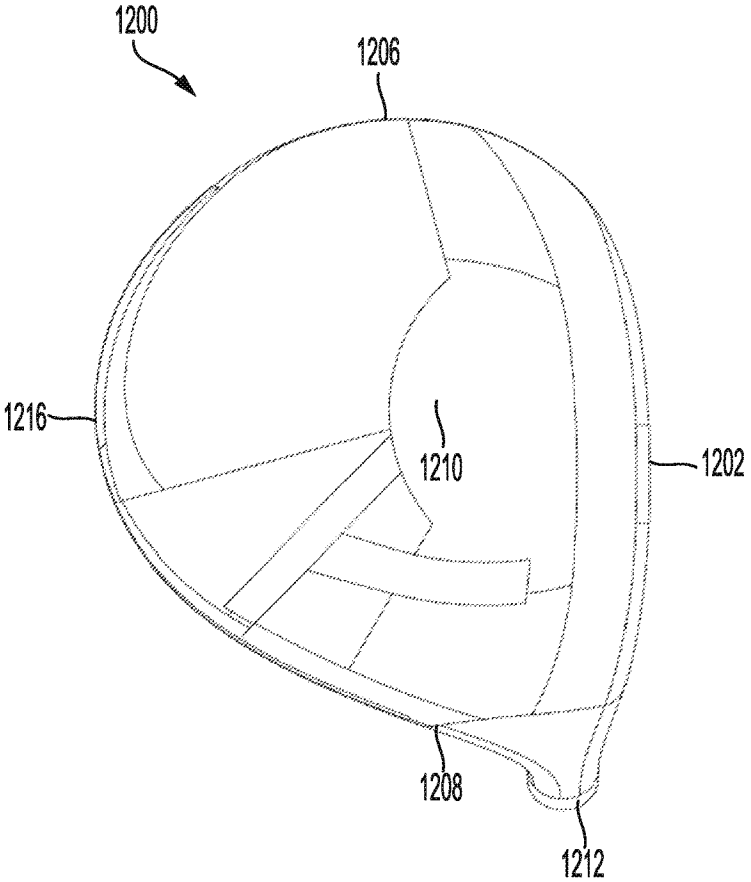
FIG. 33 depicts bottom view of a golf club head with an asymmetrical aft portion.
Figure 36:
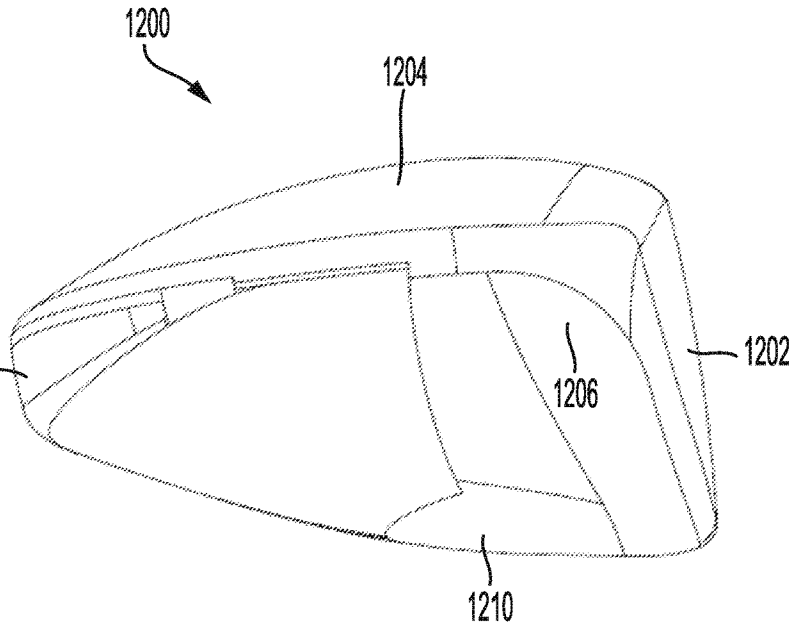
FIG. 36 depicts a toe-side view of the golf club head of FIG. 33.
Figure 35:
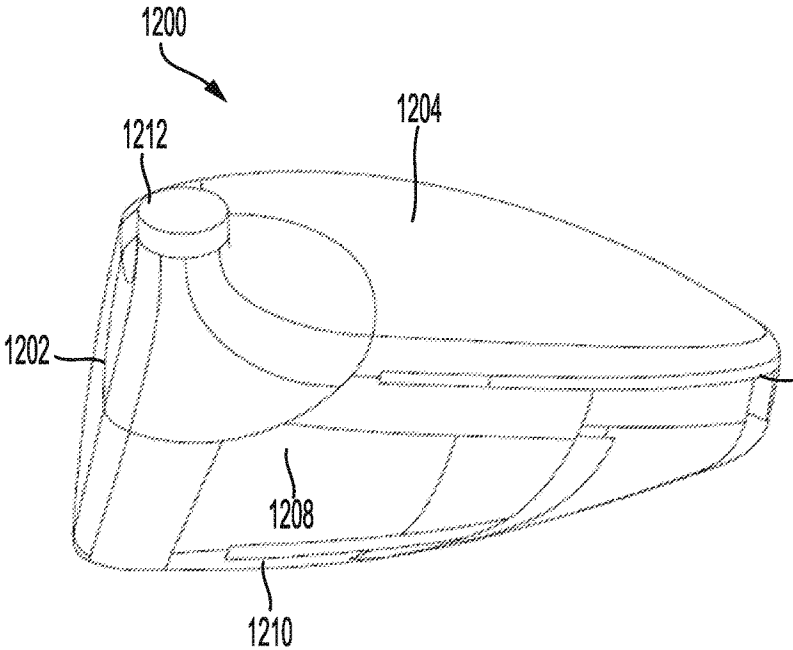
FIG. 35 depicts a heel-side view of the golf club head of FIG. 33.

FIG. 33 depicts bottom view of a golf club head 1200 with an asymmetrical aft portion. FIG. 34 depicts a rear view of the golf club head 1200, FIG. 35 depicts a heel-side view of the golf club head 1200, and FIG. 36 depicts a toe-side view of the golf club head 1200. FIGS. 33-36 are discussed concurrently. The golf club head includes a striking face 1202, a crown 1204, a sole 1210, a toe side 1206, a heel side 1208, a hosel 1212, a skirt 1220 or boat tail, and a rearmost point 1216.

The sole 1210 and the skirt 1220 have different geometries on the toe side of the rearmost point 1216 versus the heel side of the rearmost point 1216. The different geometries result in the skirt 1220 and a segment of the aft portion the golf club head 1200 to be asymmetric about the rearmost point 1216. For example, the volume of the skirt 1220 on the toe side of the rearmost point 1216 is less than the volume of the skirt on the heel side of the rearmost point 1216. In FIG. 34, the additional volume for the aft portion of the example golf club head 100 on the heel side 1208 can be seen as compared to the volume of the aft portion on the toe side 1206. The shape of the crown 1204 may be symmetric around a vertical plane extending in the front-to-back direction and through a point, such as the frontmost point, face center, and/or rearmost point 1216.

As one example, at set distance from the frontmost point of the club face, the height of the sole 1210 above the ground may be different on the toe side of the rearmost point 1216 and the heel side of the rearmost point 1216. For example, as shown in FIG. 34, two heights above ground are shown. The first height above ground is a height above ground ($H_H$) for a heel side of the aft portion, and a second height above ground ($H_T$) for a toe side of the aft portion. The height above ground ($H_H$) for the heel side may be measured at a point of 75% of the front-to-back distance of the golf club head 1200 and 25% of the toe-to heel distance from the rearmost point 1216 towards the heel. The height above ground ($H_T$) for the toe side of the aft portion measured at a point of 75% of the front-to-back distance of the golf club head 1200 and 25% of the toe-to-heel distance from the rearmost point 1216 towards the toe. In some examples, the height above ground ($H_T$) for the toe side may be at least 10%, 15%, or 20% greater than the height above ground ($H_H$) for the heel side.

Figure 37:
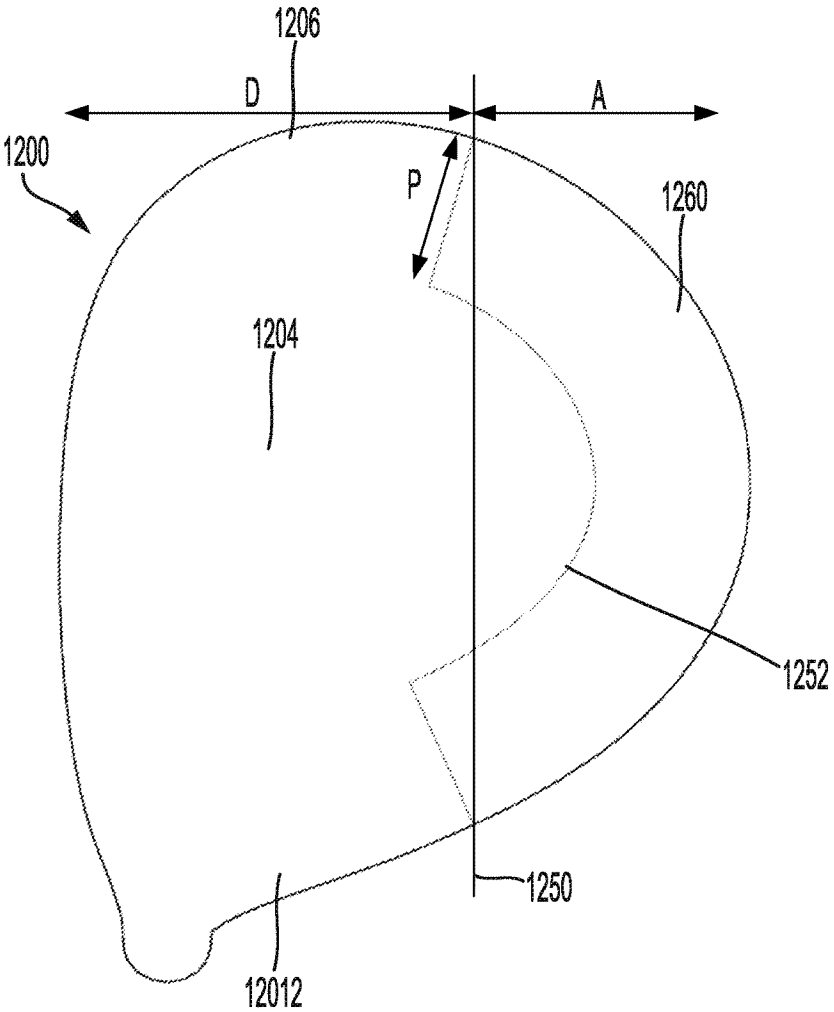
FIG. 37 depicts a top view of the golf club head of FIG. 33 with an example aft slice.

FIG. 37 depicts a top view of the golf club head 1200 with an example aft slice 1260. The example aft slice 1260 may be configured similarly to the aft slice 760 discussed above. For instance, the aft slice 1260 is a portion of the golf club head 1200 beginning at a slice line 1250 and between an outer perimeter of the golf club head 1200 and an offset perimeter slice curve 1252. The slice line 1250 runs in the heel-to-toe direction (e.g., parallel with a heel-to-toe axis) and is located a slice depth D from the frontmost point of the golf club head. The cut of the aft slice 1260 begins at the slice line 1250 and is perpendicular to the outer perimeter of the golf club head 1200. The offset perimeter slice curve 752 is offset from the outer perimeter of the golf club head 1200 by a perimeter offset distance P. The offset perimeter slice curve 1252 follows the outline or contour of the outer perimeter at the offset position. For instance, an aft portion of the golf cub head 1200 substantially to the rear of the slice line 1250 may be identified. A perimeter portion that is offset by the perimeter-offset distance P from the outer perimeter of that aft portion is then extracted or identified to form or define the aft slice 1260. The aft slice 1260 may be formed or extracted computationally by generating a three-dimensional scan of the golf club head or other computer modelling of the golf club head. In the example depicted in FIG. 12, the slice depth D is 60% of the front-to-back length of the club head 1200 measured from the frontmost point of the golf club head, and the perimeter offset distance P is 1.0 inches.

The aft slice 1260 also has an aft depth A that is measured from rearmost point of the aft slice 760 to the frontmost point of the outer perimeter of the aft slice 1260 (e.g., where the cut begins at slice line 750). The aft depth A of the aft slice 1260 is equal to the difference of the front-to-back length of the club head 1200 and the slice depth D. In the example depicted in FIG. 37, the aft depth A of the aft slice 1260 is equal to 40% of the front-to-back length of the club head 1200. Other values discussed above for slide depth D, aft depth A, and the offset distance P may also be used.

Figure 38:
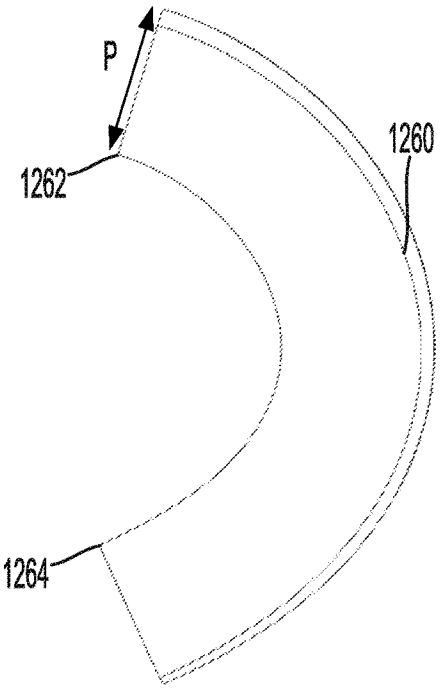
FIG. 38 depicts a top view of the example aft slice depicted in FIG. 37.
Figure 39:
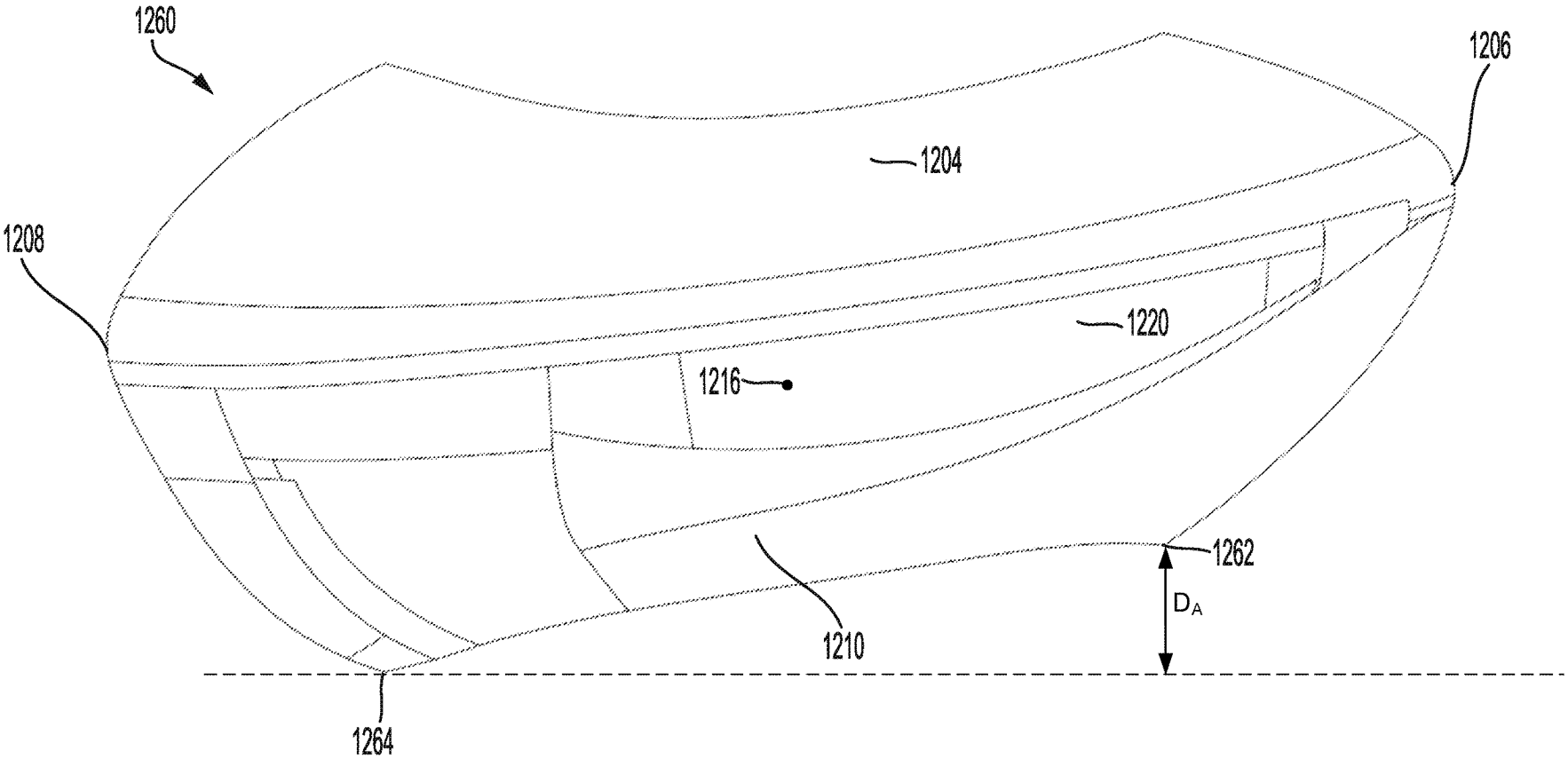
FIG. 39 depicts a rear view of the example aft slice.
Figure 41:
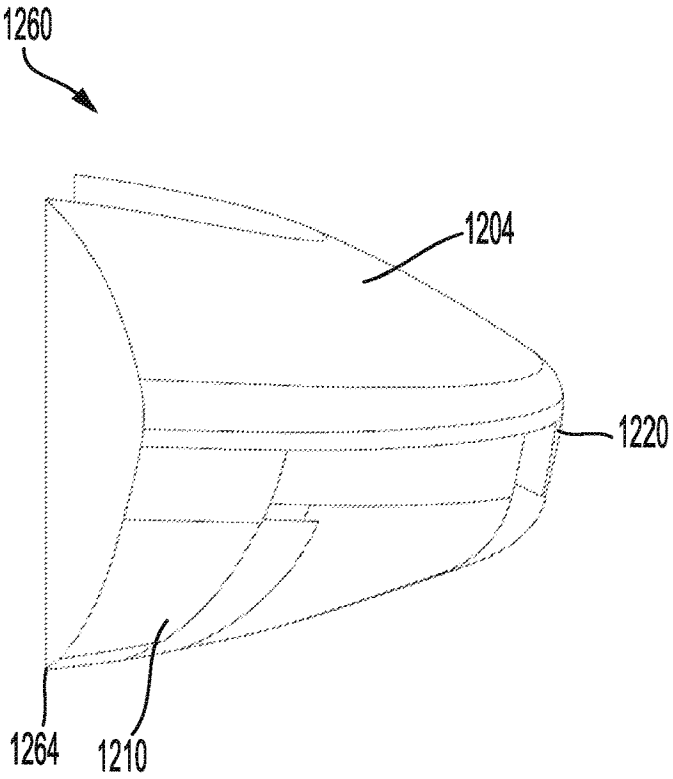
FIG. 41 depicts a heel-side view of the example aft slice.
Figure 40:
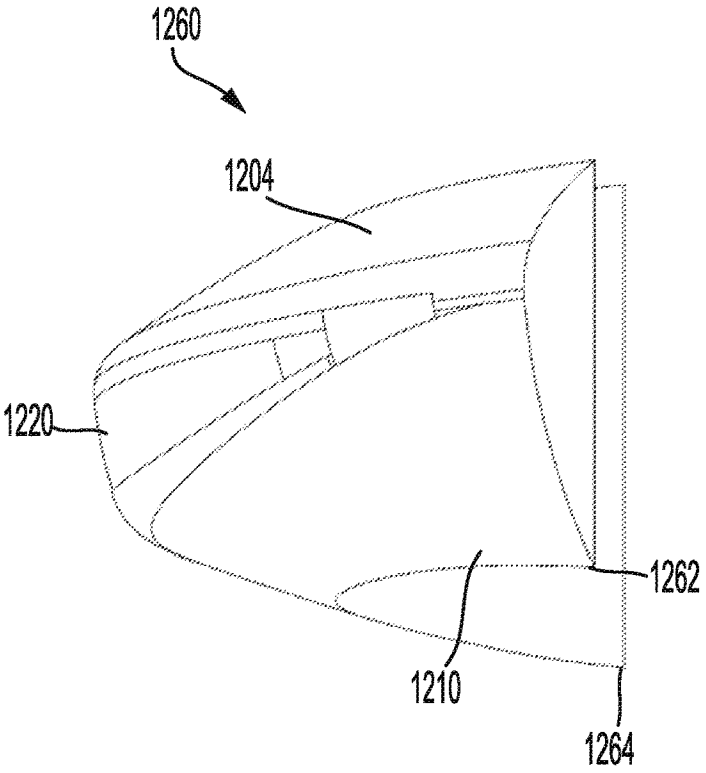
FIG. 40 depicts a toe-side view of the example aft slice.

FIG. 38 depicts a top view of the example aft slice 1260 removed or separated from the golf club head 1200. FIG. 39 depicts a rear view of the example aft slice 1260. FIG. 40 depicts a toe-side view of the example aft slice 1260. FIG. 41 depicts a heel-side view of the example aft slice 1260. FIGS. 38-41 are discussed concurrently.

As shown in FIGS. 38-41, the aft slice 1260 also includes a toe-side interior-most point 1262 and a heel-side interior-most point 1264. The toe-side interior-most point 1262 is the lowest (e.g., closest to ground) point of the aft slice 1260 in the most interior point on the toe side of the aft slice 1260 (e.g., the point closest to the striking face 1202). The heel-side interior-most point 1264 is the lowest (e.g., closest to ground) point of the aft slice 1260 in the most interior point on the heel side of the aft slice 1260 (e.g., the point closest to the striking face 1202).

Due to the asymmetry of the aft slice 1260, the toe-side interior-most point 1262 may be positioned higher above the ground plane than the heel-side interior-most point 1264. For example, the toe-side interior-most point 1262 may be positioned an asymmetry distance ($D_A$) above a plane parallel to the ground plane and extending through the heel-side interior-most point 1264. The asymmetry distance may be at least 0.1 inches, 0.2 inches, 0.3 inches, 0.4 inches, 0.5 inches, 0.6 inches, and/or 0.7 inches and is less than 1 inch, 1.2 inches, and/or 1.4 inches. In some examples, the asymmetry distance ($D_A$) may be at least 5%, 7%, 10%, 12%, 15%, 17%, or 20% of the club head height (e.g., the bottom of the sole to the uppermost portion of the crown). The greater the asymmetry distance ($D_A$), the more volume that can be preserved on the toe side of the golf club head. For instance, as can be seen in the figures, the portion of the aft slice 1260 that is toward the toe side 1206 of the rearmost point 1216 has a smaller volume than the portion of the aft slice 1260 that is towards the heel side 1208 of the aft slice 1260.

Figure 42:
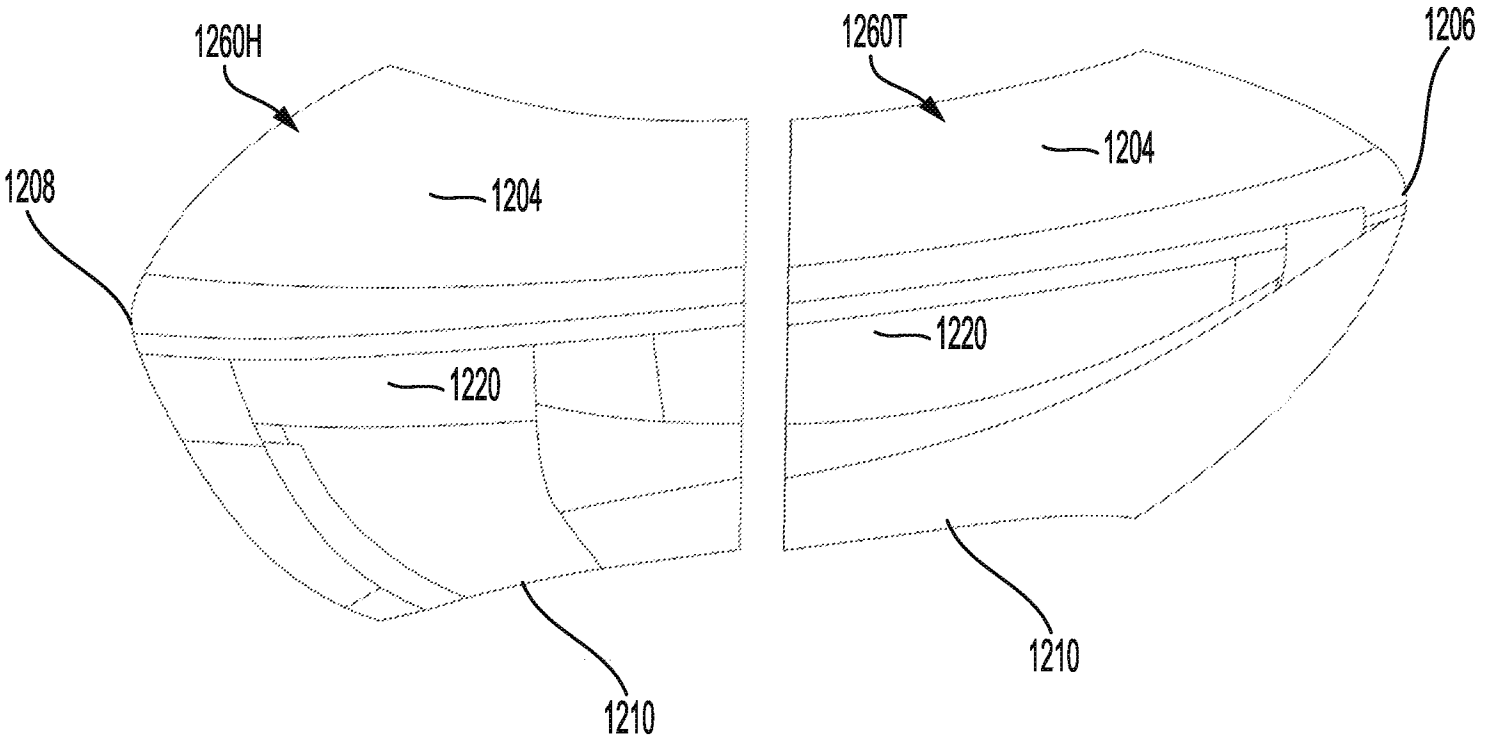
FIG. 42 depicts a rear view of the example aft slice split into a toe-side aft slice and a heel-side aft slice.

FIG. 42 depicts a rear view of the example aft slice split 1260 into a toe-side aft slice 1260T and a heel-side aft slice 1260H. The aft slice 1260 is split by a vertical plane (e.g., perpendicular to ground plane or in the y-direction) running through the rearmost point 1216 of the aft slice 1260. The volume of the heel-side aft slice 1260H has a volume that is greater than the volume of the toe-side aft slice 1260T. In some examples, the volume of the heel-side aft slice 1260H may be at least 1%, 2%, 5%, 10%, 15%, 20%, 25%, or 30% greater than volume of the toe-side aft slice 1260T. As discussed above, the greater the difference in volumes the more volume conservation that can be achieved while still improving overall aerodynamics of the golf club head 1200.

In some examples, the sole 1210 of the toe-side aft slice 1260T includes a concave component or segment, while the heel-side aft slice 1260H does not include any concave components or segments. For example, the sole 1210 of the heel-side aft slice 1260H may be entirely convex.

Figure 43:
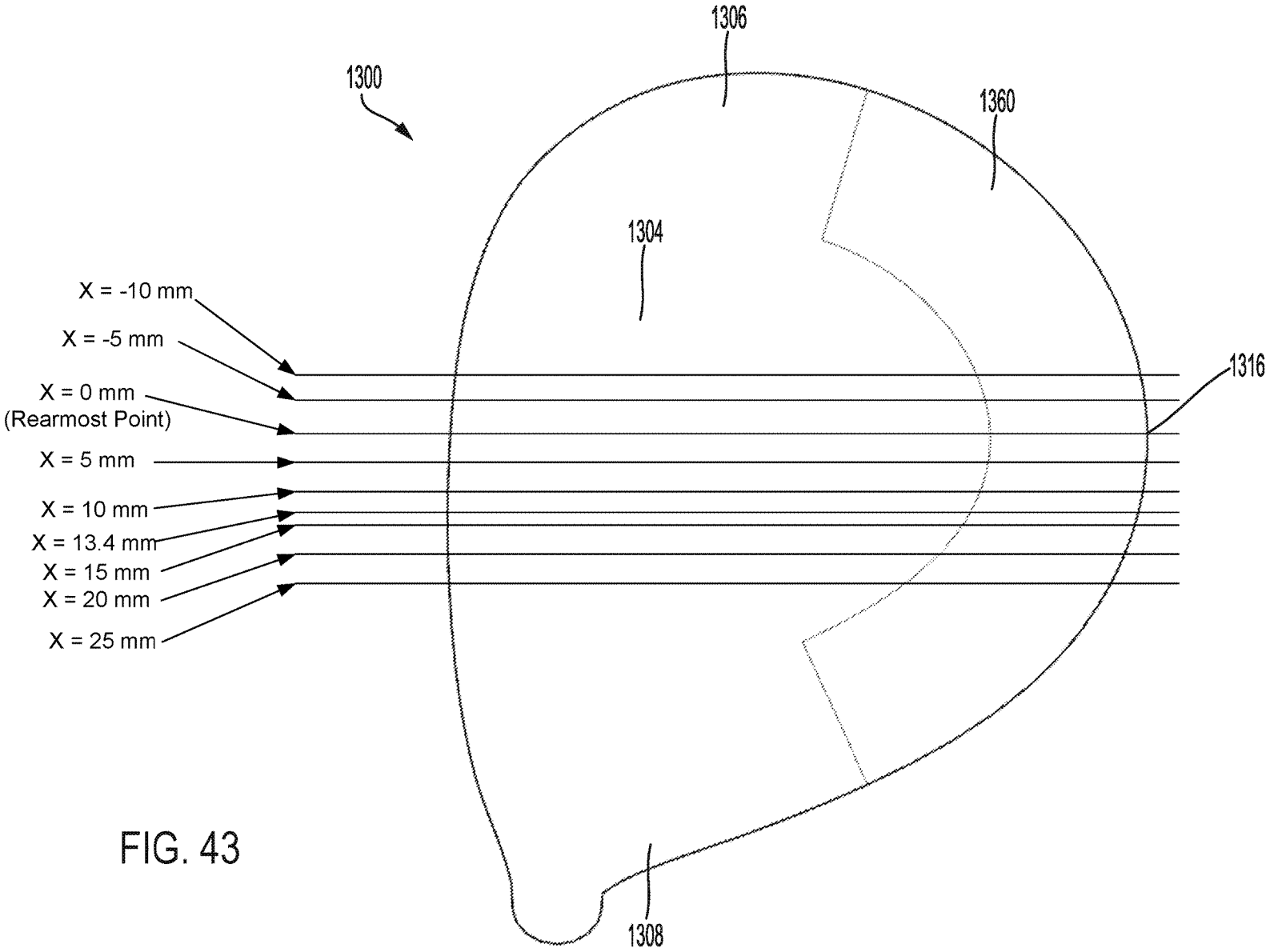
FIG. 43 depicts a top view of a golf club head with a series of cross-section cut lines.

FIG. 43 depicts a top view of a golf club head 1300 with a series of cross-section cut lines. The golf club head 1300 may be similar to the golf club head 1200 discussed above. For instance, the golf club head 1300 includes a crown 1304, a toe side 1306, a heel side 1308, and a rearmost point 1316. The golf club head 1300 may also include an aft slice 1360.

A series of different cut lines are shown in FIG. 43 in the front-to-back direction of the golf club head 1300, which may be referred to as the Z-direction. A first cut line is taken at X=0, which extends through the rearmost point 1316 of the golf club head 1300. The cut lines are then taken at different intervals in the heel-to-toe direction, which may be referred to as the X-direction. For instance, cut lines are provided towards the toe at X=−5 mm and X=−10 mm. Towards the heel from the rearmost point 1316, cut lines are taken at 5 mm intervals. Another cut line at face center of the of golf club head 1300, which is 13.4 mm towards the heel from the rearmost point 1316, is also provided.

Figure 44:
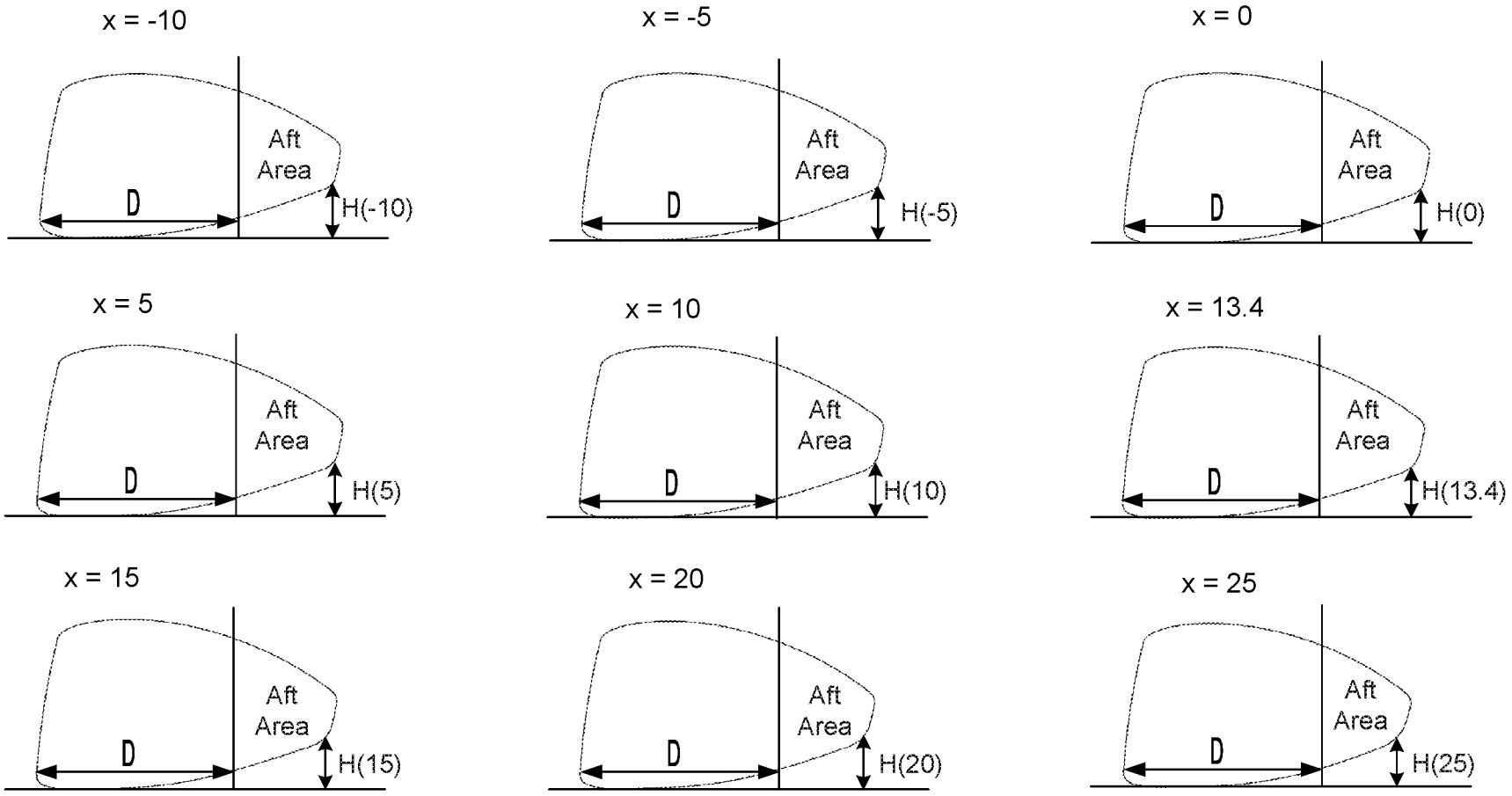
FIG. 44 depicts a plurality of cross sections of the golf club head at the cross-section lines of FIG. 43.

FIG. 44 depicts a plurality of cross sections of the golf club head 1300 at the cross-section lines of FIG. 43. The cross sections are shown from the heel view and show the outer perimeter of the golf club head 1300 at the cut section. The cross sections may be considered two-dimensional projections from the heel view at each of the cut lines. For instance, a cross section from the heel view of the golf club head is shown for the cut lines at X=−10 mm, −5 mm, 0 mm, 5 mm, 10 mm, 134 mm, 15 mm, 20 mm, and 25 mm.

Each of the cross sections may be defined by an aft area behind a distance D from the frontmost point of golf club head in the particular cross section. In some examples, the distance D may be the same values as the slice depth D. The aft area is the two-dimensional area of the cross-section projection behind a vertical plane at the distance D and bounded by the remaining aft perimeter of the golf club head. In some examples, the aft area for a toe side projection may be less than the aft area for the equivalent heel side projection. For instance, the aft area for the cross section at X=−10 mm may be less than the aft area for the cross section at X=10 mm. Similarly, the aft area for the cross section at X=−25 mm (e.g., 25 mm towards the toe from the rearmost point 1316) may be less than the aft area for the cross section at X=25 (e.g., 25 mm towards the heel from the rearmost point 1316).

The height (H) of the skirt or boat tail above the ground plane may also be asymmetric about the rearmost point 1316. For example, the height of the skirt above the ground plane for a toe-side projection may be higher than that of an equivalent heel side projection. For example, a height (H) of the skirt or boat tail for the projection at X=25 mm may be less than the height (H) of the skirt or boat tail at the projection X=−25 mm. The skirt or boat tail thickness may also be asymmetric about the rearmost point 1316. For instance, the thickness of the skirt or boat tail may be greater for a heel-side projection than that of an equivalent toe side projection.

Although specific devices have been recited throughout the disclosure as performing specific functions, one of skill in the art will appreciate that these devices are provided for illustrative purposes, and other devices may be employed to perform the functionality disclosed herein without departing from the scope of the disclosure. This disclosure describes some embodiments of the present technology with reference to the accompanying drawings, in which only some of the possible embodiments were shown. Other aspects may, however, be embodied in many different forms and should not be construed as limited to the embodiments set forth herein. Rather, these embodiments were provided so that this disclosure was thorough and complete and fully conveyed the scope of the possible embodiments to those skilled in the art.

Further, as used herein and in the claims, the phrase "at least one of element A, element B, or element C" is intended to convey any of: element A, element B, element C, elements A and B, elements A and C, elements B and C, and elements A, B, and C. Further, one having skill in the art will understand the degree to which terms such as "about" or "substantially" convey in light of the measurement techniques utilized herein. To the extent such terms may not be clearly defined or understood by one having skill in the art, the term "about" shall mean plus or minus ten percent.

Although specific embodiments are described herein, the scope of the technology is not limited to those specific embodiments. Moreover, while different examples and embodiments may be described separately, such embodiments and examples may be combined with one another in implementing the technology described herein. One skilled in the art will recognize other embodiments or improvements that are within the scope and spirit of the present technology. Therefore, the specific structure, acts, or media are disclosed only as illustrative embodiments. The scope of the technology is defined by the following claims and any equivalents therein.

What is claimed is:

1. A metal-wood type golf club head comprising:

a striking face defining a frontmost point of the golf club head;

a sole connected to a bottom side of the striking face; and a crown connected to a top side of the striking face, wherein an aft slice of the golf club head is defined as a portion of the golf club head to a rear of a slice line and between an outer perimeter of a rear portion of the golf club head and an offset perimeter slice curve having a shape corresponding to a shape of the outer perimeter of the rear portion of the golf club head, and wherein:

the slice line extends in a heel-to-toe direction and is located a slice depth rearward from the frontmost point, the slice depth being equal to 60% of a front-to-back length of the golf club head;

the offset perimeter slice curve is offset from the outer perimeter of the rear portion of the golf club head by a perimeter offset distance of 1 inch;

the aft slice includes a rearmost point, a toe-side aft slice defined as a portion of the aft slice on the toe side of the rearmost point, and a heel-side aft slice defined as a portion of the aft slice on the heel side of the rearmost point;

a volume of the heel-side aft slice is at least 15% greater than a volume of the toe-side aft slice;

the aft slice defines a first area in a first cross-sectional plane perpendicular to the heel-to-toe direction and offset toe-ward from the rearmost point by 5 mm; and the aft slice defines a second area, greater than the first area, in a second cross-sectional plane perpendicular to the heel-to-toe direction and offset heel-ward from the rearmost point by 5 mm.

2. The golf club head of claim 1, wherein:

the heel-side aft slice includes a heel-side interior-most point;

the toe-side aft slice includes a toe-side interior-most point; and the golf club head is configured such that, when arranged in an address position on a ground plane, the toe-side interior-most point is positioned higher above the ground plane than the heel-side interior-most point.

3. The golf club head of claim 2, wherein the toe-side interior-most point is at least 0.2 inch above the heel-side interior-most point.

4. The golf club head of claim 2, wherein the toe-side interior-most point is positioned above the heel-side interior-most point by an asymmetrical distance that is at least 5% of a height of the golf club head.

5. The golf club head of claim 1, further comprising a skirt having a thickness that is asymmetric about the rearmost point.

6. A metal-wood type golf club head comprising:

a striking face defining a frontmost point of the golf club head;

a sole connected to a bottom side of the striking face;

a crown connected to a top side of the striking face; and wherein an aft slice of the golf club head is defined as a portion of the golf club head to a rear of a slice line and between an outer perimeter of a rear portion of the golf club head and an offset perimeter slice curve having a shape corresponding to a shape of the outer perimeter of the rear portion of the golf club head, wherein:

the slice line extends in a heel-to-toe direction and is located a slice depth rearward from the frontmost point, the slice depth being equal to 60% of a front-to-back length of the golf club head;

the offset perimeter slice curve is offset from the outer perimeter of the rear portion of the golf club head by a perimeter offset distance of 1 inch; and the aft slice includes a rearmost point, a heel-side interior-most point, and a toe-side interior-most point, the golf club head being configured such that, when arranged in an address position on a ground plane, the toe-side interior-most point is positioned higher above the ground plane than the heel-side interior-most point by an asymmetrical distance that is at least 10% of a height of the golf club head.

7. The golf club head of claim 6, wherein the toe-side interior-most point is at least 0.2 inch above the heel-side interior-most point.

8. The golf club head of claim 6, wherein the aft slice includes a toe-side aft slice, defined as a portion of the aft slice on the toe side of the rearmost point, and a heel-side aft slice defined as a portion of the aft slice on the heel side of the rearmost point, and wherein the heel-side aft slice has a volume greater than a volume of the toe-side aft slice.

9. The golf club head of claim 8, wherein the volume of the heel-side aft slice is at least 5% greater than the volume of the toe-side aft slice.

10. The golf club head of claim 9, wherein the volume of the heel-side aft slice is at least 20% greater than the volume of the toe-side aft slice.

11. The golf club head of claim 6, further comprising a skirt having a thickness that is asymmetric about the rearmost point.

12. A metal-wood type golf club head comprising:

a striking face defining a frontmost point of the golf club head;

a sole connected to a bottom side of the striking face; and a crown connected to a top side of the striking face, wherein an aft slice of the golf club head is defined as a portion of the golf club head to a rear of a slice line and between an outer perimeter of a rear portion of the golf club head and an offset perimeter slice curve having a shape corresponding to a shape of the outer perimeter of the rear portion of the golf club head, wherein the slice line extends in a heel-to-toe direction and is located a slice depth rearward from the frontmost point, the slice depth being equal to 60% of a front-to-back length of the golf club head, wherein the offset perimeter slice curve is offset from the outer perimeter of the rear portion of the golf club head by a perimeter offset distance of 1 inch, wherein the aft slice includes:

a rearmost point;

a toe-side aft slice defined as a portion of the aft slice on the toe side of the rearmost point and including a toe-side interior-most point; and a heel-side aft slice defined as a portion of the aft slice on the heel side of the rearmost point and including a heel-side interior-most point, wherein a volume of the heel-side aft slice is at least 15% greater than a volume of the toe-side aft slice, and wherein the golf club head is configured such that, when arranged in an address position on a ground plane, the toe-side interior-most point is positioned higher above the ground plane than the heel-side interior-most point by an asymmetrical distance that is at least 10% of a height of the golf club head.

13. The golf club head of claim 12, wherein the toe-side interior-most point is at least 0.2 inch above the heel-side interior-most point.

14. The golf club head of claim 12, wherein the volume of the heel-side aft slice is at least 20% greater than the volume of the toe-side aft slice.

15. The golf club head of claim 12, wherein a portion of the sole corresponding to the toe-side aft slice includes a convex segment and a portion of the sole corresponding to the heel-side aft slice is entirely convex.

* * * * *